US005832851A

United States Patent [19]

Kato

[11] Patent Number: 5,832,851

[45] Date of Patent: Nov. 10, 1998

[54] SEWING MACHINE

[75] Inventor: Satoshi Kato, Kariya, Japan

[73] Assignee: Brother Kogyo Kabushiki Kaisha, Nagoya, Japan

[21] Appl. No.: 835,738

[22] Filed: Apr. 10, 1997

Related U.S. Application Data

[63] Continuation-in-part of Ser. No. 813,297, Mar. 10, 1997, Pat. No. 5,718,183.

[30] Foreign Application Priority Data

| | | | |
|---|---|---|---|
| Mar. 11, 1996 | [JP] | Japan | 8-083352 |
| Mar. 13, 1996 | [JP] | Japan | 8-085917 |
| Apr. 15, 1996 | [JP] | Japan | 8-118506 |
| Feb. 21, 1997 | [JP] | Japan | 9-054012 |

[51] Int. Cl.[6] ..... D05B 19/00; D05B 57/30

[52] U.S. Cl. ..... 112/470.01; 112/181; 112/220

[58] Field of Search ..... 112/470.01, 181, 112/201, 220, 155, 470.06, 102.5, 231

[56] References Cited

U.S. PATENT DOCUMENTS

| | | | |
|---|---|---|---|
| 2,718,858 | 9/1955 | Ritter | 112/181 |
| 5,189,971 | 3/1993 | Frankel et al. | 112/220 |
| 5,458,075 | 10/1995 | Tice et al. | 112/220 X |
| 5,474,001 | 12/1995 | Tajima et al. . | |
| 5,660,129 | 8/1997 | Murata et al. | 112/220 X |

FOREIGN PATENT DOCUMENTS

| | | |
|---|---|---|
| B2-60-21750 | 5/1985 | Japan . |
| A-3-234291 | 10/1991 | Japan . |

*Primary Examiner*—Peter Nerbun
*Attorney, Agent, or Firm*—Oliff & Berridge, PLC

[57] ABSTRACT

A sewing machine including a needle bar to which a sewing needle conveying a sewing thread is secured, a loop catcher which catches a loop of the sewing thread conveyed by the sewing needle, a catcher shaft which is fixed to the loop catcher, a first drive device which includes an output shaft and which rotates the catcher shaft and thereby rotates the loop catcher, and a coupling device which connects the catcher shaft to the output shaft of the first drive device such that a drive force of the first drive device is transmitted to the loop catcher via the output shaft, the coupling device and the catcher shaft, and such that the catcher shaft is movable in an axial direction thereof relative to the output shaft while a phase of the catcher shaft relative to the output shaft is substantially maintained.

25 Claims, 36 Drawing Sheets

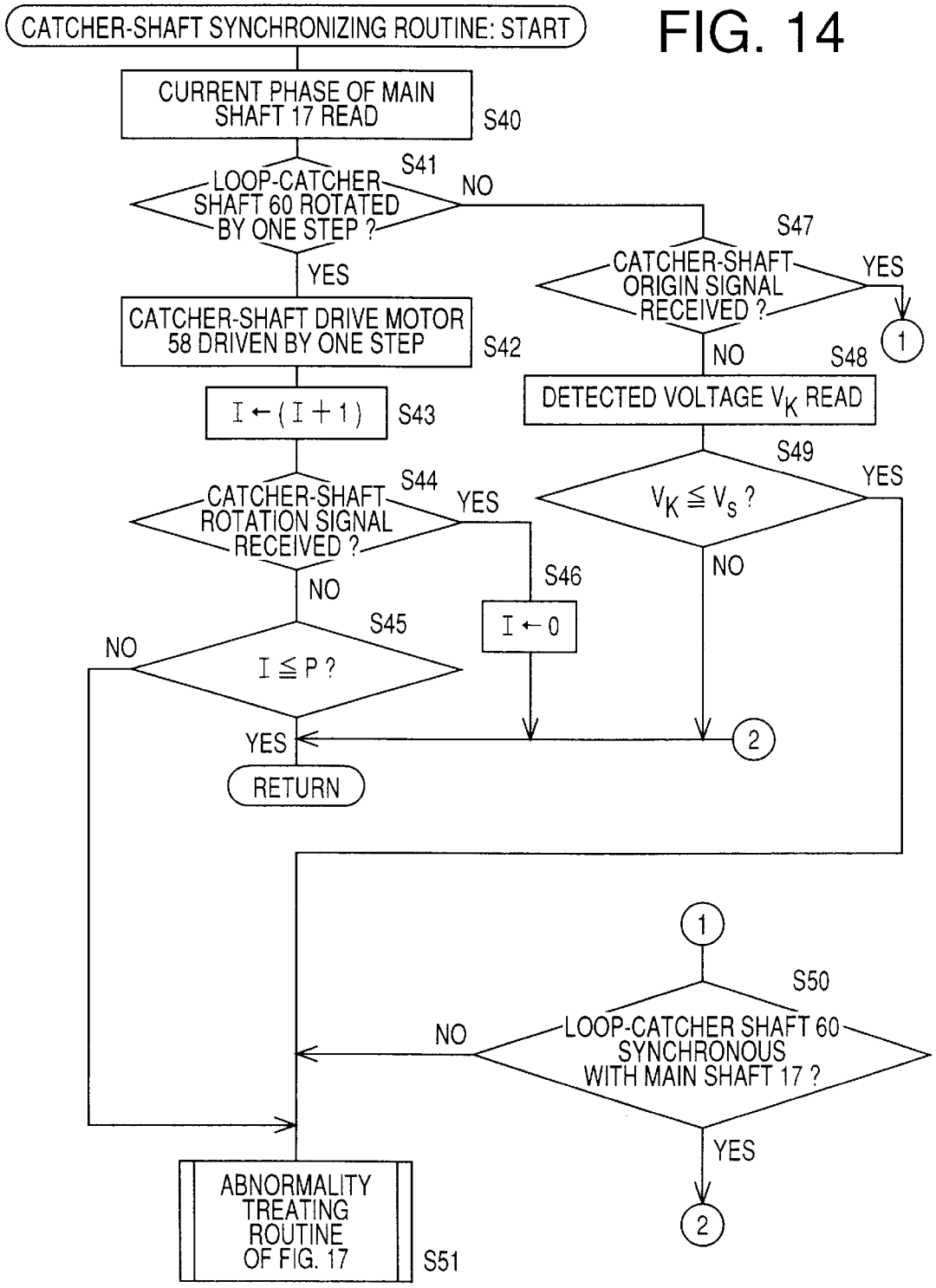
CATCHER-SHAFT SYNCHRONIZING ROUTINE: START
FIG. 14
CURRENT PHASE OF MAIN SHAFT 17 READ
S40
S41
LOOP-CATCHER SHAFT 60 ROTATED BY ONE STEP ?
NO
YES
CATCHER-SHAFT DRIVE MOTOR 58 DRIVEN BY ONE STEP
S42
I ← (I + 1)
S43
S44
CATCHER-SHAFT ROTATION SIGNAL RECEIVED ?
YES
NO
S46
I ← 0
S45
I ≦ P ?
NO
YES
RETURN
S47
CATCHER-SHAFT ORIGIN SIGNAL RECEIVED ?
YES
NO
1
S48
DETECTED VOLTAGE $V_K$ READ
S49
$V_K \leqq V_S$ ?
YES
NO
2
1
S50
LOOP-CATCHER SHAFT 60 SYNCHRONOUS WITH MAIN SHAFT 17 ?
NO
YES
2
ABNORMALITY TREATING ROUTINE OF FIG. 17
S51

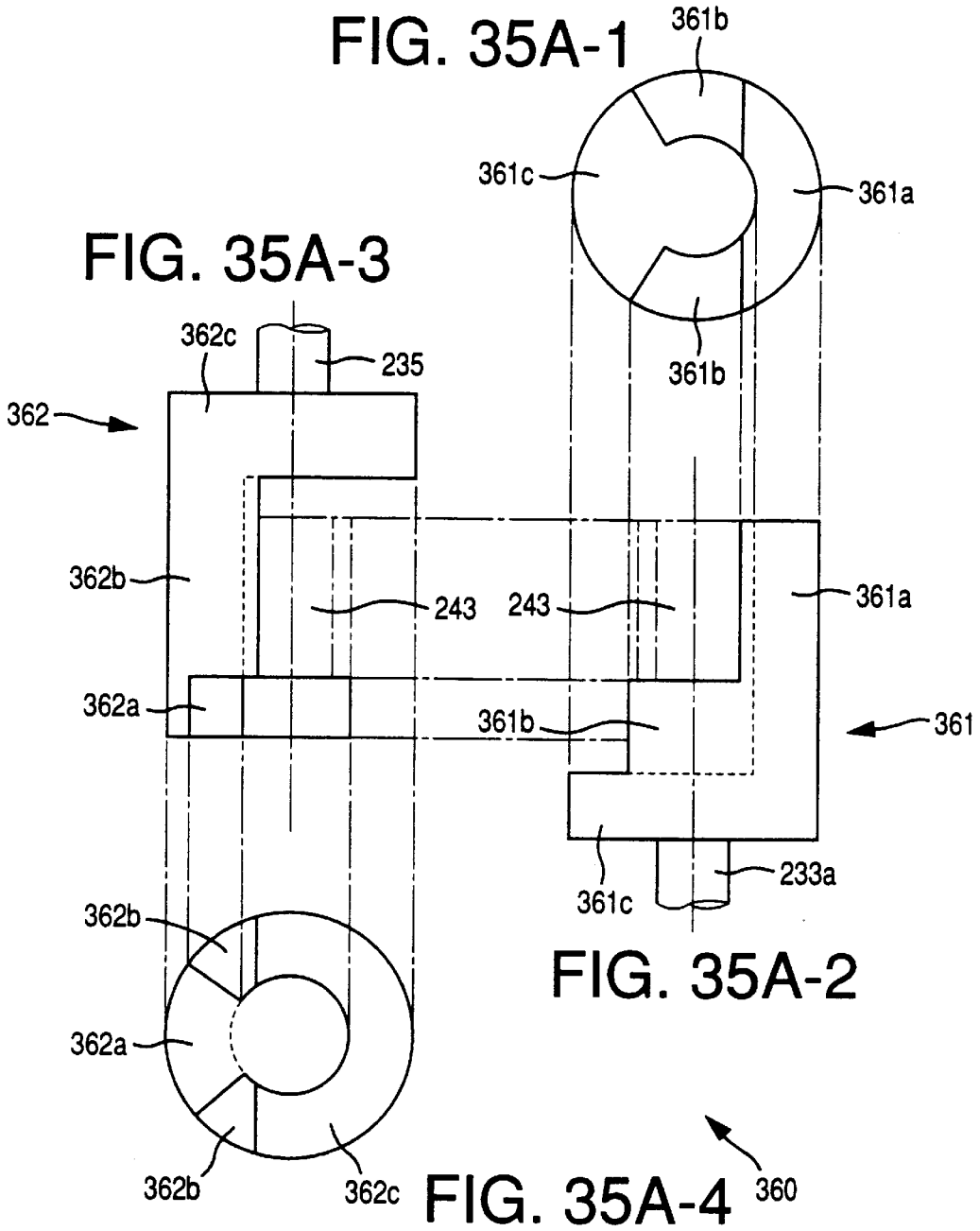
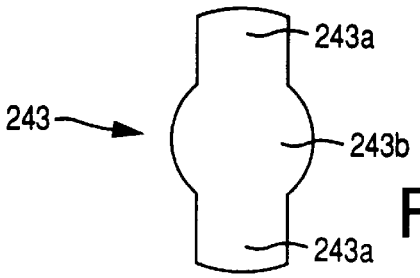
FIG. 35B

SEWING MACHINE

This is a continuation-in-part application from the patent application Ser. No. 08/813,297, filed on Mar. 10, 1997 (Attorney Docket No. JAO 39372), now U.S. Pat. No. 5,718,183.

BACKGROUND OF THE INVENTION

1. Field of the Invention

The present invention relates to a sewing machine in which a loop catcher is fixed to a loop-catcher shaft driven or rotated by a drive device.

2. Related Art Statement

There is known a sewing machine which is essentially provided by a sewing head, an arm portion, a column portion, and a sewing bed. A main shaft which is driven by a main motor is provided in the arm portion, and a needle bar and a take-up lever of the sewing head are driven or reciprocated by the driving force of the main shaft. A loop-catcher shaft (i.e., lower shaft) and a loop catcher which cooperates with a sewing needle secured to the needle bar are provided in the sewing bed. The catcher shaft is also driven or rotated by the driving force obtained from the main shaft. Thus, the sewing machine is of an interlocked-drive type, and the loop catcher is rotated in synchronism with the reciprocation of the sewing needle.

In the above sewing machine, the loop catcher is attached to the catcher shaft, using a screw. When a user wants to change, depending upon given sewing conditions, a needle clearance between the sewing needle and a point-of-hook of the loop catcher as measured in an axial direction of the catcher shaft, the user first loosens the screw whereby, however, not only the needle clearance but also an angular phase of the loop catcher relative to the catcher shaft (i.e., timing when the point-of-hook of the catcher meets the sewing needle) become changeable. Accordingly, the user needs to rotate the main shaft to move the sewing needle to its predetermined meeting position and adjust the point-of-hook of the loop catcher to its predetermined meeting position, with accuracy, using an exclusive gauge or his or her naked eyes. In addition, the user needs to adjust the needle clearance between the point-of-hook and the sewing needle, with accuracy. In this state, the screw is re-fastened to attach the loop catcher to the catcher shaft. Those adjusting operations are very cumbersome and time-consuming.

By the way, if the sewing machine is provided with an exclusive drive motor which drives the loop catcher or the catcher shaft independent of the main shaft, the instantaneous rotating state of the loop catcher can be controlled depending upon the given sewing conditions, while the rotation of the loop catcher is synchronized with the rotation of the main shaft.

For example, Japanese Patent Application laid open for opposition under Publication No. 60(1985)-21750 discloses a sewing machine including a needle drive motor for driving a sewing needle and a loop-catcher drive motor for driving a loop catcher. This sewing machine is of an independent-drive type, and the two motors are controlled by a control device to synchronize the reciprocation of the sewing needle and the rotation of the loop catcher with each other and thereby form a series of stitches.

The above-indicated, second sewing machine suffers from the same problem. That is, when a user wants to change a needle clearance depending upon given sewing conditions, he or she may need to adjust the needle clearance and additionally adjust the loop catcher and the sewing needle to their predetermined meeting positions, using an exclusive gauge or his or her naked eyes, before a vise is re-fastened to attach the loop catcher to a loop-catcher shaft. Those adjusting operations are very cumbersome and time-consuming.

SUMMARY OF THE INVENTION

It is therefore an object of the present invention to provide a sewing machine in which a needle clearance is easily adjustable.

According to a first aspect of the present invention, there is provided a sewing machine comprising a needle bar to which a sewing needle conveying a sewing thread is secured; a loop catcher which catches a loop of the sewing thread conveyed by the sewing needle; a catcher shaft which is fixed to the loop catcher; a first drive device which includes an output shaft and which rotates the catcher shaft and thereby rotates the loop catcher; and a coupling device which connects the catcher shaft to the output shaft of the first drive device such that a drive force of the first drive device is transmitted to the loop catcher via the output shaft, the coupling device and the catcher shaft, and such that the catcher shaft is movable in an axial direction thereof relative to the output shaft while a phase of the catcher shaft relative to the output shaft is substantially maintained.

In the sewing machine in accordance with the first aspect of the invention, since the catcher shaft is connected to the output shaft by the coupling device, a needle clearance between the sewing needle and a point-of-hook of the loop catcher as measured in the axial direction of the catcher shaft is easily adjustable without causing any substantial change in the phase of the catcher shaft relative to the output shaft, accordingly, any substantial change of respective meeting positions of the point-of-hook and the sewing needle relative to each other.

According to a preferred feature of the first aspect of the invention, the sewing machine further comprises a main shaft to which the needle bar is connected, and a second drive device which rotates the main shaft and thereby reciprocates the needle bar, the first drive device being independent of the second drive device. Each of the first and second drive devices may comprise an electric motor. In this case, the sewing machine may further comprise a control device which controls the first and second drive devices to synchronize the reciprocation of the needle bar or the sewing needle and the rotation of the loop catcher with each other. The present sewing machine need not employ a connecting mechanism for connecting the main shaft and the catcher shaft to each other. In addition, the first drive device may be constituted by a small-size unit (e.g., known as "shuttle module") which is detachably attached to a sewing bed of the sewing machine.

According to another feature of the present invention, the coupling device comprises a first connecting member which is fixed to the output shaft of the drive motor and which includes a drive-force output portion, a second connecting member which is fixed to the catcher shaft fixed to the loop catcher and which includes a drive-force input portion, and a buffer member which is provided between the drive-force output and input portions. In this case, the coupling device enjoys a simple construction. The drive force transmitted from the output shaft of the first drive device to the drive-force output portion of the first connecting member is transmitted via the buffer member to the drive-force input portion of the second connecting member. The catcher shaft is movable in the axial direction thereof relative to the output shaft of the first drive device, while the angular phase of the catcher shaft relative to the output shaft of the first drive motor is substantially maintained. The buffer member absorbs abrupt changes of the load exerted by the loop catcher to the first drive device. In addition, since the first and second connecting members do not directly contact each other because of the provision of the buffer member therebetween, noise is prevented from being produced because of otherwise possible contact thereof. However, the buffer member may be omitted.

According to another feature of the present invention, the buffer member is formed of a material selected from the group consisting of a rubber and a resin. Preferably, the buffer member is formed of a hard rubber or a soft resin.

According to another feature of the present invention, one of the first and second connecting members which is fixed to a corresponding one of the output shaft and the catcher shaft includes an engaging portion which engages the other one of the output shaft and the catcher shaft such that the other shaft is not movable relative to the engaging portion in a direction perpendicular to the axial direction of the catcher shaft, so that the output shaft and the catcher shaft are concentrically connected to each other. In this case, the drive force output from the first drive device is transmitted to the loop catcher with high efficiency.

According to another feature of the present invention, the engaging portion comprises at least one of an engaging hole and an engaging projection. The other shaft may fit in the engaging hole, or may have an engaging hole in which the engaging projection fits. Otherwise, the other shaft may be fit in a plurality of engaging projections arranged along a small circle.

According to another feature of the present invention, the first connecting member includes the drive-force output portion extending parallel to the output shaft, the second connecting member includes the drive-force input portion extending parallel to the catcher shaft and being opposed to the drive-force output portion in a direction perpendicular to the axial direction of the catcher shaft, and the buffer member is sandwiched between the drive-force output and input portions. The buffer member may be slightly compressed between the output and input portions of the first and second connecting members.

According to another feature of the present invention, the first connecting member additionally includes one of (a) a first engaging portion including a circular portion having a first outer diameter and a first part-doughnut portion which has a first inner diameter equal to the first outer diameter and a second outer diameter greater than the first inner diameter and which is integral with the circular portion and extends over a first angle smaller than 180° and (b) a second engaging portion including a second part-doughnut engaging portion which has the first inner diameter and the second outer diameter and which extends over a second angle which is greater than 180° and adds to the first angle to provide 360°, and the second connecting member additionally includes the other of the first and second engaging portions, the first and second engaging portions engaging each other such that the first and second engaging portions are not movable relative to each other in a direction perpendicular to the axial direction of the catcher shaft, so that the output shaft and the catcher shaft are concentrically connected to each other. The first and second angles may add to each other to provide an added angle slightly smaller than 360°, in the case where the buffer member is sandwiched between the drive-force output and input portions of the first and second connecting members such that the buffer member is slightly compressed.

According to another feature of the present invention, the first connecting member includes the drive-force output portion which engages a first engaging portion of the buffer member such that the buffer member is not movable relative to the drive-force output portion in a direction perpendicular to the axial direction of the catcher shaft, and the second connecting member includes the drive-force input portion which engages a second engaging portion of the buffer member such that the buffer member is not movable relative to the drive-force input portion in the direction perpendicular to the axial direction and which is opposed via the buffer member to the drive-force output portion in the axial direction. The drive-force output portion of the first connecting member may comprise at least one pair of parallel engaging surfaces which are opposed to each other and which sandwich the first plate-like engaging portion of the buffer member, and the drive-force input portion of the second connecting member may comprise at least one pair of parallel engaging surfaces which are opposed to each other and which sandwich the second plate-like engaging portion of the buffer member. Otherwise, the drive-force output portion may comprise a plate-like projection having at least one pair of parallel engaging surfaces which are opposite to each other and which is sandwiched by two projections of the first engaging portion of the buffer member, and the drive-force input portion may comprise a plate-like projection having at least one pair of parallel engaging surfaces which are opposite to each other and which is sandwiched between two projections of the second engaging portion of the buffer member. In this case, the buffer member is subject to shear stresses when transmitting the drive force of the first drive device to the loop catcher. Each of the drive-force output and input portions may have two, three, or more pairs of parallel engaging opposed or opposite surfaces which are equiangularly arranged about the axis line of the output shaft or the catcher shaft. Each of the first and second engaging portions of the buffer member may have two, three, or more pairs of parallel engaging opposed or opposite surfaces which are equiangularly arranged about an axis line thereof.

According to another feature of the present invention, the sewing machine further comprises a position adjusting device which is operable for moving the catcher shaft in the axial direction thereof and thereby adjusting a position of the catcher shaft relative to the output shaft of the drive motor in the axial direction. In this case, the catcher shaft to which the loop catcher is fixed is easily adjustable in the axial direction of the catcher shaft by operating the position adjusting device.

According to another feature of the present invention, the sewing machine further comprises a housing in which the catcher shaft and the output shaft of the drive motor are accommodated, and the position adjusting device comprises a rotatable adjusting member which is supported by the housing such that the adjusting member is rotatable about an axis line thereof and which has a first engaging portion which is eccentric with respect to the axis line, a case member which is movable relative to the housing in the axial direction of the catcher shaft and which has a second engaging portion which is engaged with the first engaging portion, and at least one bearing which is fixed to the case member and which bears the catcher shaft while permitting the rotation thereof and inhibiting the movement thereof relative thereto in the axial direction. The first engaging portion may be an eccentric pin and the second engaging portion may be an elongate hole. In this case, the case member is moved relative to the housing in the axial direction of the catcher shaft, but is not rotated relative to the housing about the catcher shaft. Otherwise, the first engaging portion may be an eccentric pin and the second engaging portion may be a circular hole in which the pin just fits. In this case, the case member is not only moved relative to the housing in the axial direction of the catcher shaft but also is rotated relative to the housing about the catcher shaft. However, the angular phase of the catcher shaft is not changed relative to the output shaft of the first drive device.

According to a second aspect of the present invention, there is provided a sewing machine comprising a needle bar to which a sewing needle conveying a sewing thread is secured; a loop catcher which catches a loop of the sewing thread conveyed by the sewing needle; a catcher shaft which is fixed to the loop catcher; a drive device which includes an output shaft and which rotates the catcher shaft and thereby rotates the loop catcher, the catcher shaft being integrally connected to the output shaft of the drive device such that a drive force of the drive device is transmitted to the loop catcher via the output shaft and the catcher shaft, and such that the catcher shaft is movable in an axial direction thereof together with the output shaft; and a position adjusting device which is operable for moving the catcher shaft and the output shaft of the drive device integrally connected to each other, in the axial direction of the catcher shaft, and thereby adjusting a position of the loop catcher in the axial direction.

In the sewing machine in accordance with the second aspect of the invention, the catcher shaft to which the loop catcher is fixed is integrally connected to the output shaft of the drive device, such that the catcher shaft is movable in the axial direction thereof together with the output shaft. Therefore, the position of the loop catcher is easily adjustable in the axial direction of the catcher shaft by operating the position adjusting device, without causing any change of the angular phase of the loop catcher relative to the output shaft of the drive device. The catcher shaft and the output shaft may be integrally connected to each other by a coupling device.

According to a preferred feature of the second aspect of the invention, the drive device comprises an electric motor including a rotor and a stator, the output shaft including a first portion fixed to the rotor, and a pair of bearings which bear a second and a third portion of the output shaft on both sides of the first portion thereof, respectively, while permitting the rotation of the output shaft and the movement thereof with the catcher shaft in the axial direction.

According to another feature of the second aspect of the invention, the sewing machine further comprises a housing in which the catcher shaft and the output shaft of the drive motor are accommodated, and a rotary encoder including a rotary plate which has a plurality of slits and which is fixed to the output shaft and the catcher shaft integrally connected to each other, and a light emitter and a light receiver which are fixed to the housing and are opposed to each other via the rotary plate, the light emitter emitting a light toward the light receiver, the light receiver receiving the light emitted by the light emitter and transmitted through each of the slits of the rotary plate, the light emitter and receiver being remote from each other by a distance which defines a greatest possible distance over which the loop catcher is movable in the axial direction. In this case, when the rotary plate is rotatable with the output shaft of the drive device, the rotary encoder produces a detection signal indicative of an amount of rotation of the rotary plate. It is preferred that the distance between the light emitter and receiver of the rotary encoder be great enough to enable the loop catcher to be moved over a sufficient distance to change the needle clearance by a sufficient amount.

According to another feature of the second aspect of the invention, the catcher shaft and the output shaft of the drive device are provided by a single shaft member. In this case, no coupling device is needed for integrally connecting the catcher shaft and the output shaft to each other.

According to a third aspect of the present invention, there is provided a sewing machine comprising a needle bar to which a sewing needle conveying a sewing thread is secured; a loop catcher which catches a loop of the sewing thread conveyed by the sewing needle; a catcher shaft which is fixed to the loop catcher; a drive device which includes an output shaft connected to the catcher shaft and which rotates the catcher shaft and thereby rotates the loop catcher; a supporting device which supports the catcher shaft such that the catcher shaft is movable in an axial direction thereof together with the loop catcher; and a position adjusting device which is operable for moving the catcher shaft in the axial direction thereof and thereby adjusting a position of the loop catcher in the axial direction.

In the sewing machine in accordance with the third aspect of the invention, the catcher shaft is supported by the supporting device such that the catcher shaft is movable in the axial direction thereof together with the loop catcher. Therefore, the position of the loop catcher is easily adjustable in the axial direction of the catcher shaft by operating the position adjusting device.

According to a preferred feature of the third aspect of the invention, the sewing machine further comprises a housing in which the catcher shaft and the output shaft of the drive motor are accommodated, and the supporting device comprises a case member which is movable relative to the housing in the axial direction of the catcher shaft, and at least one bearing which is fixed to the case member and which bears the catcher shaft while permitting the rotation thereof and inhibiting the movement thereof relative thereto in the axial direction.

According to another feature of the third aspect of the invention, the position adjusting device comprises a rotatable adjusting member which is supported by the housing such that the adjusting member is rotatable about an axis line thereof and which has a first engaging portion which is eccentric with respect to the axis line, and a second engaging portion of the case member which is engaged with the first engaging portion.

According to another feature of the third aspect of the invention, the position adjusting device further comprising a fastening device which fastens the case member to the housing to inhibit the movement of the case member in the axial direction of the catcher shaft and unfastens the case member from the housing to permit the case member to be moved in the axial direction of the catcher shaft as a result of rotation of the rotatable adjusting member.

According to another feature of the third aspect of the invention, the fastening device comprises an engaging surface of the case member, and an externally threaded member which is threadedly engaged with an internally threaded hole of the housing and which is engageable with the engaging surface to fasten the case member to the housing.

According to another feature of the third aspect of the invention, the position adjusting device further comprising a fastening device which fastens the rotatable adjusting member to the housing to inhibit the rotation of the adjusting member and thereby inhibit the movement of the case member in the axial direction of the catcher shaft and unfastens the adjusting member from the housing to permit the adjusting member to be rotated to move the case member in the axial direction of the catcher shaft.

According to another feature of the third aspect of the invention, the fastening device comprises an externally threaded member, an engaging portion of the housing which is engageable with a base portion of the rotatable adjusting member, and an internally threaded hole of the housing in which said base portion of the adjusting member is provided and with which the externally threaded member is threadedly engaged to press the adjusting member against the engaging portion of the housing so as to fasten the adjusting member to the housing.

According to another feature of the third aspect of the invention, the sewing machine further comprises a housing in which the catcher shaft and the output shaft of the drive motor are accommodated, and the supporting device comprises a case member which is movable relative to the housing in the axial direction of the catcher shaft, and at 1east one bearing which is fixed to the case member and which bears the catcher shaft while permitting the rotation thereof and inhibiting the movement thereof relative thereto in the axial direction, and the position adjusting device comprises a rotatable adjusting member which is supported by the housing such that the adjusting member is rotatable about an axis line thereof and which has an engaging projection which is eccentric with respect to the axis line, and an engaging elongate hole of the case member which is engaged with the engaging projection.

According to another feature of the third aspect of the invention, the sewing machine further comprises a coupling device which connects the catcher shaft to the output shaft of the drive device such that a drive force of the drive device is transmitted to the loop catcher via the output shaft, the coupling device and the catcher shaft, and such that the catcher shaft is movable in the axial direction thereof relative to the output shaft while a phase of the catcher shaft relative to the output shaft is substantially maintained.

According to another feature of the third aspect of the invention, the catcher shaft is integrally connected to the output shaft of the drive device such that a drive force of the drive device is transmitted to the loop catcher via the output shaft and the catcher shaft, and such that the catcher shaft is movable in the axial direction thereof together with the output shaft as well as the loop catcher.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 14 is a flow chart representing a catcher-shaft synchronizing routine;

FIG. 35A-1 to 35A-4 are a plan and a side view of each of a first and a second connecting member of another coupling device which is employed in another sewing machine as a third embodiment of the present invention;

FIG. 35B is a side view of a buffer member which is used with the first and second connecting members shown in FIG. 35A;

DETAILED DESCRIPTION OF THE PREFERRED EMBODIMENTS

Figure 1:
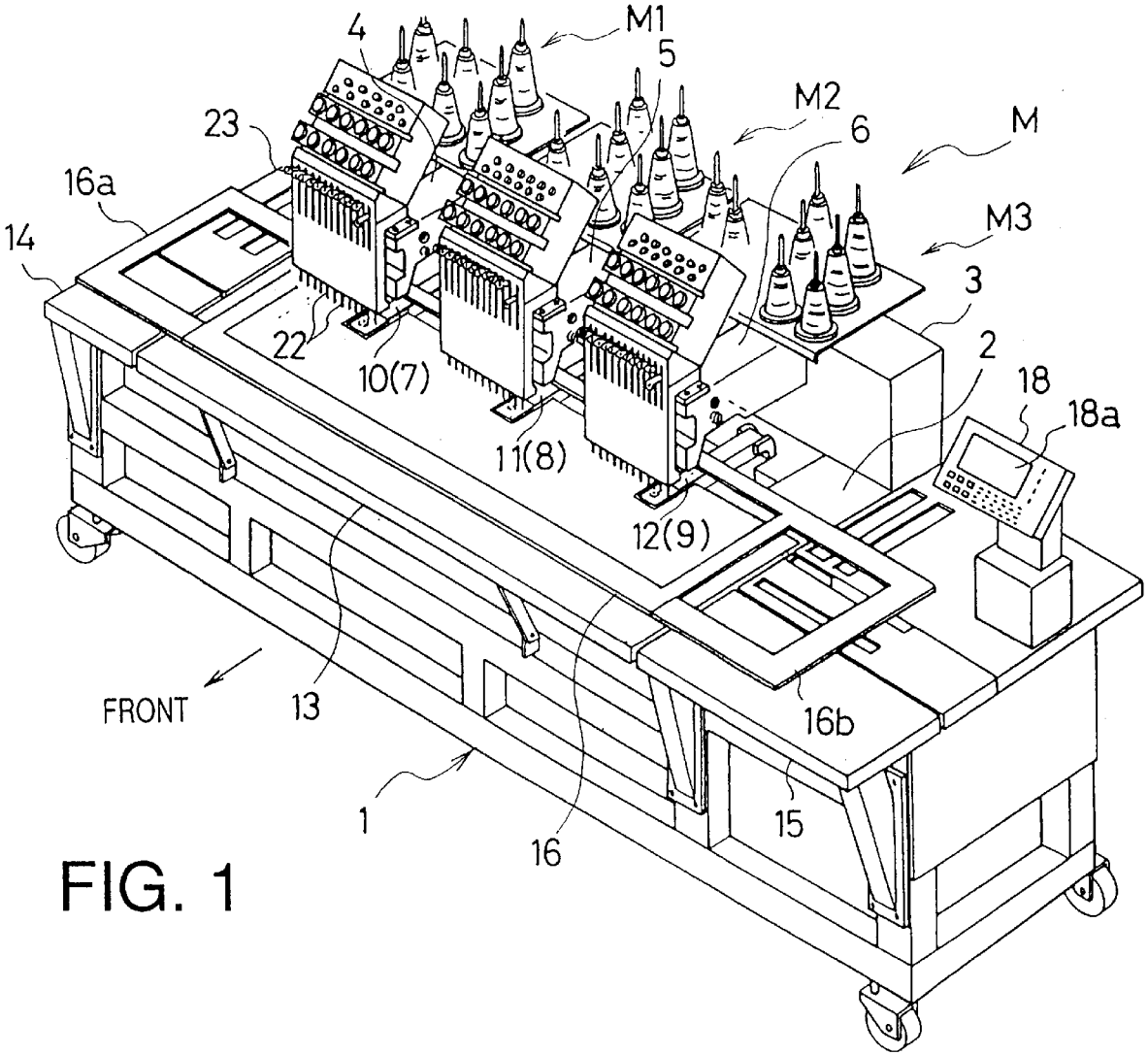
FIG. 1 is a perspective view of a multiple-head embroidering machine to which the present invention is applied.

FIG. 1 shows a multiple-head embroidering machine, M, to which the present invention is applied. The embroidering machine M includes three multiple-needle sewing machines, M1, M2, M3. Each sewing machine M1–M3 includes a loop catcher 59 in the form of a full-rotation shuttle (FIG. 4) which catches a loop of a needle thread 47 conveyed by a sewing needle 22 (FIG. 2), and a loop-catcher drive motor 58 (FIG. 4) which drives or rotates a loop-catcher shaft 60 of the loop catcher 59 and which is independent of a main motor 110 (FIG. 8) which drives or rotates a main shaft 17 (FIG. 2) and thereby reciprocates the needle 22.

As shown in FIG. 1, the embroidering machine M includes an elongate base frame 1. A support plate 2 is provided on a rear portion of the base frame 1. The support plate 2 has a predetermined length in the longitudinal direction of the base frame 1, and has a generally rectangular shape in its plan view. An elongate support frame 3 stands on a rear portion of the support plate 2, and supports three sewing heads 4, 5, 6 such that the three sewing heads 4–6 are equidistant from one another in the longitudinal direction of the support frame 3. Respective end portions of three sewing beds 7, 8, 9 in the form of three, generally cylindrical bed units 10, 11, 12 which correspond to the three sewing heads 4–6, respectively, are supported by an elongate portion of the base frame 1 which corresponds to a front end portion of the support plate 2.

Thus, the three multiple-needle sewing machines M1–M3 are provided by the three sewing heads 4–6 supported by the support frame 3, and the three bed units 10–12 which are independent of one another, respectively. A front end portion of the sewing head 4–6 of each sewing machine M1–M3 supports twelve needle bars 21 (FIG. 2) which are arranged in an array extending in the longitudinal direction of the base frame 1, such that one of the needle bars 21 which is positioned or indexed at an operating position is reciprocated up and down by the main motor 110 via the main shaft 17. Each sewing head 4–6 additionally has twelve take-up levers 23 which correspond to the twelve needle bars 21, respectively, and one of the twelve take-up levers 23 which corresponds to the said one needle bar 21 being positioned at the operating position is swung in synchronism with the reciprocation of the said one needle bar 21. The needle bars 21 and the take-up levers 23 are accommodated in a needle-bar case 20, which is supported by each sewing head 4–6 such that the needle-bar case 20 is movable in the longitudinal direction of the base frame 1. The respective needle-bar cases 20 of the three sewing heads 4–6 can be moved, simultaneously with one another, by a needle-bar changing device (not shown) which is driven by a needle-bar changing motor 115 (FIG. 8), so that color sewing threads 47 conveyed by a current group of sewing needles 22 being positioned at the respective operating positions are changed to different color sewing threads 47 conveyed by a new group of sewing needles 22.

A work table 13 is provided in front of the support plate 2 such that an upper surface of the work table 13 is flush with those of the bed units 10–12 and extends horizontally. An elongate movable frame 16 which extends in the longitudinal direction of the base frame 1 and has a rectangular shape in its plan view, is placed over the work table 13 and a pair of side tables 14, 15 which are provided on both sides of the work table 13, respectively.

One 16*b* of opposite end portions 16*a*, 16*b* of the movable frame 16 is driven or moved by an X-axis moving device (not shown) in an X-axis direction, i.e., in the longitudinal direction of the base frame 1, and the two end portions 16*a*, 16*b* are driven or moved by a Y-axis moving device (not shown) in a Y-axis direction perpendicular to the X-axis direction. The X-axis and Y-axis moving devices include an X-axis driving motor 117 and a Y-axis driving motor 119 (FIG. 8), respectively. Thus, the movable frame 16 is movable to an arbitrary position on an X-Y plane defined by the X-axis and Y-axis directions. An operator's panel 18 including a display 18*a* is provided on a rear portion of the side table 15. The display 18*a* displays various messages relating to a sewing operation. The operator's panel 18 is operable for inputting various commands into the embroidering machine M.

Figure 2:
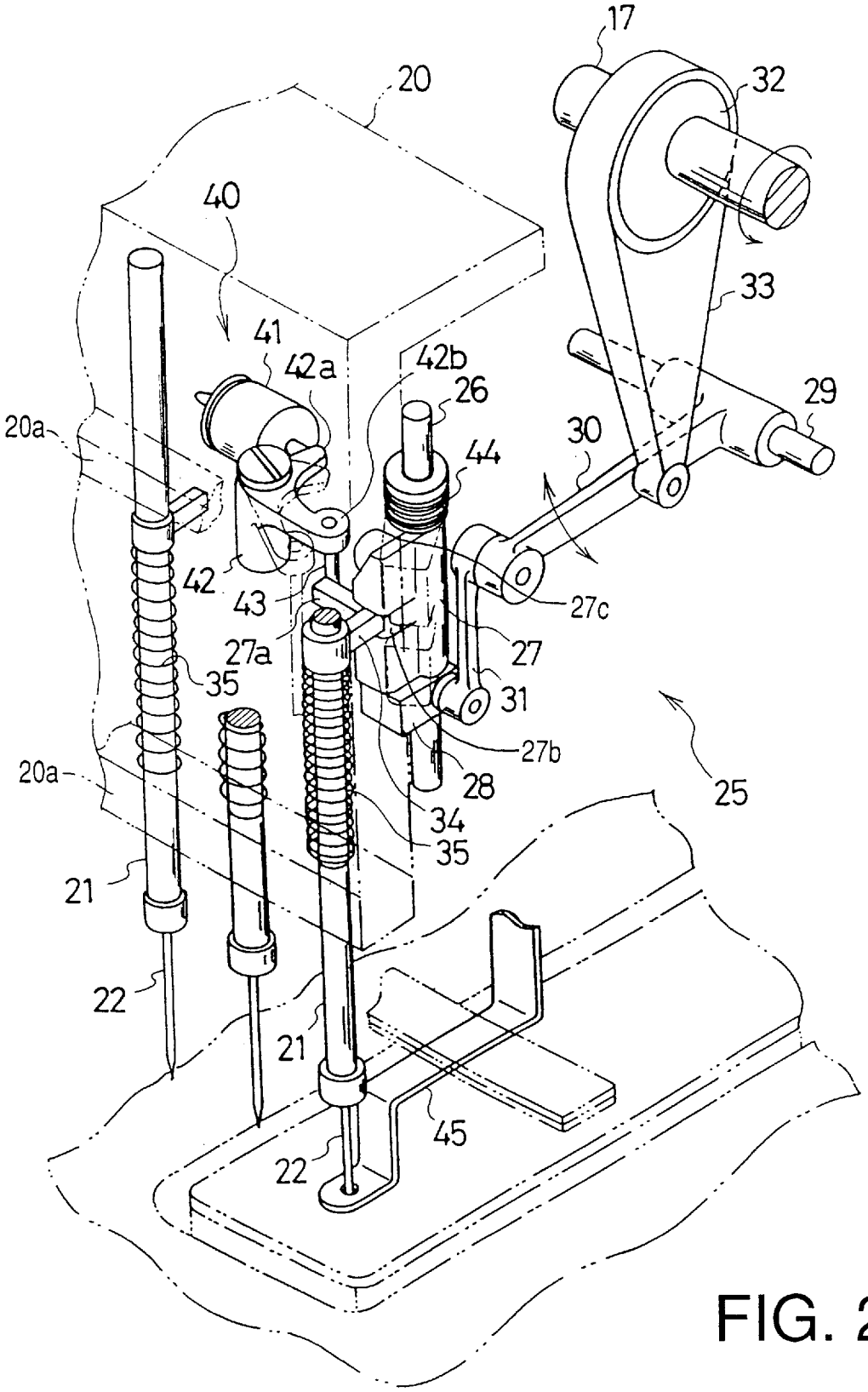
FIG. 2 is a perspective view of a needle-bar reciprocating device including a needle-bar jumping device.

Referring next to FIG. 2, there will be described a needle-bar drive device 25 which is employed by each sewing machine M1–M3 and which drives or reciprocates the needle bar 21 up and down.

The needle-bar drive device 25 includes an axis member 26 which vertically extends inside a front end portion of each sewing head 4–6. An upper and a lower end portion of the axis member 26 are supported by a main frame of each sewing head 4–6. A drive member 27 is fit on the axis member 26 such that the drive member 27 is movable relative to the axis member 26 vertically, i.e., in an axial direction of the axis member 26. The drive member 27 has an engageable recess 27*b* which is engageable with an engageable pin 34 which is fixed to the needle bar 21. A connection member 28 is fit on the axis member 26 such that the connection member 28 is vertically movable relative to the axis member 26 but is not rotatable relative to the same 26. A lower end portion of the drive member 27 is connected to an upper end portion of the connection member 28 such that the drive member 27 is vertically movable with the connection member 28 and is rotatable relative to the connection member 28 about the axis member 26. The connection member 28 is connected to a link member 31 which in turn is pivotally connected to a pivot lever 30 which is pivotally supported by a pivot axis member 29 fixed to the main frame of each sewing head 4–6.

A single main shaft 17 extends in the X-axis direction through the sewing heads 4–6. An eccentric cam 32 is fixed to the main shaft 17, and a lower end portion of an eccentric lever 33 which is externally fit on the eccentric cam 32 is pivotally connected to the pivot lever 30.

A sewing needle 22 is secured to a lower end of each of the twelve needle bars 21 of each sewing head 4–6. The engageable pin 34 is fixed to an intermediate position of each needle bar 21. A compression coil spring 35 is provided around an intermediate portion of the bar 21 between the engageable pin 34 and a lower support member 20*a* of the needle-bar case 20. The coil spring 35 biases the bar 21 toward an upper-dead position thereof, i.e., toward an upper support member 20*a*. When the needle-bar case 20 is moved in the X-axis direction, the engageable pin 34 of the needle bar 21 being positioned or indexed at the operating position is engaged with the engageable recess 27*b* of the drive member 27 being held at its upper-dead position corresponding to the upper-dead position of the needle bar 21.

When a main motor 110 (FIG. 8) is driven or rotated in a predetermined direction, the main shaft 17 is rotated in a corresponding direction. The rotation of the main shaft 17 is converted by a converting device including the eccentric lever 33, the pivot lever 30, and the link member 31, into the reciprocal movement of the drive member 27 and the connection member 28 as a unit on the axis member 26. Thus, only the needle bar 21 that is connected to the drive member 27 via the engageable pin 34 and the engageable recess 27*b* is reciprocated up and down in synchronism with the rotation of the main shaft 17.

Next, there will be described a needle-bar jumping device 40 which is employed in each sewing machine M1–M3 and which jumps the needle bar 21 up to the upper-dead position thereof.

As shown in FIG. 2, a needle-bar jumping solenoid 41 which has a horizontal plunger is provided in the needle-bar case 20. A rotatable lever 42 which has two arms 42*a*, 42*b* is supported by the needle-bar case 20, such that the lever 42 is rotatable about a vertical axis line. One 42*a* of the two arms 42*a*, 42*b* of the lever 42 is held in contact with the plunger of the solenoid 41. An operative member 43 is fixed to the other arm 42*b* of the lever 42, such that the operative member 43 vertically extends and is engageable with an engageable projection 27*a* which is formed as an integral part of the drive member 27 and projects from the same 27.

A coil spring 44 which is provided above the drive member 27 elastically biases the drive member 27 to rotate in a direction from a non-engageable rotation position, indicated in phantom line, where the drive member 27 cannot engage the engageable pin 34, toward an engageable rotation position, indicated in solid line, where the drive member 27 can engage the engageable pin 34.

When the needle-bar jumping solenoid 41 is energized for a predetermined time duration, with the drive member being engaged with the pin 34 of the needle bar 21, the plunger of the solenoid 41 is advanced to rotate the lever 42 in a clockwise direction in its plan view. The rotation of the lever 42 is transmitted to the drive member 27 via the axis member 43 and the projection 27*a*, so that the drive member 27 is rotated against the biasing force of the coil spring 44 from the engageable position to the non-engageable position where the recess 27*b* is disengaged from the pin 34 and the needle bar 21 is permitted to jump up to the upper-dead position because of the biasing force of the coil spring 25.

When the drive member 27 is moved up toward its upper-dead position with the needle bar 21 being held at its upper-dead position after jumping up and with the drive member 27 being held at its engageable position after returning, an inclined upper surface 27*c* of the drive member 27 is engaged with a lower surface of the pin 34, so that the drive member 27 is permitted to rotate to the non-engageable position against the biasing force of the coil spring 44. However, since subsequently the pin 34 engages the recess 27*b*, the drive member 27 is rotated toward the engageable position because of the biasing action of the spring 44. Thus, the drive member 27 and the needle bar 21 are automatically engaged with each other at their upper-dead positions.

Figure 8:
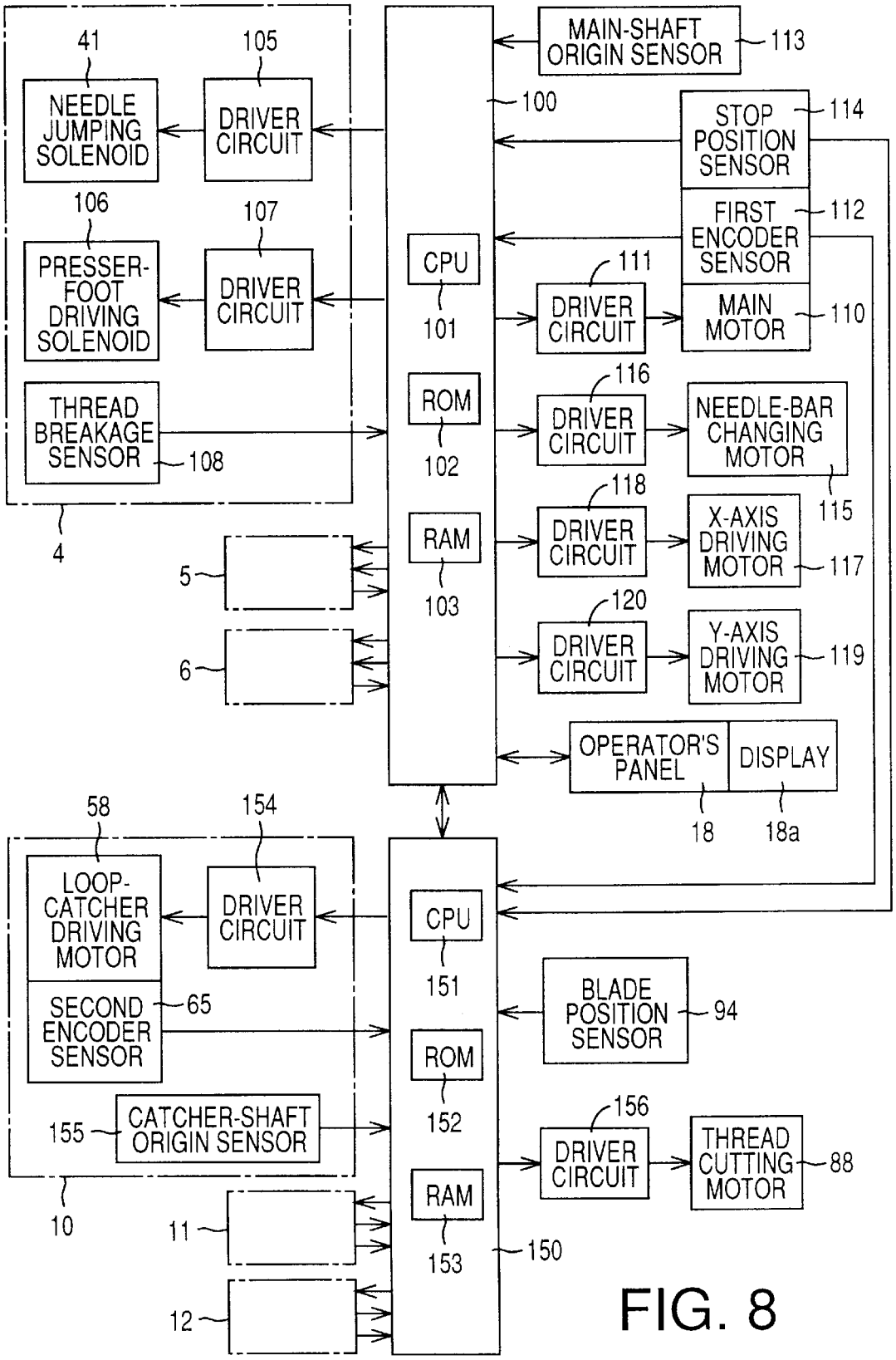
FIG. 8 is a block diagram of an electronic construction of the multiple-head embroidering machine of FIG. 1.

Each sewing bed 7–9 includes a presser foot 45 which is selectively moved to an operating position where the foot 45 presses a work sheet, W, held by the movable frame 16 above the bed 7–9, and a retracted position higher than the operating position by a predetermined distance. The presser foot 45 is moved by a presser-foot moving device (not shown) which is driven by a presser-foot driving solenoid 108 (FIG. 8).

Referring next to FIGS. 3 to 7, there will be described the bed units 10–12. Since the three bed units 10–12 have the same construction, one 10 of the three units 10–12 will be described.

The bed unit 10 includes a bed case 50 which extends in the Y-axis direction and which has a generally U-shaped cross section. A rear end portion of the bed case 50 is attached to a pair of support brackets 51 which are fixed to the elongate portion of the base frame 1 which corresponds to the front end portion of the support plate 2 and which extends in the X-axis direction. A loop-catcher module 55 is detachably attached to a front end portion of the bed case 50. An upper side of the front end portion of the bed case 50 is covered by a throat plate 52 having a needle throat 52*a*, and a cover plate 53 provided adjacent to the throat plate 52.

Next, the loop-catcher module 55 will be described in detail.

Figure 4:
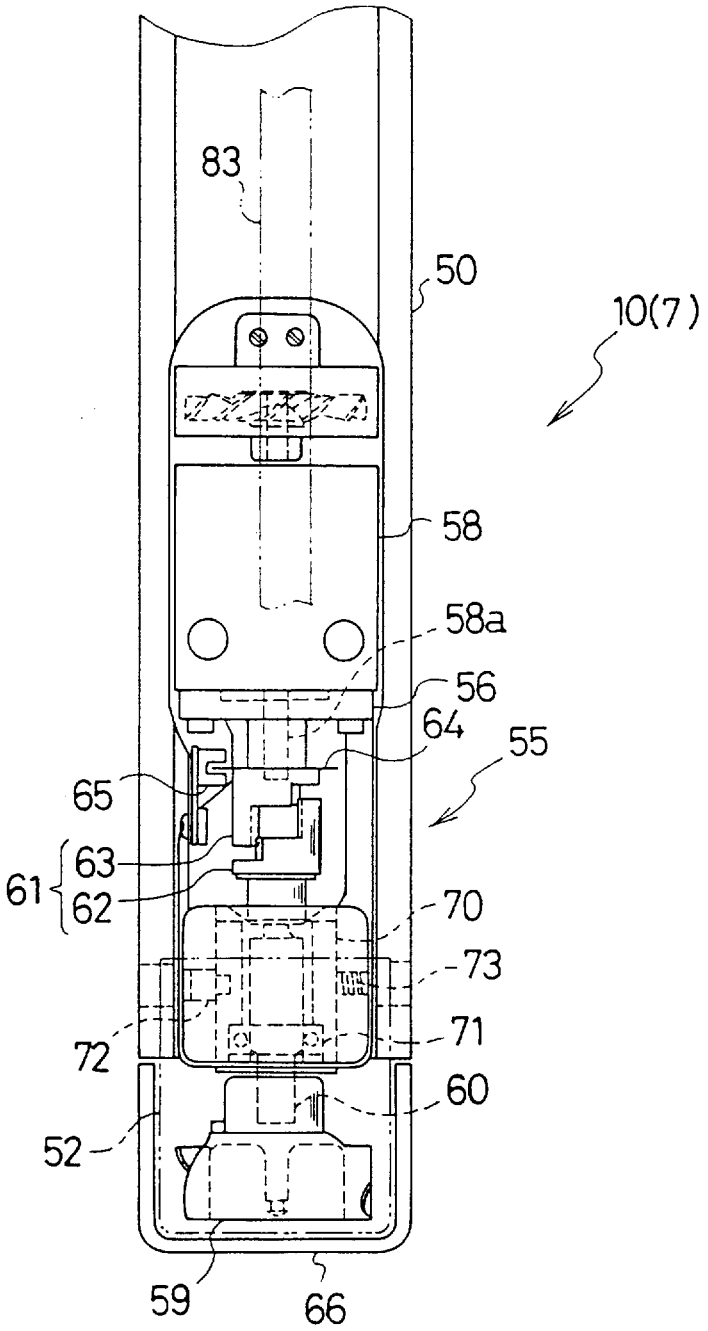
FIG. 4 is a plan view of a part of the bed unit which includes a loop-catcher module.
Figure 5:
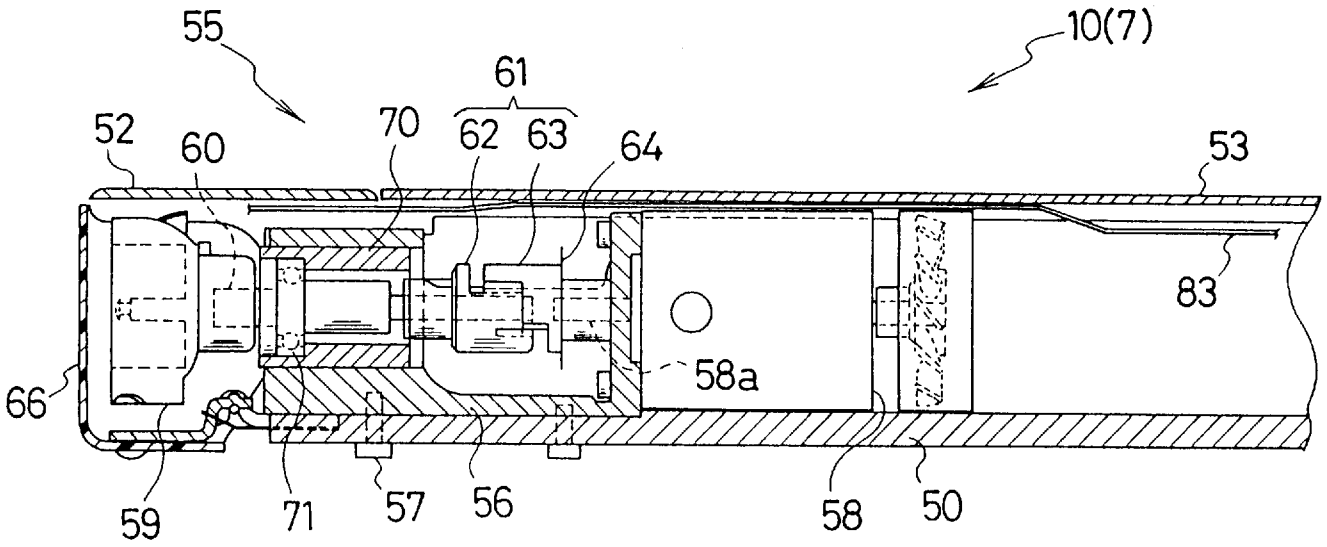
FIG. 5 is a longitudinal, cross section view of the part of the bed unit including the loop-catcher module.
Figure 6:
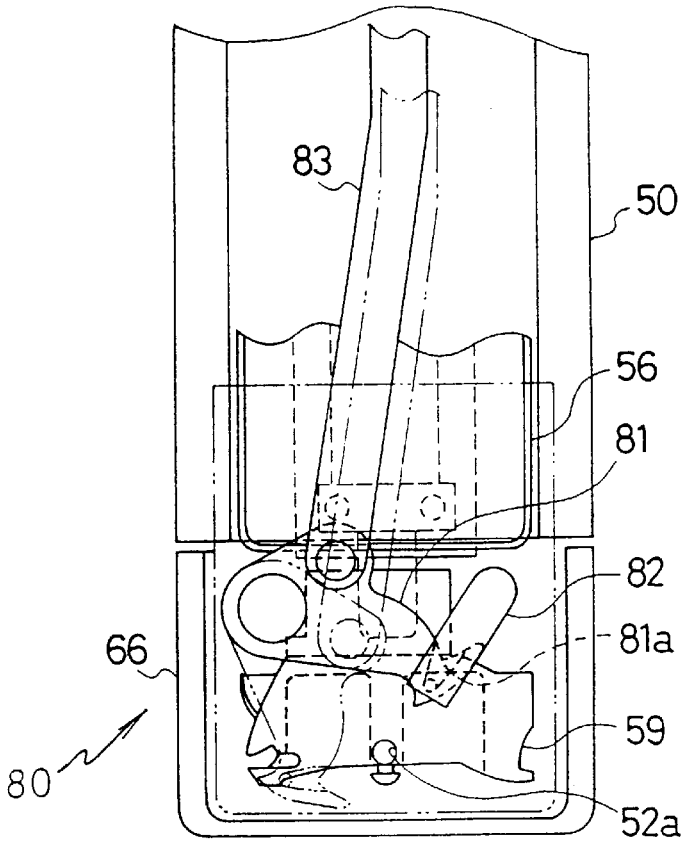
FIG. 6 is an enlarged plan view of a front end portion of the bed unit.

As shown in FIGS. 4 and 5, an attachment block 56 is attached, with a screw 57, to the front end portion of the bed case 50, and a loop-catcher drive motor 58 which is provided by a stepper motor is fixed to a rear end of the block 56. The loop catcher 59 which is provided by a full-rotation shuttle is disposed in front of the block 56, and a loop-catcher shaft 60 which is fixed to the loop catcher 59 is supported by the block 56 such that the catcher shaft 60 is rotatable about an axis line thereof and such that the shaft 60 is movable in the Y-axis direction, that is, the position of the shaft 60 is adjustable in the Y-axis direction. A first connection member 63 is fixed to a front end of a drive shaft 58*a* of the catcher drive motor 58, and a second connection member 62 is fixed to a rear end of the catcher shaft 60. The first and second connection members 63, 62 are connected to each other to provide a coupling or connecting device 61. Thus, the coupling device 61 connects between the catcher shaft 60 and the drive shaft 58*a* of the catcher drive motor 58.

Figure 21:
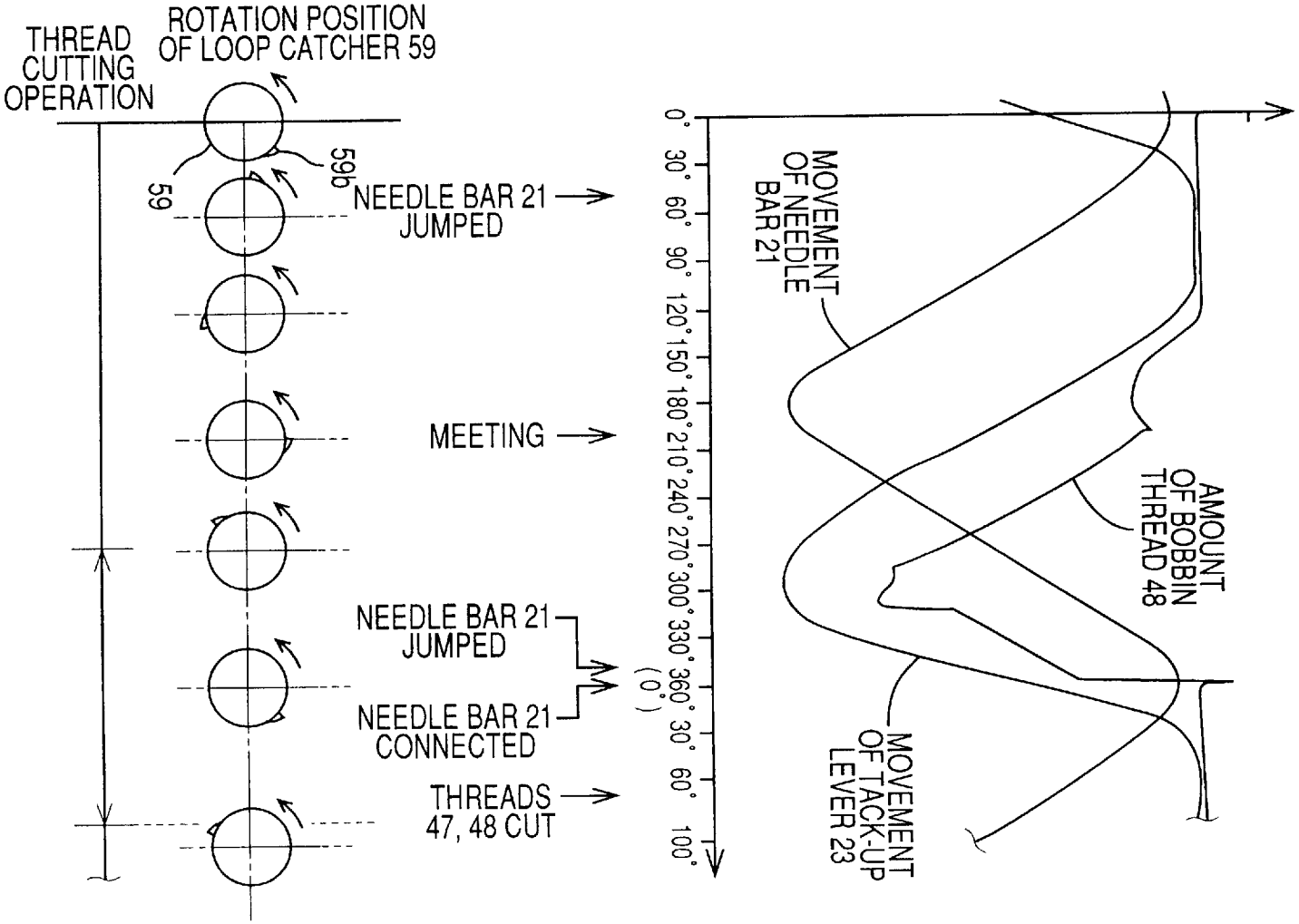
FIG. 21 is a time chart illustrating three curves representing the movement of a needle bar, the movement of a take-up lever, the amount of a bobbin thread, and the rotation position of a loop catcher, in comparison with the rotation position of a main shaft.
Figure 23:
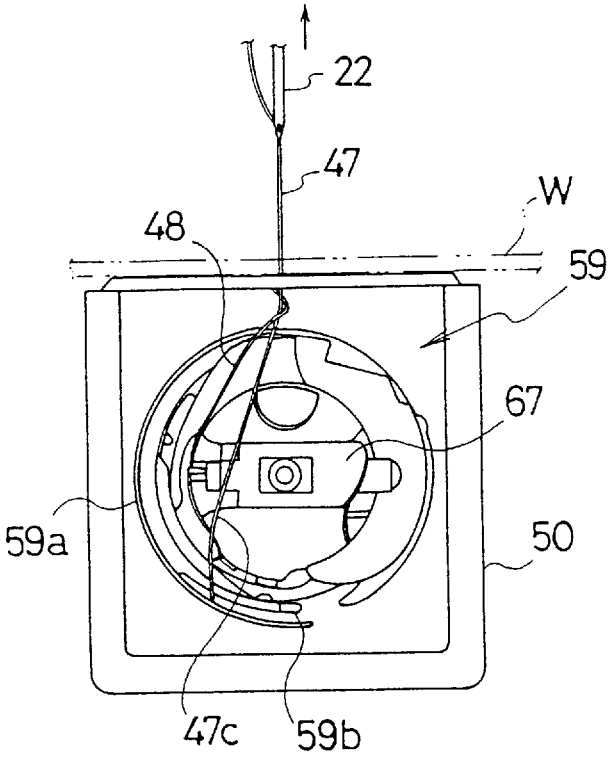
FIG. 23 is a front elevation view of the loop catcher in the form of a full-rotation shuttle when the main shaft 17 takes the rotation position of 280°.

As shown in FIG. 23, the loop catcher 59 includes a bobbin-case holder which holds a bobbin case 67, and a rotating hook 59*a* which rotates around the bobbin-case holder. The rotating hook 59*a* has a point-of-hook 59*b* which hooks a needle thread 47 to form a loop 47*c* of the needle thread 47. As shown in FIG. 21, when the main shaft 17 is at the rotation position of about 200°, the point-of-hook 59*b* meets an eye hole of the sewing needle 22, and hooks the needle thread 47 conveyed by the sewing needle 22. Subsequently, as the rotating hook 59*a* is rotated, the loop 47*c* of the needle thread 47 becomes larger and passes between the bobbin-case holder and the rotating hook 59*a*.

An encoder disk 64 which has a plurality of slits is fixed to the second connection member 63, and a second encoder sensor 65 which is provided by a photosensor (a first encoder sensor 112 will be described later) optically detects each of the slits of the encoder disk 64 and outputs a corresponding one of catcher-shaft rotation signals. The second encoder sensor 65 is fixed to the attachment block 56. When the catcher drive motor 58 is driven or operated, the rotation of the drive shaft 58*a* is transmitted to the catcher shaft 60 via the coupling device 61. Thus, the loop catcher 59 is rotated in a predetermined direction, at a rotation speed, K, which is twice higher than that of the main shaft 17. The front end portion of the bed unit 10 is covered by a protection cover 66 which is pivotally hinged to a lower end of the front end portion of the bed case 50.

Next, there will be described a supporting device which supports the loop catcher 59 such that the position of the catcher 59 is adjustable in the Y-axis direction.

The attachment block 56 includes a cylindrical portion in which a cylindrical bearing case 70 is provided such that the bearing case 70 is movable in the Y-axis direction. A bearing 71 is press-fit in the bearing case 70. An eccentric pin 72 projects from one of opposite side walls of the block 56, such that a projecting portion of the pin 72 is held in engagement with an elongate hole of a corresponding side wall of the bearing case 70. A set vis 73 is detachably attached to the other side wall of the block 56. When the set vis 73 is fastened to the block 56, the bearing case 70 is fixed in position.

When the set vis 73 is manually loosened and the eccentric pin 72 is manually rotated in a clockwise or counterclockwise direction, the bearing case 70 can be moved by a small distance (e.g., 1 to 2 mm) frontward or rearward in the Y-axis direction. Thus, the position of the loop catcher 59 in the Y-axis direction can be finely adjusted, and accordingly the clearance provided between the catcher 59 and the needle 22 can be appropriately adjusted.

Referring next to FIGS. 3 through 6, there will be described a thread cutting device 80 which is provided in each bed unit 10–12 and which cuts the needle thread 47 and a bobbin thread 48.

A stationary plate (not shown) which is fixed to an upper wall of the attachment block 56 extends above the loop catcher 59. A movable blade 81 is supported by the stationary plate such that the movable blade 81 is rotatable between a retracted position indicated in solid line in FIG. 6, and an advanced (i.e., maximum rotation) position indicated in phantom line. A stationary blade 82 cooperates with the movable blade 81 to cut the needle and bobbin threads 47, 48. The stationary blade 82 is fixed to the throat plate 52, at a position above the stationary plate, such that the stationary blade 82 is oriented frontward.

A thread-cutting operating lever 83 which is connected to the movable blade 81 extends rearward through the bed case 50. When the operating lever 83 is moved frontward, the movable blade 81 is rotated clockwise to its advanced position and, when the lever 83 is moved rearward, the blade 81 is rotated counterclockwise from the advanced position to the retracted position. During this backward rotation, a notch 81*a* of the movable blade 81 engages or catches the needle and bobbin threads 47, 48 and subsequently the movable blade 81 cooperates with the stationary blade 82 to cut the two threads 47, 48 simultaneously.

Figure 3:
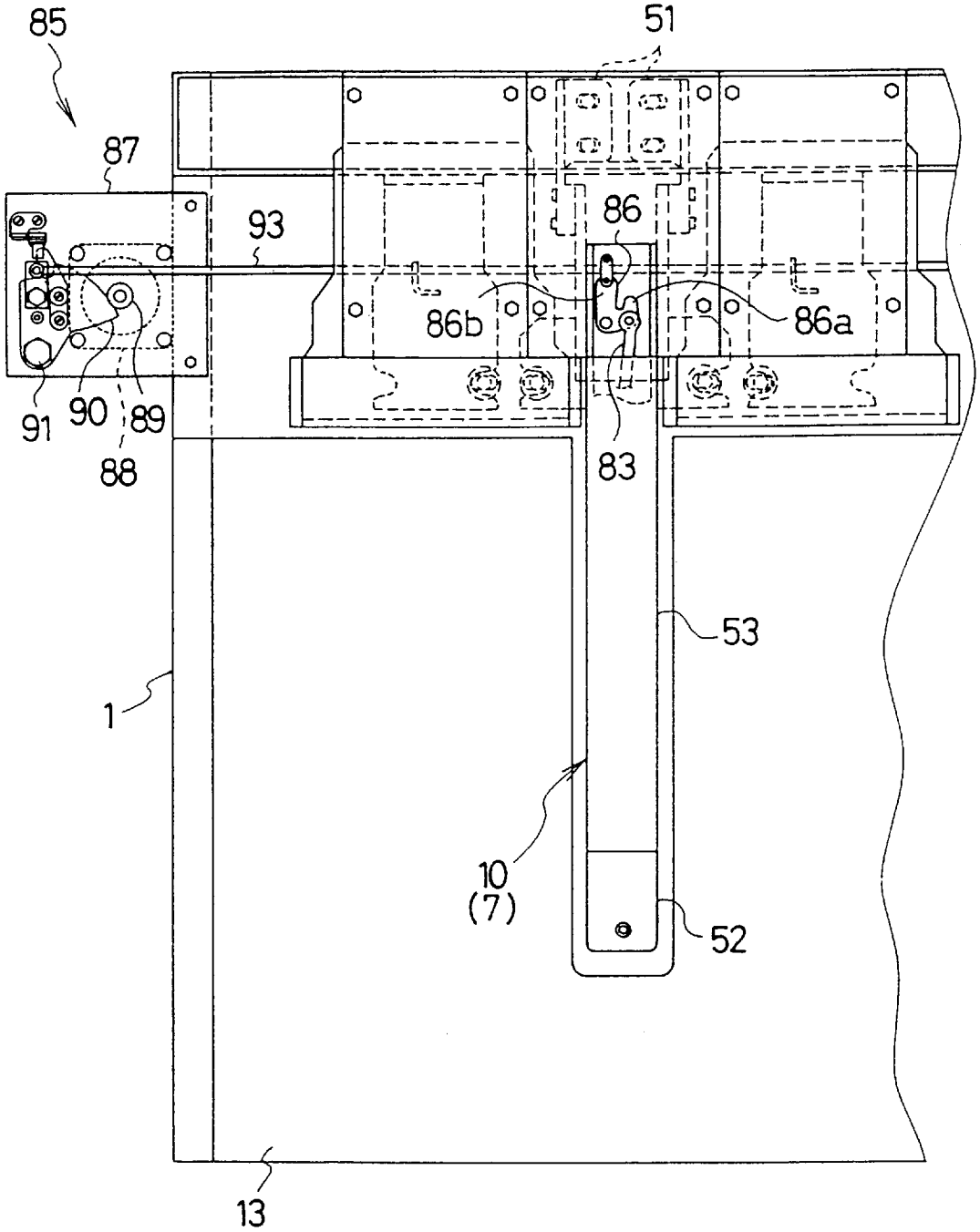
FIG. 3 is a plan view of a part of the machine of FIG. 1 which includes a part of a work table, and a bed unit.
Figure 7:
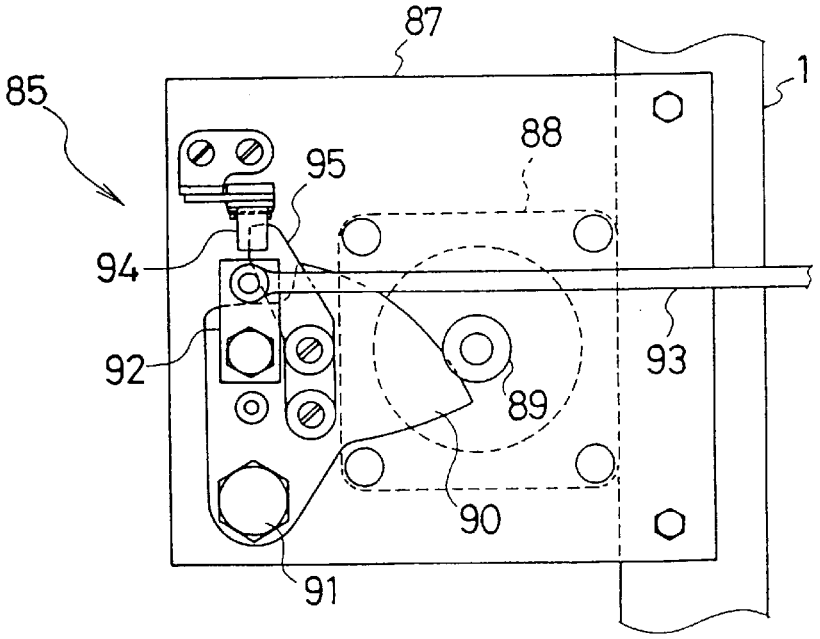
FIG. 7 is an enlarged plan view of a thread-cutting driving device.

Referring next to FIGS. 3 and 7, there will be described a thread-cutting driving device 85 which drives the thread cutting device 80.

A rear end portion of the thread-cutting operating lever 83 is connected to one 86*a* of two arms 86*a*, 86*b* of a rotary plate 86 which has a generally L shape in its plan view and which is supported by the rear end portion of the bed case 50 such that the rotary plate 86 is rotatable about a vertical axis member. An attachment plate 87 is fixed to one of opposite end portions of the base frame 1 in the X-axis direction, and a thread cutting motor 88 is attached to a lower surface of the attachment plate 87. A sector gear 90 which is meshed with a drive gear 89 of the thread cutting motor 88 is supported by the plate 87 via a stepped bolt 91 such that the sector gear 90 is rotatable about the bolt 91. A base portion of a connection plate 92 is attached to the sector gear 90, and a free end portion of the connection plate 92 is connected to one of opposite end portions of a thread-cutting operating rod 93 which extends in the X-axis direction.

The other arm 86*b* of the rotary plate 86 is connected to the thread-cutting operating rod 93. When the thread cutting motor 88 is rotated counterclockwise by a predetermined angle, the sector gear 90 and the connection plate 92 are rotated clockwise by a corresponding angle. Consequently, the thread-cutting operating rod 93 is moved rightward by a corresponding distance, and the rotary plate 86 is rotated clockwise by a corresponding angle. Thus, the thread-cutting operating lever 83 is moved frontward, and the movable blade 81 is rotated from the retracted position to the advanced position. Then, when the motor 88 is rotated clockwise by the same angle, the rod 93 is moved leftward by the same distance, and the rotary plate 86 is rotated counterclockwise by the same angle. Thus, the lever 83 is moved rearward, and the movable blade 81 is rotated from the advanced position to the retracted position. During this rotation, the blade 81 engages the needle and bobbin threads 47, 48 and cooperates with the stationary blade 82 to cut the two threads 47, 48 simultaneously.

A position sensor 94 which is provided by a photosensor is attached to the attachment plate 87, at a position near the sector gear 90. A shading plate 95 is attached to the sector gear 90. When the movable blade 81 is positioned between in its retracted position and a thread cutting position where the blade 81 cooperates with the stationary blade 82 to cut the threads 47, 48, the position sensor 94 detects the shading plate 95 and generates an "H" (high) level position signal, DS, to a catcher-shaft control device 150 (FIG. 8); and when the blade 81 is positioned between the thread cutting position and the advanced position, the sensor 94 does not detect the plate 95 and generates an "L" (low) level position signal DS to the same 150.

Referring next to FIG. 8, there will be described a main control device 100 which controls the multiple-head embroidering machine M as a whole except the bed units 10–12 and the thread-cutting driving device 85.

The main control device 100 is provided by a microcomputer including a central processing unit (CPU) 101, a read only memory (ROM) 102, and a random access memory (RAM) 103, and an input and an output interface (not shown) which are connected to the microcomputer via buses including a data bus.

Regarding the sewing head 4, the main control device 100 is connected to the needle-bar jumping solenoid 41 and the presser-foot driving solenoid 106 via respective driver circuits 105, 107, and connected to a thread breakage sensor 108. This is the case with each of the other sewing heads 5, 6. In addition, the main control device 100 is connected to the main motor 110 via a driver circuit 111, a first encoder sensor 112, a main-shaft origin sensor 113, a stop position sensor 114, the needle-bar changing motor 115 via a driver circuit 116, the X-axis driving motor 117 via a driver circuit 118, the Y-axis driving motor 119 via a driver circuit 120, and the operator's panel 18 which includes the display 18*a* and various switches operable for inputting various commands including a sewing start command. When an encoder disk (not shown) associated with the main motor 110 or the main shaft 17 is rotated by 360°, the first encoder sensor 112 generates a thousand slit signals to the control device 100, and the main-shaft origin sensor 113 generates a single main-shaft origin signal to the control device 100. When the needle bar 21 is positioned at a stop position corresponding to a rotation position, 100°, of the main shaft 17, the stop position sensor 114 generates a stop position signal to the control device 100.

Moreover, the main control device 100 is connected to the catcher-shaft control device 150 which controls the loop catcher 59 and the thread-cutting operation. The catcher-shaft control device 150 is provided by a microcomputer including a CPU 151, a ROM 152, and a RAM 153, and an input and an output interface (not shown) which are connected to the microcomputer via buses including a data bus.

For the bed unit 10, the catcher-shaft control device 150 is connected to the catcher driving motor 58 via a driver circuit 154, the second encoder sensor 65, and a catcher-shaft origin sensor 155. This is the case with each of the other bed units 11, 12. When the encoder disk 64 associated with the catcher driving motor 58 or the catcher shaft 60 is rotated by 360°, the second encoder sensor 65 generates five hundred slit signals to the control device 150, and the catcher-shaft origin sensor 155 generates a single catcher-shaft origin signal to the control device 150. In addition, the control device 150 is connected to the position sensor 94, and the thread cutting motor 88 via a driver circuit 156.

The main motor 110 is provided by an inductor motor and is subject to a known inverter control. The thousand slit signals, i.e., main-shaft rotation signals that are generated by the first encoder sensor 112 during each full rotation of the encoder disk associated with the main motor 110 or the main shaft 17, are divided into forty thousand pulse signals, which in turn are supplied, as main-shaft control signals, to the driver circuit 111 to drive the main motor 110.

When the driver circuit 154 is supplied with five hundred pulse signals from the catcher-shaft control device 150, the catcher driving motor 58 provided by the stepper motor is rotated by 360° and accordingly the loop catcher 59 provided by the full-rotation shuttle is rotated by 360°. Since the catcher shaft 60 is rotated at the rotation speed K twice as high as that of the main shaft 17, the catcher shaft 60 is full-rotated twice while the main shaft 17 is full-rotated once.

Figure 9:
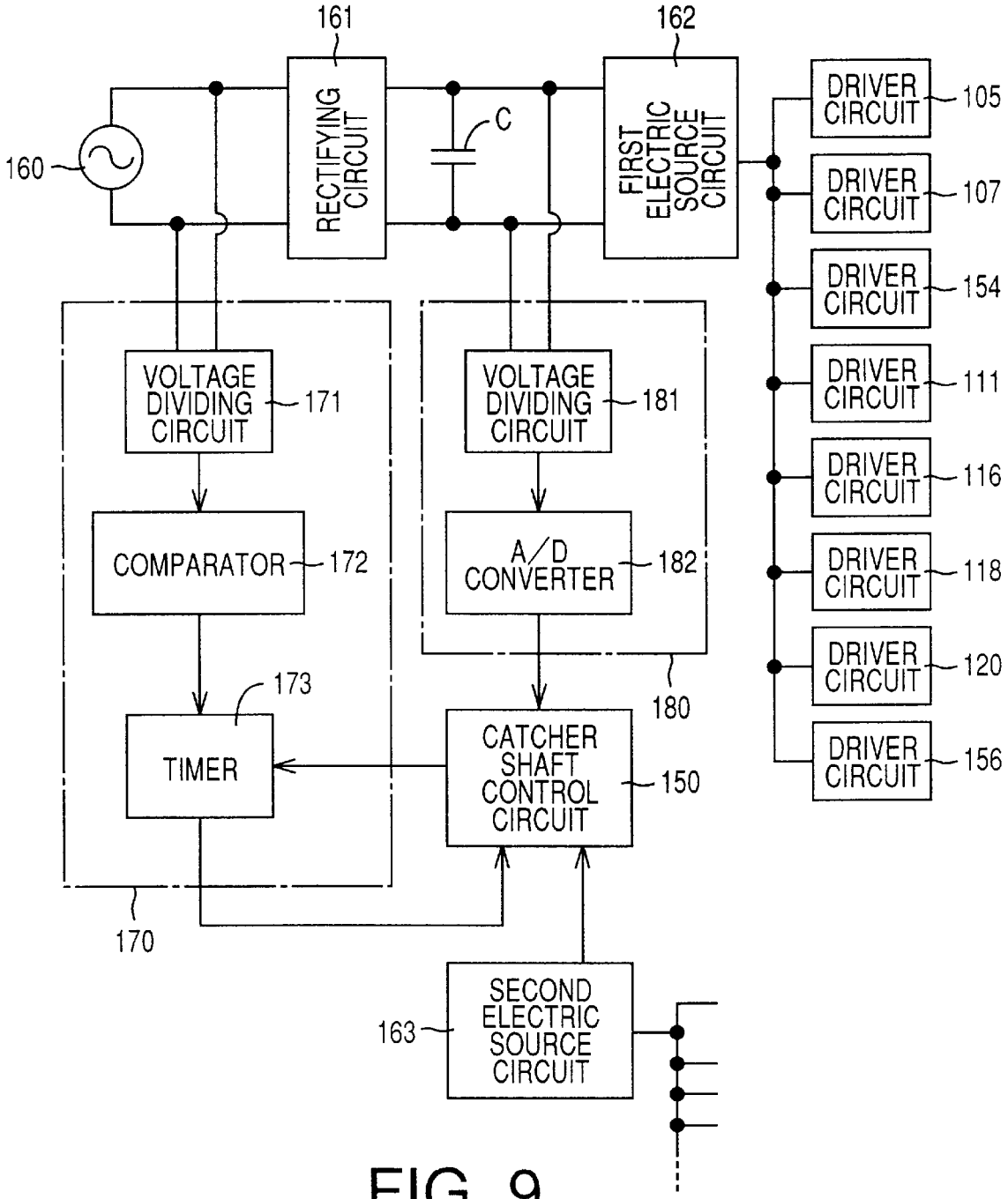
FIG. 9 is a block diagram of an electricity receiving section of the machine of FIG. 1 which receives electricity from a commercial electric source.

Referring next to FIG. 9, there will be described an electric-power or electricity supplying device which supplies an electricity to the various driver circuits 105, 107, 111, 116, 118, 120, 154, 156.

The electricity supplying device includes a first electric source circuit 162 which is connected to a commercially available electric source (i.e., alternating current tap) 160 via a rectifying circuit 161 which rectifies the alternating current into a rectified, direct drive current to be supplied to the source circuit 162.

A service-interruption detector circuit 170 which detects an interruption of the electricity supplying service is connected to a primary side of the rectifying circuit 161 on which side the tap 160 is provided, and a voltage-fall detector circuit 180 which detects an abnormal voltage fall is connected to a secondary side of the rectifying circuit 161 on which the source circuit 162 is provided. In addition, an emergency-use electric source in the form of a capacitor, C, is connected to the secondary side of the rectifying circuit 161. The capacitor C stores an electricity and supplies the stored electricity to the needle-bar jumping solenoid 41 via the driver circuit 105, upon detection of an abnormal or asynchronous state which will be described later.

Next, there will be described the service-interruption detector circuit 170 briefly. The detector circuit 170 includes a voltage dividing circuit 171 which divides the alternating voltage present on the primary side of the rectifying circuit 161, and supplies the divided voltage to a comparator 172. The comparator 172 compares the divided voltage with a reference voltage and, each time the divided voltage exceeds the reference voltage, i.e., at the same cycle as that of the alternating voltage or current, the comparator 172 supplies a reset signal to reset or clear a time measured by a timer 173. If the timer 173 counts a preset time before receiving a clear signal from the comparator 172, the timer 173 supplies a control-interruption signal to the CPU 151 of the catcher-shaft control device 150. When the electricity supplying service interrupts for some reason, the comparator 172 does not supply a clear signal before the timer 173 counts the preset time. Thus, the timer 173 detects the service interruption and supplies a control-interruption signal to the control device 150.

The voltage-fall detector circuit 180 includes a voltage dividing circuit 181 which divides the direct voltage present on the secondary side of the rectifying circuit 161, and supplies the divided voltage to an analog to digital (A/D) converter 182 which converts the divided voltage to a digital signal to be supplied to the control device 150. The main control device 100, the catcher-shaft control device 150, and other electronic components are supplied with appropriate drive voltages from a second electric source circuit 163 which is provided exclusively therefor.

Referring next to the flow charts shown in FIGS. 10 to 17, there will be described the operation of the catcher-shaft control device 150 for controlling the rotation of the loop-catcher shaft 60 connected to the loop catcher 59.

Figure 20:
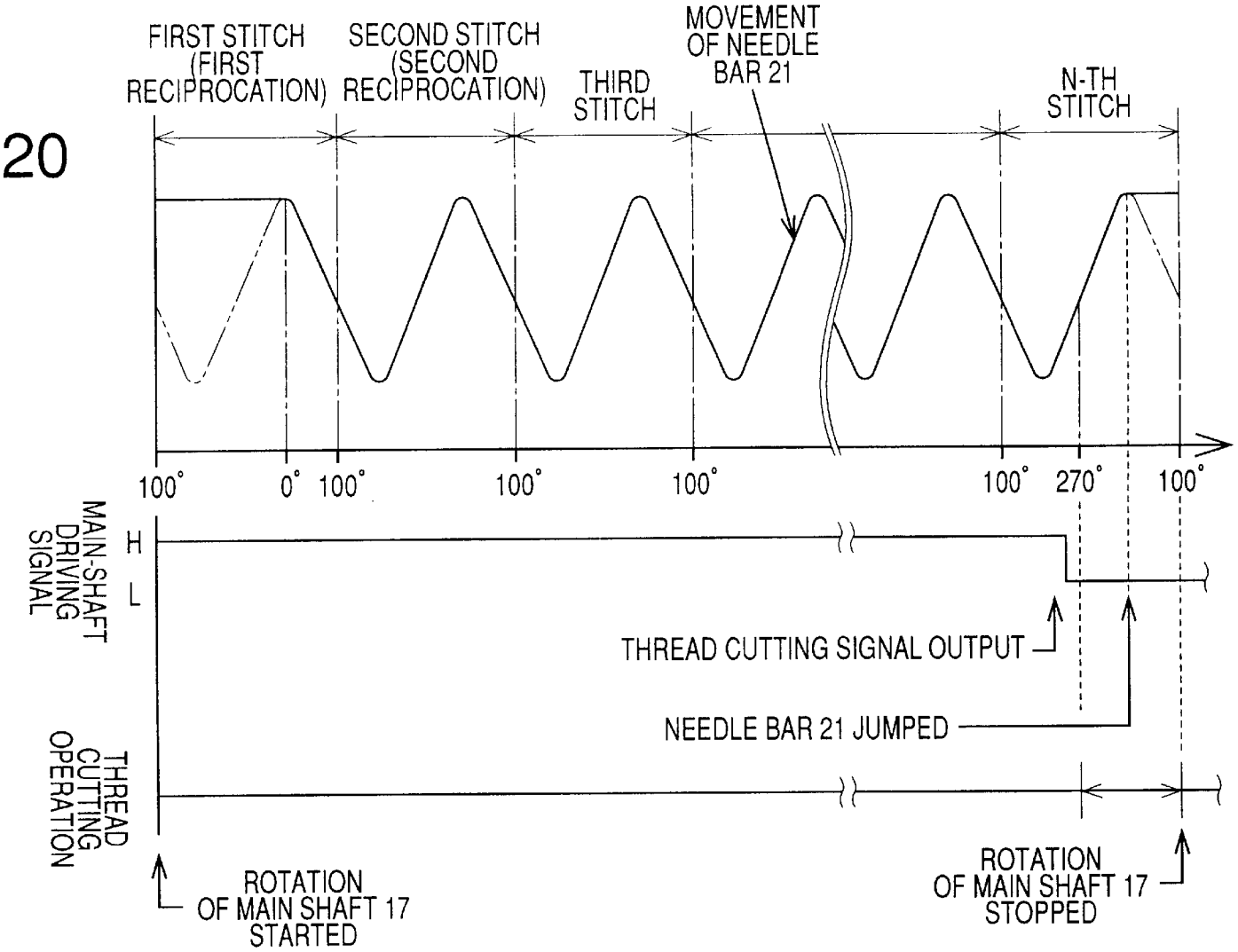
FIG. 20 is a time chart illustrating various signals which are output while an embroidery including N stitches is formed.

FIG. 20 illustrates various control signals which are supplied from the main control device 100 to the catcher-shaft control device 150. At the beginning of a sewing operation, normally, the main shaft 17 remains stopped at the stop position of 100°, and the needle bar 21 remains held at the upper-dead position as a result of being jumped up by the needle-bar jumping device 40.

It is assumed that the present machine M embroiders an embroidery according a batch of embroidery data including sets of stitch-position data corresponding to N stitches (N is a natural number). When the main control device 100 changes a main-shaft drive signal from an L (low) level to an H (high) level, the driver circuit 111 starts driving the main motor 110. It is also assumed that the embroidery data do not command any thread cutting for changing threads but command only a thread cutting at the end of formation of the N-th stitch.

FIG. 21 illustrates the movement of the needle bar 21, the movement of the take-up lever 23, the amount of the bobbin thread 48, and the rotation position of the loop catcher 59, in comparison with the rotation position of the main shaft 17, during a sewing operation. The rotation position (i.e., angular position) of the loop catcher 59 indicates the rotation position of the point-of-hook 59*a*.

As shown in FIG. 20, when the sewing needle 22 is first reciprocated, the needle bar 21 is automatically connected to the drive member 27 when the main shaft takes 0°, i.e., when the needle bar 21 takes the upper-dead position. Thus, in fact, the first stitch is not formed although the needle 22 is reciprocated. Meanwhile, when the N-th stitch is formed and the main shaft 17 takes 260°, the main-shaft drive signal is changed from the H level to the L level, and a thread cutting signal is supplied from the main control device 100 to the catcher-shaft control device 150. While the main shaft 17 is rotated from 270° to 440° (80°), a thread cutting operation is effected. During this period, when the main shaft 17 takes 360°, i.e., when the needle bar 21 takes the upper-dead position, the needle bar 21 is disconnected from the drive member 27, but does not jump up. Subsequently, when the main shaft 17 takes 460° (100°), the rotation of the main shaft 17 is stopped at the stop position.

Figure 10:
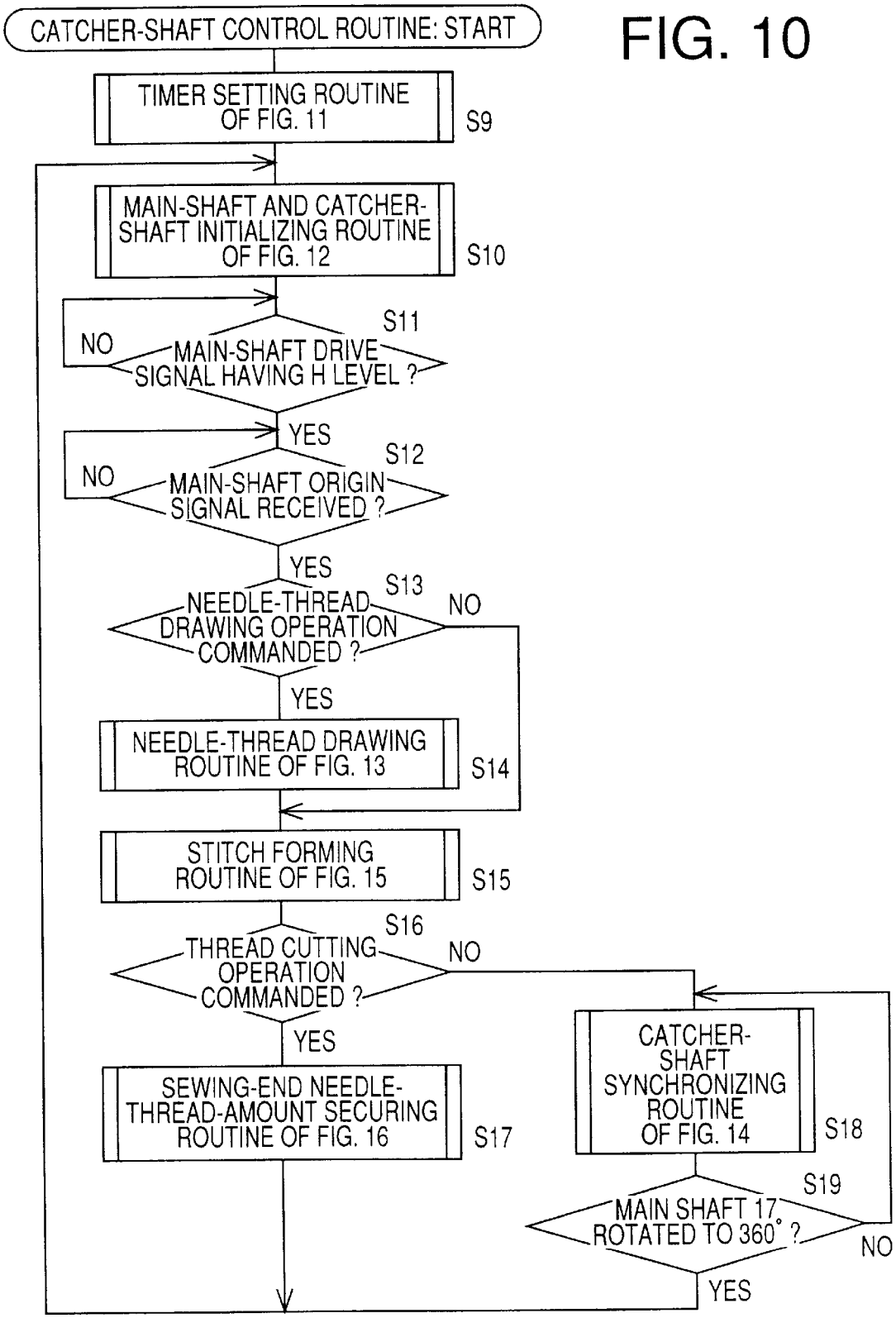
FIG. 10 is a flow chart representing a catcher-shaft control routine according to which a catcher-shaft control device of the machine of FIG. 1 controls the rotation of a loop-catcher shaft.

Upon application of an electric power to the present multiple-head embroidering machine M, the catcher-shaft control device 150 begins with Step S9 of the catcher-shaft control routine shown in FIG. 10. Step S9 corresponds to the timer setting routine, shown in FIG. 11, in which a reference time is set in the timer 173 of the service-interruption detector circuit 170. More specifically described, at Step S20, the control device 150 supplies, to the timer 173, a reference time which is equal to two and half times as long as the period, ACt, of the alternating current being supplied to the machine M. For example, in the case where the frequency of the alternating current is 60 Hz, the control device 150 presets a reference time equal to 16 (msec)×2.5, in the timer 173. Step S20 is followed by Step S21 to reset or clear the time measured, i.e., value counted, by the timer 173 so that the timer 173 re-starts to measure time. Step S21 is followed by Step S22 at which if the time measured by the timer 173 exceeds the reference time, the timer 173 supplies a control-interruption signal to the control device 150. On the other hand, if the comparator 172 supplies a rest or clear signal to the timer 173 before the timer 173 counts up the reference time, the timer 173 re-starts measuring time.

Figure 12:
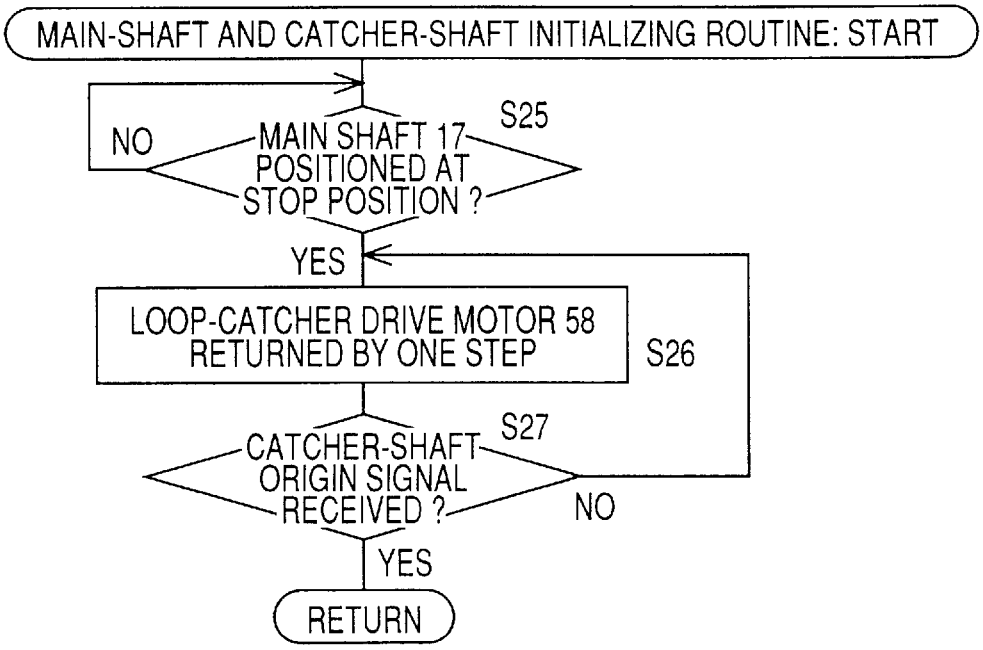
FIG. 12 is a flow chart representing a main-shaft and catcher-shaft initializing routine.

Then, the control of the CPU 151 of the control device 150 proceeds with Step S10, i.e., main-shaft and catcher-shaft initializing routine shown in FIG. 12.

Figure 24:
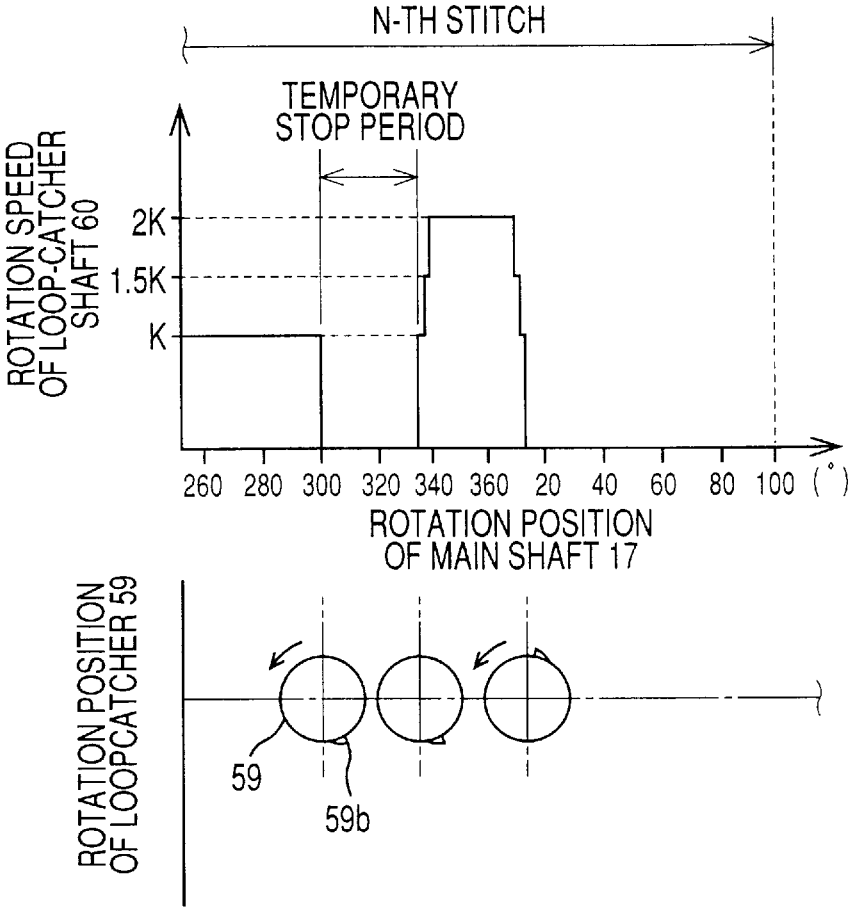
FIG. 24 is a time chart illustrating the rotation speed of the loop-catcher shaft in comparison with the rotation position of the main shaft when a thread cutting operation is effected.

At Step S25, the CPU 151 judges whether the main shaft 17 is positioned at the stop position, i.e., at 100°, based on the detection signal supplied from the stop-position sensor 114. When a prior sewing operation is ended after a thread cutting operation, the main shaft 17 is stopped at the stop position. Therefore, usually, a positive judgment is made at Step S25. Accordingly, the control goes to Step S26. As shown in FIG. 24, at the beginning of a sewing operation, the loop catcher 59 (i.e., point-of-hook 59*a*) is positioned at a phase corresponding to 13° of the main shaft 17. Therefore, at Step S26, the control device 150 supplies one pulse signal to the driver circuit 154 to rotate the catcher drive motor 58 (i.e., stepper motor) by one step, i.e., a predetermined angle, in order to return the catcher shaft 60 to the catcher-shaft origin where the catcher-shaft origin sensor 155 supplies a catcher-shaft origin signal to the control device 150. Step S26 is followed by Step S27 to judge whether the control device 150 has received the catcher-shaft origin signal from the sensor 155. If a negative judgment is made at Step S27, Steps S26 and S27 are repeated. When the loop-catcher shaft 60 is returned to the origin position, as shown in FIG. 22, which corresponds to the stop position (100°) of the main shaft 17, a positive judgment is made at Step S27, and the control of the CPU 151 goes to Step S11.

On the other hand, if a negative judgment is made at Step S25, the main control device 100 is operated to control the display 18*a* to indicate an error message informing an operator of that situation. Then, the operator can manually rotate the main shaft 17 to the stop position.

If the main control device 100 does not output a main-shaft drive signal having an H level, no sewing operation is started. In this case, a negative judgment is made at Step S11. Step S11 is repeated until a positive judgment is made. As shown in FIG. 20, when the main control device 100 supplies a main-shaft drive signal having an H level and a sewing operation is started, a positive judgment is made at Step S11. Thus, the rotation of the main motor 110 is started and the main shaft 17 is rotated from the stop position, i.e., 100°. At this time, however, the rotation of the loop catcher 59 is not started.

Figure 22:
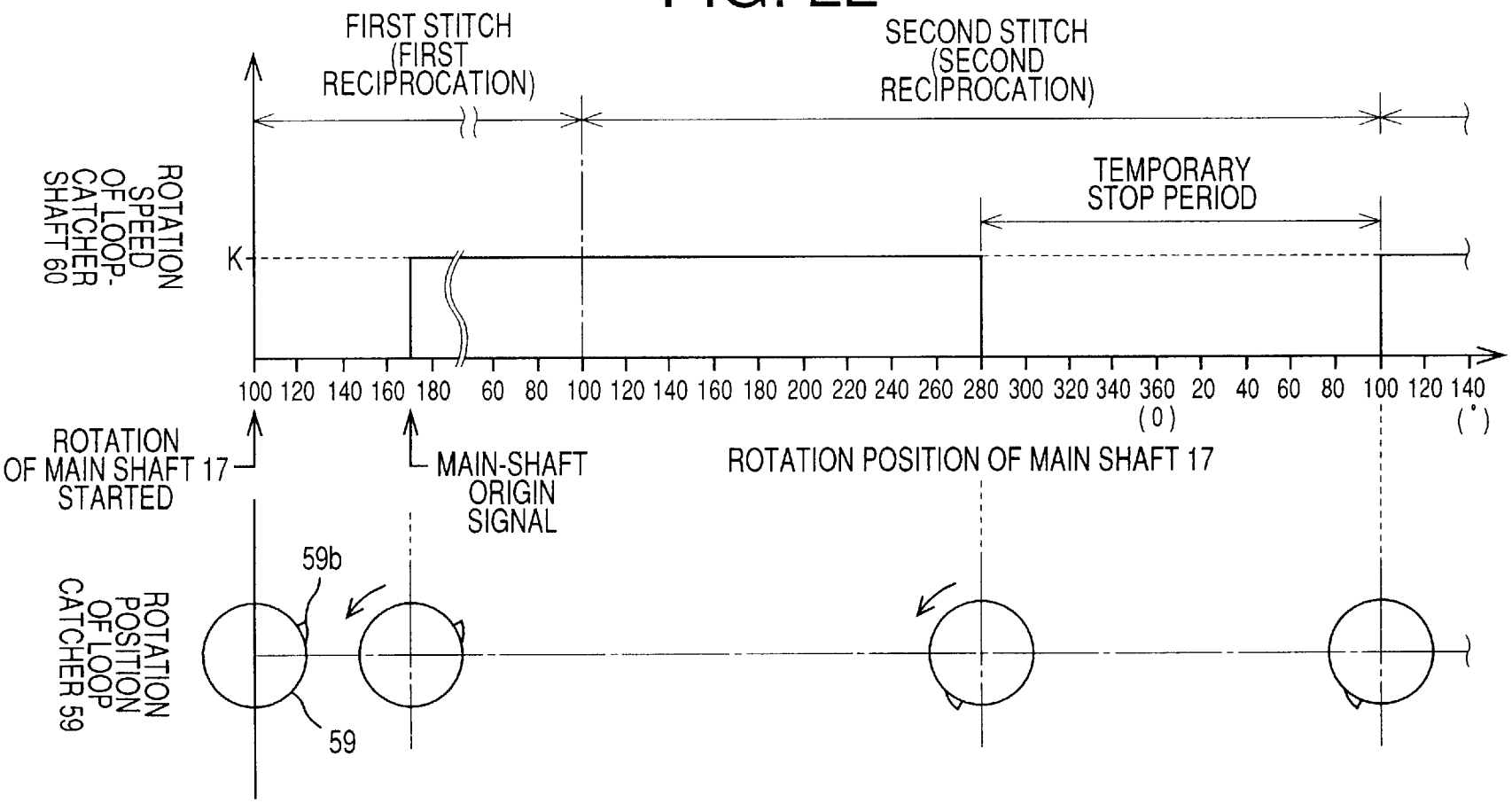
FIG. 22 is a time chart illustrating the rotation speed of the loop-catcher shaft in comparison with the rotation position of the main shaft when a sewing operation is started.

As shown in FIG. 22, when the main shaft 17 is rotated to 170° during the first reciprocation of the sewing needle 22 following the commencement of the sewing operation, the main-shaft origin sensor 113 generates a main-shaft origin signal to the main control device 100. Thus, a positive judgment is made at Step S12. Step S12 is followed by Step S13 to judge whether the main control device 100 is commanding the catcher-shaft control device 150 to carry out a needle-thread drawing operation at Step S14, i.e., the needle-thread drawing routine shown in FIG. 13. If a positive judgment is made at Step S13, the control of the CPU 151 goes to Step S14. The needle-thread drawing operation is carried out to draw the needle thread 48 conveyed by the sewing needle 22, to the underside of a work sheet W such as a fabric or a leather.

At Step S30, the catcher-shaft control device 150 carries out the catcher-shaft synchronizing routine shown in FIG. 14.

At Step S40, the control device 150 reads a current rotation or angular position, i.e, current phase of the main shaft 17, by counting the number of main-shaft rotation signals supplied from the first encoder sensor 112 to the main control device 100 after the main-shaft origin signal is issued. While the main shaft 17 is rotated by 360°, a thousand main-shaft rotation signals are supplied from the sensor 112 to the control device 100, and four thousand pulse signals are supplied to the driver circuit 111 to rotate the main motor 110, as described previously. Step S40 is followed by Step S41 to judge whether it is a timing to rotate the catcher-shaft drive motor 58 by one step so as to synchronize the loop-catcher shaft 60 with the rotation of the main shaft 17. A positive judgment is made at Step S41, each time the main control device 100 supplies every fourth pulse signal to the main motor 110. If a positive judgment is made at Step S41, the control of the CPU 151 goes to Step S42 to supply one pulse signal to the driver circuit 154 to rotate the catcher-shaft drive motor (stepper motor) 58 by one step.

Step S42 is followed by Step S43 to add one to a value, I, counted by a counter provided in the RAM 153 of the control device 150. The counter counts the number of pulse signals supplied from the control device 150 to the driver circuit 154 to drive the loop-catcher drive motor 58. Subsequently, at Step S44, the CPU 151 judges whether the control device 150 has received a catcher-shaft rotation signal from the second encoder sensor 65, in order to judge whether the loop-catcher shaft 60 is rotating. If a negative judgment is made at Step S44, the control of the CPU 151 goes to Step S45 to judge whether the counted value I is not greater than a reference value, P (e.g., ten to fifteen). If a positive judgment is made at Step S45, the control of the CPU 151 quits this routine and goes to Step S31 of the routine of FIG. 13. On the other hand, if a positive judgment is made at Step S44, the control goes to Step S46 to clear the value I counted by the counter, to zero, and then goes to Step S31.

On the other hand, if a negative judgment is made at Step S41, the control goes to Step S47 to judge whether the control device 150 has received a catcher-shaft origin signal from the catcher-shaft origin sensor 155. If a negative judgment is made at Step S47, the control goes to Step S48 to read a detected voltage, $V_K$, supplied from the A/D converter 182 of the voltage-fall detector circuit 180. Step S48 is followed by Step S49 to judge whether the detected voltage $V_K$ is not higher than a reference voltage, $V_s$, at which the main motor 110 and/or the loop-catcher drive motor 58 cannot normally operate. If a negative judgment is made at Step S49, the control goes to Step S31. On the other hand, if a positive judgment is made at Step S47, the control goes to Step S50 to calculate, based on the current phase of the main shaft 17 read at Step S40, an actual pulse-signal number representing the number of pulse signals which are actually supplied to the drive motor 58 during a time period in which the loop-catcher shaft 60 is rotated by 360° from the time of prior detection of the origin position thereof corresponding to 170° of the main shaft 17, to the time of current detection of the origin position thereof detected at Step S47. In the ROM 152, a nominal pulse-signal number representing the number of pulse signals which are nominally supplied to the drive motor 58 during the same time period, is pre-stored. In addition, the ROM 152 stores a reference pulse-signal number representing a permissible difference between the actual pulse-signal number and the nominal pulse-signal number for synchronizing the rotation of the loop catcher 58 with the rotation of the main shaft 17, i.e. the reciprocation of the needle bar 21. The ROM 152 may additionally store a table representing a relationship between actual phases of the main shaft 17 and corresponding actual pulse-signal numbers. At Step S50, the CPU 151 judges whether the difference between the actual and nominal pulse-signal number is smaller than the reference pulse-signal number. If a positive judgment is made at Step S50, the control of the CPU 151 goes to Step S31.

Figure 17:
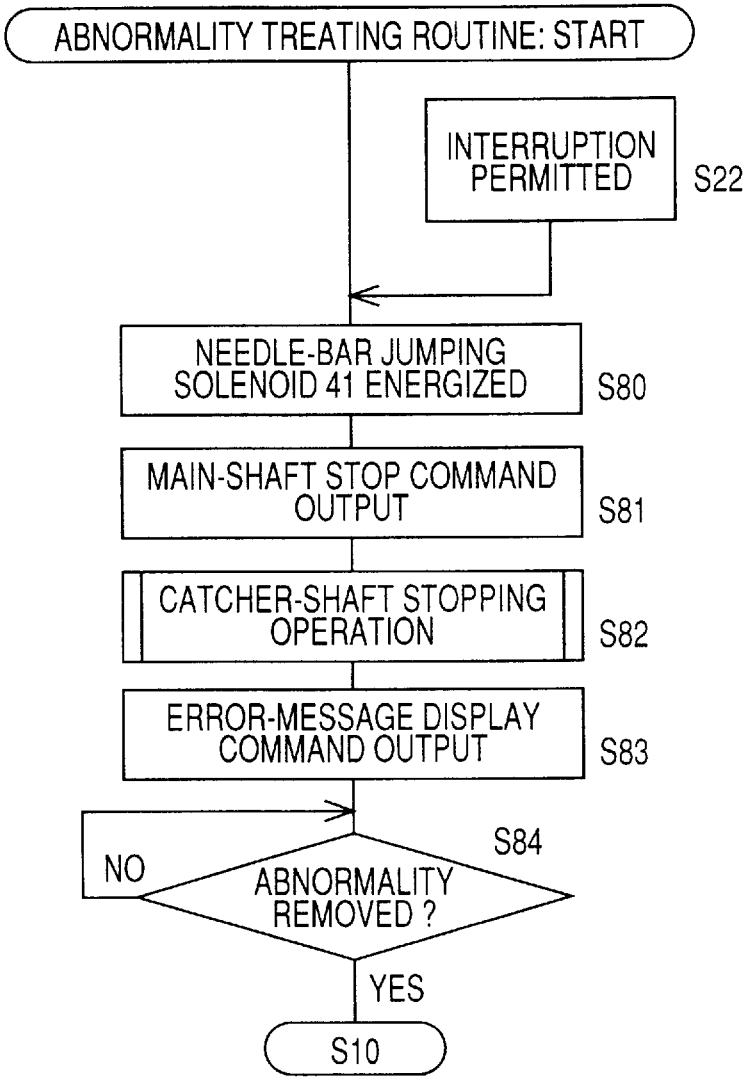
FIG. 17 is a flow chart representing an abnormality treating routine.

On the other hand, if a positive judgment is made at Step S49 or if a negative judgment is made at Step S45 or Step S50, the control of the CPU 151 goes to Step S51, i.e., abnormality treating routine shown in FIG. 17. In the case where a positive judgment is made at Step S49 or a negative judgment is made at Step S45, the control device 150 identifies that the loop-catcher shaft 60 is rotating in an asynchronous state in which it is expected that the amount of asynchronism between the needle bar 21 and the loop catcher 59 will exceed a permissible amount which may, or may not, correspond to the reference pulse-signal number pre-stored in the ROM 152. Meanwhile, in the case where a negative judgment is made at Step S50, the control device 150 identifies that the loop-catcher shaft 60 is rotating in an asynchronous state in which the amount of asynchronism between the needle bar 21 and the loop catcher 59 is now greater than a permissible amount which corresponds to the reference pulse-signal number pre-stored in the ROM 152.

At Step S80, the main control device 100 controls the driver circuit 105 to drive or energize the needle-bar jumping solenoid 41 for a predetermined time duration. To this end, the catcher-shaft control device 150 operates for causing the capacitor C to supply the stored electricity to the solenoid 41 via the circuit 105. Thus, the solenoid 41 quickly and reliably responds to the abnormality. Consequently the drive member 27 is rotated to the non-engageable position and accordingly the needle bar 21 jumps up to the upper-dead position thereof, as described previously. Thus, the sewing needle 22 is effectively prevented from colliding with the loop catcher 59 because of the excessive asynchronism between the needle bar 21 and the loop catcher 59 and/or the excessive fall of the electric voltage supplied to the present machine M.

Step S80 is followed by Step S81 to output, to the main control device 100, a main-shaft drive stop command to stop the main motor 110. Thus, the main control device 100 supplies a brake operating signal to the driver circuit 111 to apply brake to the main motor 110 and instantly stop the same 110. Step S81 is followed by Step S82, i.e., loop-catcher drive motor stopping routine in which the control device 150 supplies a brake operating signal to apply brake to the drive motor 58 to stop the rotation of the drive motor 58 simultaneously with the stopping of the main motor 110. Subsequently, at Step S83, the control device 150 supplies, to the main control device 100, a command to control the display 18*a* to indicate an error message informing the operator of the situation that the two motors 110, 58 have been stopped because of the detection of abnormality. If the operator removes the abnormality and operates an error resetting switch (not shown) provided on the operator's panel 18, a positive judgment is made at Step S84. Then, the control of the CPU 151 goes back to Step S10 of FIG. 10.

Meanwhile, when the electricity supplying service interrupts for some reason, the service-interruption detector circuit 170 detects the service interruption since the comparator 172 does not supply a clear signal to the timer 173 before the timer 173 counts up the reference time. Thus, the timer 173 supplies a control-interruption signal to the control device 150 at Step S22 of FIG. 11. Accordingly, the control device 150 carries out the abnormality treating routine of FIG. 17. Thus, the needle bar 21 jumps up to the upper dead position, and the sewing needle 22 is effectively prevented from colliding with the loop catcher 59 because of the interruption of the electricity or electric-power supplying service.

Figure 13:
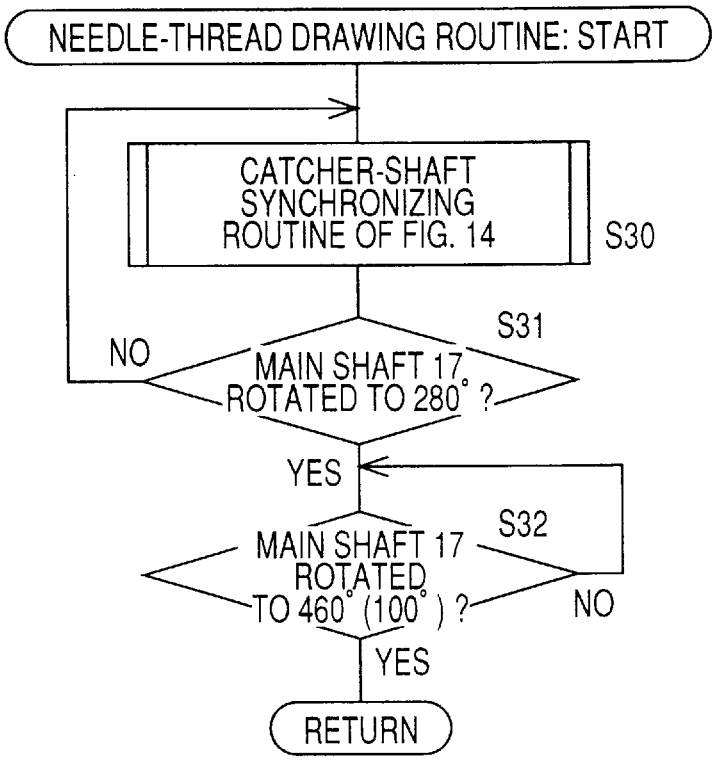
FIG. 13 is a flow chart representing a needle-thread drawing routine.

In the needle-thread drawing routine of FIG. 13, Step S30 is followed by Step S31 to judge whether the main shaft 17 has been rotated to 280°. If a negative judgment is made at Step S31, Steps S30 and S31 are repeated. As shown in FIG. 22, when the main shaft 17 has been rotated to 280° during the second reciprocation of the sewing needle 22, that is, if a positive judgment is made at Step S31, the control of the CPU 151 goes to Step S32 to stop the operation of the catcher-shaft drive motor 58, thereby stopping the rotation of the loop-catcher shaft 60, and judge whether the main shaft 17 has been rotated to 460° (100°).

While the main shaft 17 is rotated from 280° to 460° during the second reciprocation of the sewing needle 22, the loop catcher 59 is taking a rotation position, shown in FIG. 23, at which the loop 47*c* of the needle thread 47 made by the point-of-hook 59*b* has not been released from the loop catcher 59 yet, the work sheet W is being fed, and the needle 22 and the take-up lever 23 are being moved upward.

As the sewing needle 22 and the take-up lever 23 are moved upward, the needle thread 47 is drawn up through the eye hole of the needle 22. Thus, the free end portion of the needle thread 47 passes through the work sheet W and the needle throat 52*a* of the throat plate 52, from the upperside of the sheet W to the underside of the same W, i.e., to the side of the loop catcher 59. Thus, the loop 47*c* is eliminated.

Figure 15:
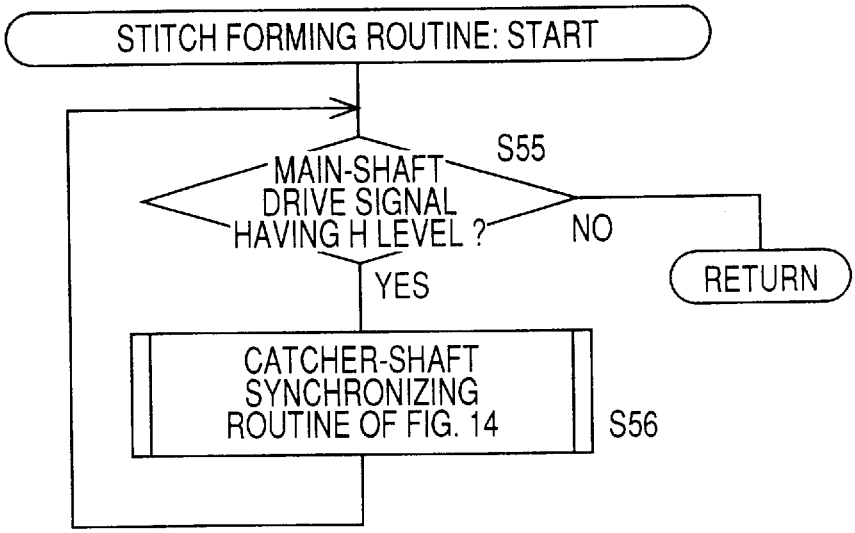
FIG. 15 is a flow chart representing a stitch forming routine.

Then, if a positive judgment is made at Step S32, that is, if the main shaft 17 has been rotated to 460° (100°) at which the rotation of the loop catcher 59 is resumed, the control of the CPU 151 goes to Step S15 of FIG. 10, i.e., the stitch forming routine, shown in FIG. 15, in which stitches are actually formed on the work sheet W.

At Step S55, the CPU 151 judges whether the main-shaft drive signal supplied from the main control device 100 to the main motor 110 has the H level. If the current sewing operation has entered the third reciprocation of the sewing needle 22, a positive judgment is made at Step S55, and the control goes to Step S56 to carry out the above-described catcher-shaft synchronizing routine of FIG. 14. Steps S55 and 56 are repeated till the formation of the N-th stitch, i.e., the last stitch. After the last stitch is formed, the main-shaft drive signal is changed from the H level to the L level as shown in FIG. 20. Thus, a negative judgment is made at Step S55, and the control of the CPU 151 quits this routine and goes to Step S16 of FIG. 10. Thus, stitches are sequentially formed, one by one, on the work sheet W.

At Step S16, the CPU 151 judges whether the main control device 100 commands the catcher-shaft control device 150 to carry out a thread cutting operation after the formation of the last stitch. If a negative judgment is made at Step S16, the control goes to Step S18 to perform the catcher-shaft synchronizing routine of FIG. 14 and then to Step S19 to judge whether the main shaft 17 has been rotated to 360°. If a negative judgment is made at Step S19, Steps S18 and S19 are repeated so that the point-of-hook 59*b* may not collide with the sewing needle 22. Meanwhile, if a positive judgment is made at Step S19, the control of the CPU 151 goes back to Step S10.

Figure 16:
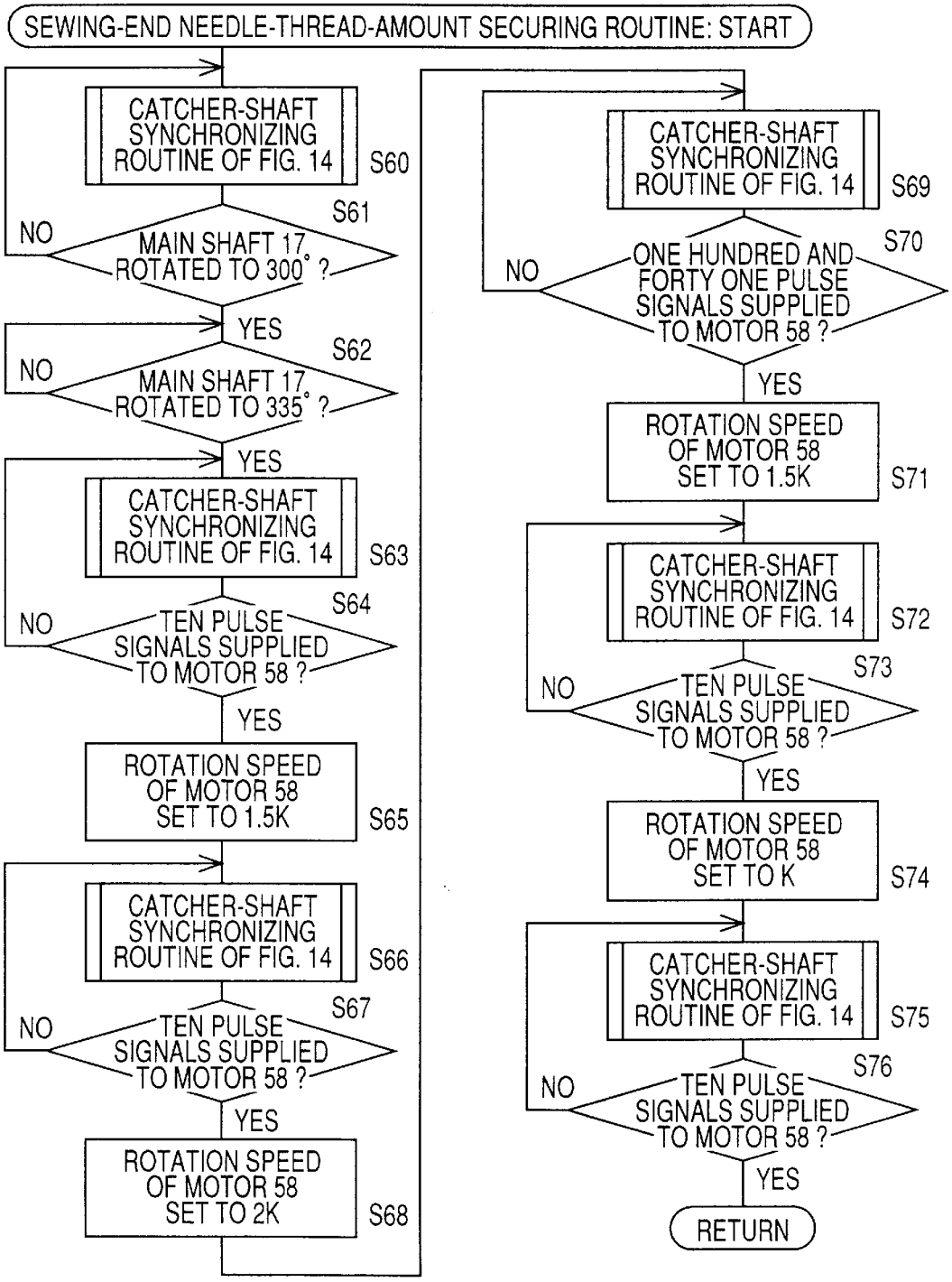
FIG. 16 is a flow chart representing a sewing-end needle-thread-amount securing routine.

On the other hand, if a positive judgment is made at Step S16, the control of the CPU 151 goes to Step S17, i.e. the sewing-end needle-thread-amount securing routine shown in FIG. 16. Substantially simultaneously with the commencement of the sewing-end needle-thread-amount securing routine, the control device 150 starts carrying out the thread cutting routine shown in FIG. 19, when the main shaft 17 is rotated to 270°. The thread cutting routine will be described later.

In the needle-thread-amount securing routine, a sufficient amount or length of the needle thread 47 between the free end thereof and the eye hole of the sewing needle 22 is secured. At Step S60, the CPU 151 carries out, during the formation of the last stitch, the catcher-shaft synchronizing routine of FIG. 14 while rotating the loop-catcher drive motor 60 at the predetermined rotation speed K, as shown in FIG. 24. Step S60 is followed by Step S61 to judge whether the main shaft 17 has been rotated to 300°. If a negative judgment is made at Step S61, Steps S60 and S61 are repeated.

When a positive judgment is made at Step S61, the control of the CPU 151 goes to Step S62 to temporarily stop the operation of the loop-catcher drive motor 60, thereby forcibly stopping the rotation of the loop catcher 59, and judge whether the main shaft 17 has been rotated to 335°. If a negative judgment is made at Step S62, Step S62 is repeated.

Figure 25:
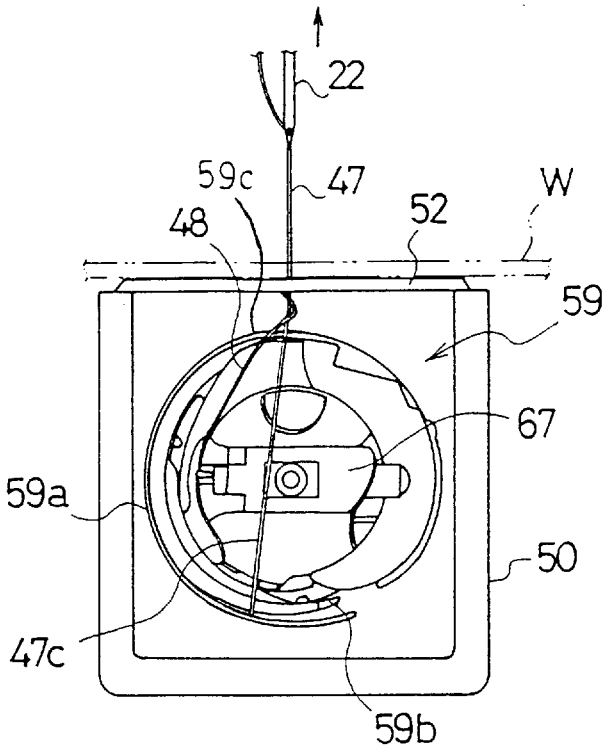
FIG. 25 is a front elevation view of the full-rotation shuttle when the shuttle is temporarily stopped with the main shaft 17 taking the rotation position of 300°.

While the main shaft 17 is rotated from 300° to 335° during the formation of the N-th stitch, the loop catcher 59 is taking a rotation position, as shown in FIG. 25, at which the loop 47*c* of the needle thread 47 has not been released from the loop catcher 59, the work sheet W is being fed, and the needle 22 and the take-up lever 23 are being moved upward. Since, in this situation, the rotation of the loop catcher 59 is temporarily stopped, the length of the needle thread 47 between the work sheet W and the eye hole of the sewing needle 22 increases as the take-up lever 23 is moved up. Accordingly, the needle thread 47 is fed from a needle-thread supplying spool (not shown).

Thus, a sufficient length of the needle thread 47 will be secured after the thread 47 is cut between the work sheet W and the sewing needle 22 in a thread cutting operation described later. Therefore, the cut end portion of the needle thread 47 is effectively prevented from coming off the eye hole of the needle 22 when the next sewing operation is started.

Meanwhile, if a positive judgment is made at Step S62, the control of the CPU 151 goes to Steps S63 to S76 at which the CPU 151 controls, while the main shaft 17 is rotated over about 38°, the loop-catcher drive motor 58 such that the motor 58 is rotated at a high speed proportional to the rotation speed of the main shaft 17 and such that the frequency of supplying of drive pulse signals does not exceed a self-start frequency of the motor 58. Thus, the needle-thread loop 47*c* is quickly released from the loop catcher 59, and an accurate amount of the thread 47 is secured.

More specifically described, at Step S63, the CPU 151 carries out the catcher-shaft synchronizing routine of FIG. 14. Step S63 is followed by Step S64 to judge whether the first ten drive pulse signals have been supplied, after the main shaft 17 reaches the phase of 335°, to the drive motor 58 to rotate the loop-catcher shaft 60 at the speed K. If a negative judgment is made at Step S64, Steps S63 and S64 are repeated. If a positive judgment is made at Step S64, the control goes to Step S65 to change the frequency of supplying of drive pulse signals to a higher one at which the loop-catcher shaft 60 is rotated at a speed, 1.5K, which is one and half times higher than the rotation speed K. Subsequently, at Step S66, the CPU 151 carries out the catcher-shaft synchronizing routine of FIG. 14, and then, at Step S67, the CPU 151 judges whether the next ten drive pulse signals have been supplied to the drive motor 58 to rotate the loop-catcher shaft 60 at the speed 1.5K. If a positive judgment is made at Step S67, the control goes to Step S68 to change the frequency of supplying of drive pulse signals to a still higher one at which the loop-catcher shaft 60 is rotated at a speed, 2K, which is twice higher than the rotation speed K. Subsequently, at Step S69, the CPU 151 carries out the catcher-shaft synchronizing routine of FIG. 14, and then, at Step S70, the CPU 151 judges whether one hundred and forty one pulse signals have been supplied to the drive motor 58 to rotate the loop-catcher shaft 60 at the speed 2K. If a positive judgment is made at Step S70, the control goes to Step S71 to change the signal-supplying frequency to a lower one at which the loop-catcher shaft 60 is rotated at the speed 1.5K. Subsequently, at Step S72, the CPU 151 carries out the catcher-shaft synchronizing routine of FIG. 14, and then, at Step S73, the CPU 151 judges whether ten drive pulse signals have been supplied to the drive motor 58 to rotate the loop-catcher shaft 60 at the speed 1.5K. If a positive judgment is made at Step S73, the control goes to Step S74 to change the signal-supplying frequency to a still lower one at which the loop-catcher shaft 60 is rotated at the speed K. Subsequently, at Step S75, the CPU 151 carries out the catcher-shaft synchronizing routine of FIG. 14, and then, at Step S76, the CPU 151 judges whether the next ten drive pulse signals have been supplied to the drive motor 58 to rotate the loop-catcher shaft 60 at the speed K. If a positive judgment is made at Step S73, the control goes back to Step S10 of FIG. 10.

Figure 19:
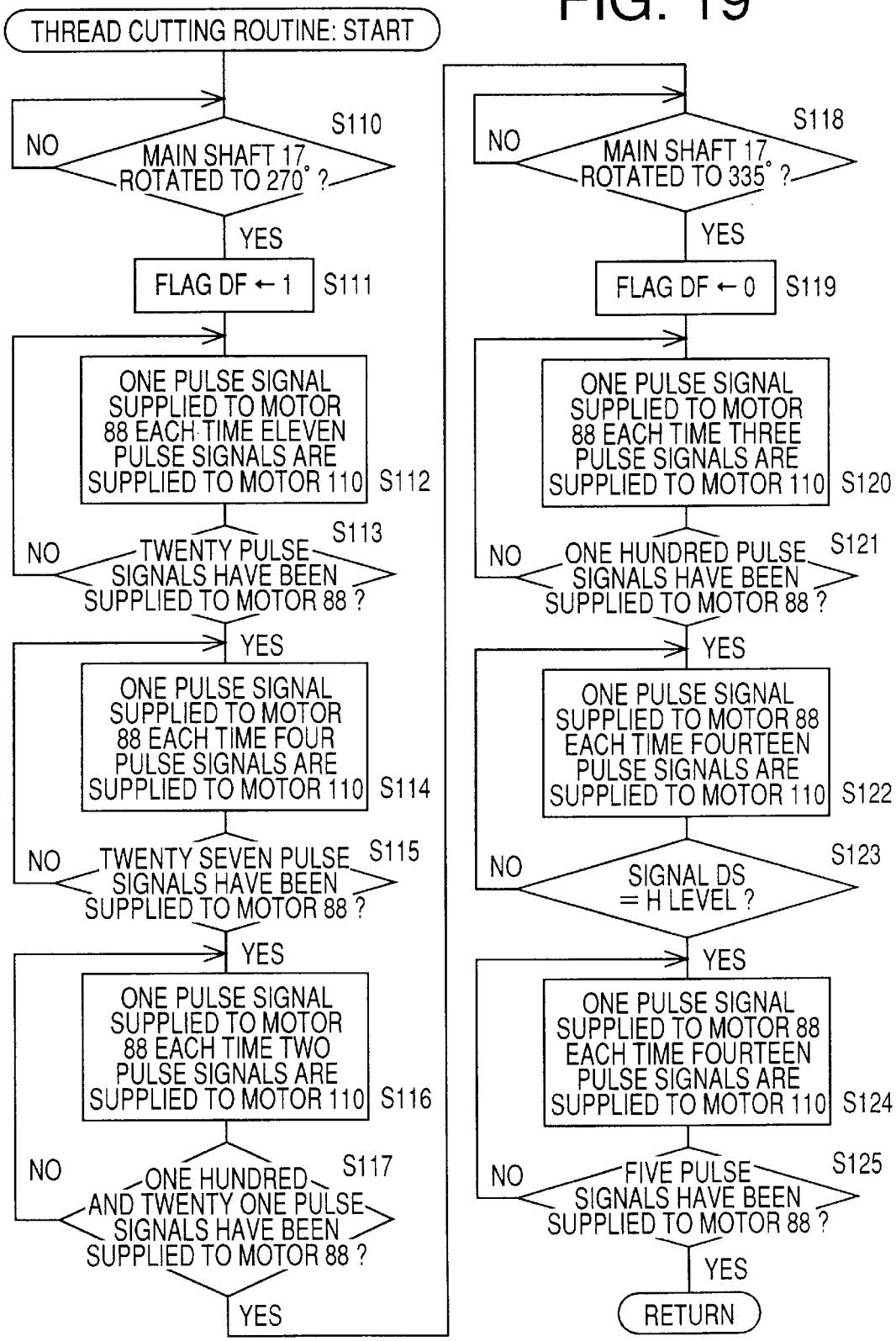
FIG. 19 is a flow chart representing a thread cutting routine.

Referring next to FIG. 19, there will be described the thread cutting routine which is carried out by the catcher-shaft control device 150 concurrently with the above-described needle-thread-amount securing routine.

Figure 18:
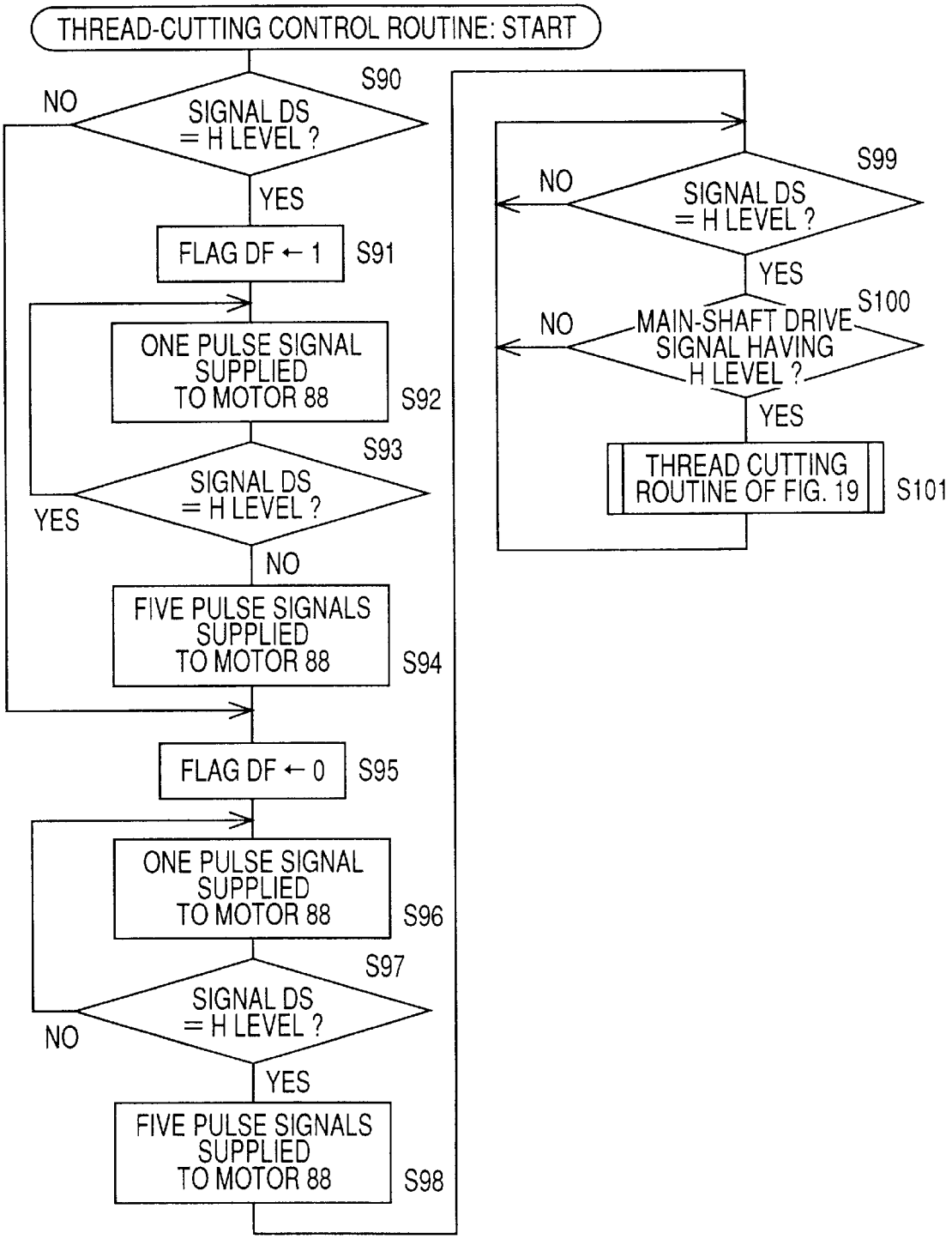
FIG. 18 is a flow chart representing a thread-cutting control routine.

The thread cutting routine, shown in FIG. 19, is employed in a thread-cutting control routine, shown in FIG. 18, which is carried out by the catcher-shaft control device 150, concurrently with the catcher-shaft control routine of FIG. 10, upon application of an electric power to the present machine M. Hence, first, the thread-cutting control routine will be described in detail.

Upon application of an electric power to the machine M, the control device 150 begins with the routine of FIG. 18. First, at Steps S90 to S98, the movable blade 81 is initialized. More specifically described, the CPU 151 judges whether the control device 150 is receiving, from the position sensor 94, the position detection signal DS having the H level, that is, whether the sensor 94 is detecting the shading plate 95 when the movable blade 81 is positioned near the retracted position. If a positive judgment is made at Step S90, the control goes to Step S91 to set a rotation-direction flag, DF, to "1" indicating that the thread cutting motor 88 is to be rotated in a direction in which to rotate the movable blade 81 from the retracted position to the advanced position. Step S91 is followed by Step S92 to supply one drive pulse signal to the motor 88 to rotate or move the blade 81 from the retracted position. Subsequently, at Step S93, the CPU 151 judges whether the control device 150 is receiving the position detection signal DS having the H level. If a positive judgment is made at Step S93, that is, if the blade 81 has not been rotated by a predetermined amount from the retracted position, Steps S92 and S93 are repeated.

If a negative judgment is made at Step S93, that is, if the control device 150 has first received the position detection signal DS having the L level, the control of the CPU 151 goes to Step S94 to supply five drive pulse signals to the thread cutting motor 88 so as to rotate the movable blade 81 by a predetermined small angle in the advancing direction. Step S94 is followed by Step S95 to set the rotation-direction flag to "0" indicating that the blade 81 is to be rotated in the retracting direction. Subsequently, at Step S96, the CPU 151 supplies one drive pulse signal to the motor 88 to rotate the blade 81 toward the retracted position. Subsequently, at Step S97, the CPU 151 judges whether the control device 150 has first received the position detection signal DS having the H level. If a negative judgment is made at Step S97, Steps S96 and S97 are repeated. Meanwhile, if a positive judgment is made at Step S97, the control of the CPU 151 goes to Step S98 to supply five drive pulse signals to the thread cutting motor 88 so as to rotate the movable blade 81 by a predetermined small angle in the retracting direction.

Step S98 is followed by Step S99 to judge whether the main control device 100 is supplying the main-shaft drive signal having the H level to the main motor 110. If a positive judgment is made at Step S98, the control goes to Step S100 to judge whether the catcher-shaft control device 150 has received, from the main control device, a thread cutting signal to command the control device 150 to carry out the thread cutting routine of FIG. 19. If a negative judgment is made at Step S100, Steps S99 and S100 are repeated. Assuming that the main control device 100 supplies the thread cutting signal when the main shaft 17 is rotated to 260° during the formation of the N-th stitch, as shown in FIG. 20, a positive judgment is made at Step S100. Thus, the control of the CPU 151 goes to Step S101, i.e., the thread cutting routine of FIG. 19.

First, at Step S110, the CPU 151 judges whether the main shaft 17 has been rotated to 270° following the commencement of this routine. If a positive judgment is made at Step S110, the control of the CPU 151 goes to Step S111 to set the rotation-direction flag DF to "1". Then, the control goes to Step S112 to count the number of pulse signals which are supplied from the main control device 100 to the main motor 110 and, if the counted number increases up to eleven, supply one pulse signal to the thread cutting motor 88. Step S112 is followed by Step S113 to judge whether the operation of Step S112 has been repeated twenty times. If a negative judgment is made at Step S113, Steps S112 and S113 are repeated.

Meanwhile, if a positive judgment is made at Step S113, the control goes to Step S114 to count the number of pulse signals supplied from the control device 100 to the main motor 110 and, if the counted number increases up to four, supply one pulse signal to the thread cutting motor 88. Step S114 is followed by Step S115 to judge whether the operation of Step S114 has been repeated twenty seven times. If a negative judgment is made at Step S115, Steps S114 and S115 are repeated.

Figure 27:
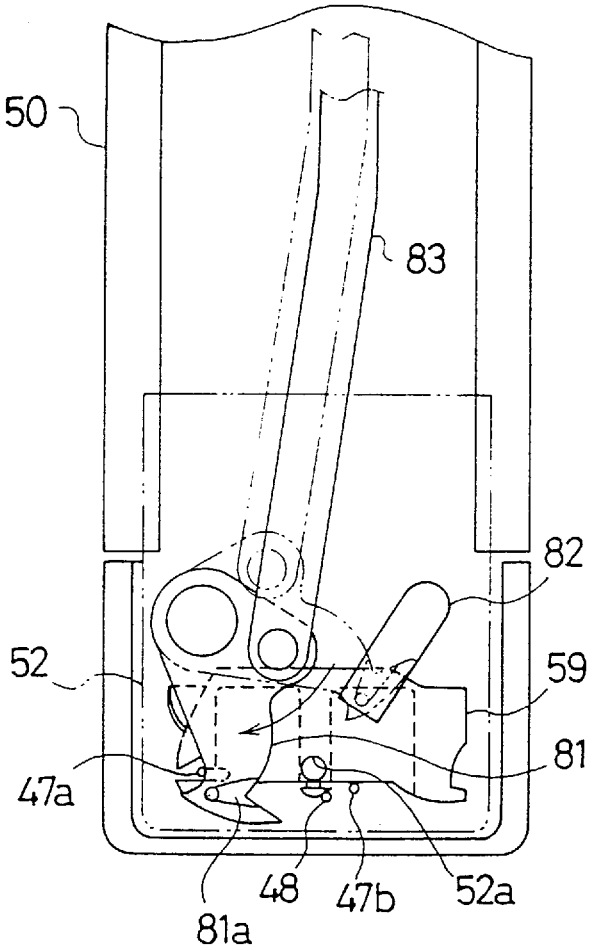
FIG. 27 is a view corresponding to FIG. 6, showing a manner in which a movable blade is rotated from its retracted position to its advanced (maximum rotation) position.

Meanwhile, if a positive judgment is made at Step S115, the control goes to Step S116 to count the number of pulse signals supplied from the control device 100 to the main motor 110 and, if the two signals are counted, supply one pulse signal to the thread cutting motor 88. Step S116 is followed by Step S117 to judge whether the operation of Step S116 has been repeated one hundred and twenty one times. If a negative judgment is made at Step S117, Steps S116 and S117 are repeated. As shown in FIG. 27, when the 121 pulse signals are supplied to the thread cutting motor 88 at Steps S116 and S117, the movable blade 81 separates a first portion 47*a* of the needle thread 47 on the side of the sewing needle 22, from a second portion 47*b* of the same 47 on the side of the work sheet W and the bobbin thread 48, after the loop 47*c* of the needle thread 47 has been released from a bifurcated, thread guiding portion 59*c* which is opposite to the point-of-hook 59*b* on the rotating hook 59*a* of the loop catcher 59.

FIG. 27 shows the advanced (maximum rotation) position of the movable blade 81 after the thread cutting motor 88 has been rotated in response to the 121 pulse signals. When the blade 81 is rotated back from the advanced position, the blade 81 is engageable with the bobbin thread 48 and the second portion 47*b* of the needle thread 47 on the side of the work sheet W.

Figure 26:
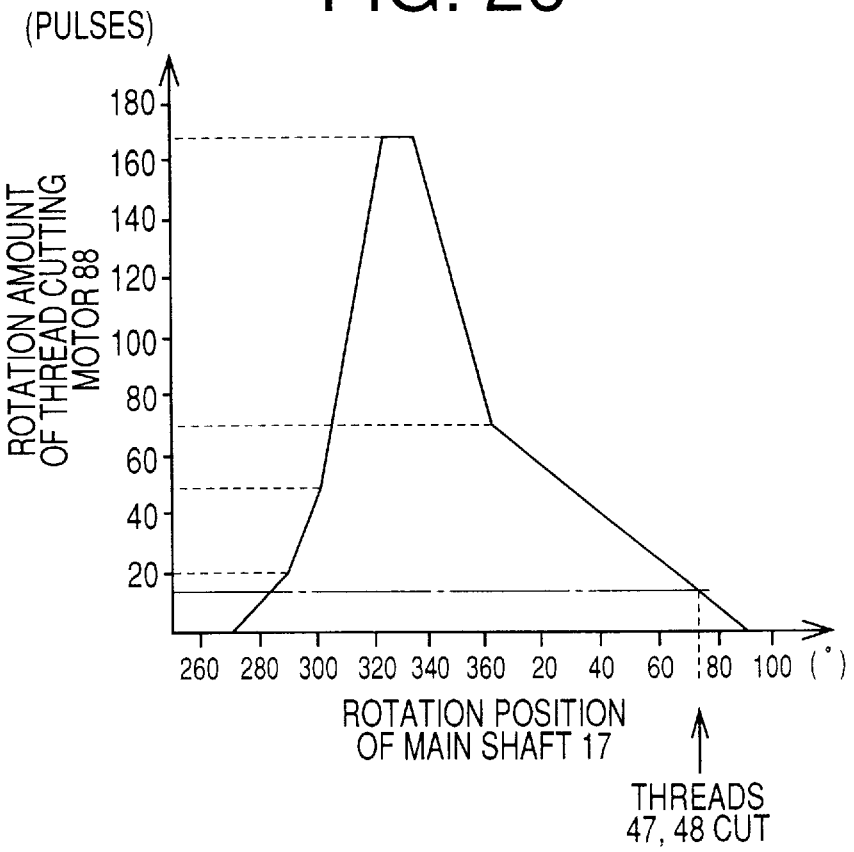
FIG. 26 is a graph illustrating the amount of operation (rotation) of a thread cutting motor, in comparison with the rotation position of the main shaft.

If a positive judgment is made at Step S117, the control of the CPU 151 goes to Step S118 to stop, as shown in FIG. 26, the operation of the thread cutting motor 88, thereby stopping the rotation of the movable blade 81, and judge whether the main shaft 17 has been rotated to 335° at which the rotation of the loop-catcher shaft 60 at the high speeds proportional to the rotation speed of the main shaft 17 is started. If a positive judgment is made at Step S118, the control goes to Step S119 to reset the rotation-direction flag to "0" so as to rotate the blade 81 in the retracting direction and then to Step S120 to count the number of pulse signals supplied from the control device 100 to the main motor 110 and, if the counted number increases up to three, supply one pulse signal to the thread cutting motor 88. Step S120 is followed by Step S121 to judge whether the operation of Step S120 has been repeated one hundred times. If a negative judgment is made at Step S120, Steps S120 and S121 are repeated. While Steps S120 and S121 are repeated, the notch 81*a* of the blade 81 engages the bobbin thread 48 and the second portion 47*b* of the needle thread 47 on the side of the work sheet W.

Figure 28:
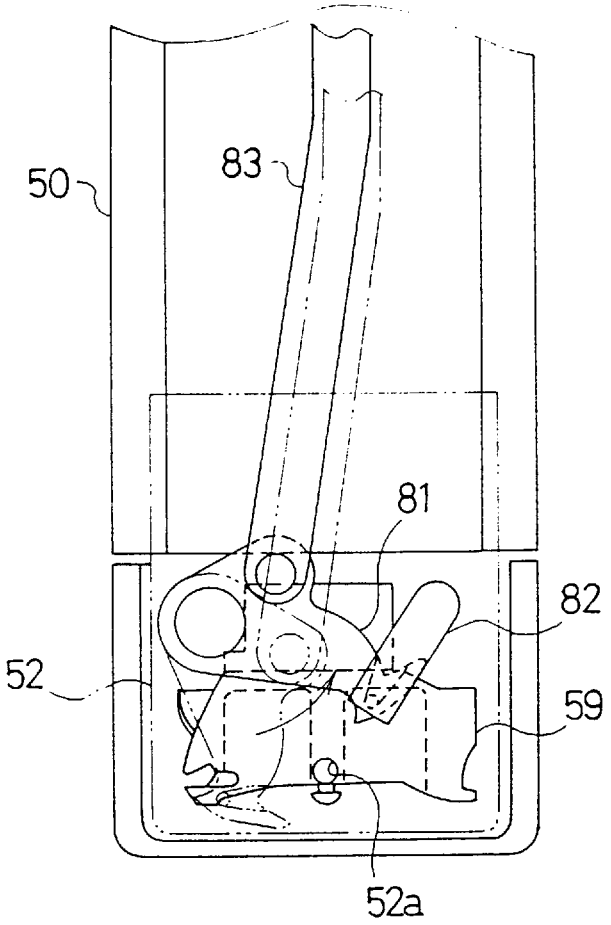
FIG. 28 is a view corresponding to FIG. 6, showing a manner in which the movable blade is rotated from its advanced (maximum rotation) position to its retracted position so that the movable blade engages a needle thread and a bobbin thread and cooperates with a stationary blade to cut the two threads simultaneously.

If a positive judgment is made at Step S121, the control of the CPU 151 goes to Step S122 to count the number of pulse signals supplied from the control device 100 to the main motor 110 and, if the counted number increases up to fourteen, supply one pulse signal to the thread cutting motor 88. Step S122 is followed by Step S123 to judge whether the control device 150 has received the position signal DS having the H level. If a negative judgment is made at Step S123, Steps S122 and S123 are repeated. As indicated in solid line in FIG. 28, at the end of the repetition of Steps S120 and S121, the movable blade 81 cooperates with the stationary blade 82 to cut simultaneously the needle and bobbin threads 47, 48. If a positive judgment is made at Step S123, the control goes to Step S124 to count the number of pulse signals supplied from the control device 100 to the main motor 110 and, if the counted number increases up to fourteen, supply one pulse signal to the thread cutting motor 88. Step S124 is followed by Step S125 to judge whether the operation of Step S124 has been repeated five times. If a negative judgment is made at Step S125, Steps S124 and S125 are repeated. Thus, the blade 81 is rotated by a predetermined small angle in the retracting direction.

A positive judgment made at Step S125 indicates that the movable blade 81 has been returned to the retracted position. Thus, the control of the CPU 151 quits this routine and goes to Step S99 of FIG. 18 to wait for the control device 150 to receive a thread cutting command from the main control device 100. In this situation, the cut ends of the needle thread 47 and the bobbin thread 48 on the side of the work sheet W are held by a thread holding device (not show) provided below the stationary blade 82.

The needle and bobbin threads 47, 48 are cut after the loop 47*c* of the needle thread 47 has been released from the loop catcher 59. The thread loop 47*c* is quickly released from the catcher 59 at the timing when the main shaft 17 is positioned at a predetermined rotation position while the loop-catcher shaft 60 is rotated at the high speeds proportional to the rotation speed of the main shaft 17. Thus, the thread loop 47*c* is released at a highly accurate timing and accordingly an accurate amount of the needle thread 47 is secured after the thread cutting operation. The thus secured amount of the needle thread 47 is so long that the cut, free end portion of the thread 47 is effectively prevented from coming off the eye hole of the sewing needle 22 when the next sewing operation is started.

Next, there will be described the operation of the multiple-head embroidering machine M, constructed as described above, for treating an abnormal state, i.e., an asynchronous state identified during a sewing operation.

When the catcher-shaft control device 150 operates according to the catcher-shaft synchronizing routine of FIG. 14 while an embroidery including N stitches is formed one stitch by one on the work sheet W, the control device 150 may not receive, at Steps S44 and S45, any catcher-shaft rotation signal from the second encoder sensor 65 although drive pulse signals are supplied to the loop-catcher drive motor 58, or may identify, at Step S50, that the amount of asynchronism between the main shaft 17 and the loop-catcher shaft 60 is greater than a reference permissible amount. In each case, the control device 150 operates, at Step S51, for forcibly jumping the needle bar 21 to which the sewing needle 22 is secured, up to the upper-dead position thereof. Thus, the needle 22 is effectively prevented from colliding with the loop catcher 59 in the first asynchronous state in which the amount of asynchronism between the main shaft 17 and the loop-catcher shaft 60 is greater than the reference amount or in the second asynchronous state in which it is expected from the judgment obtained at Step S45 that the amount of asynchronism will be greater than the reference amount.

In addition, the control device 150 may identify, at Step S49, that the detected voltage $V_K$ is lower than a reference low voltage $V_s$ at which the main motor 110 and/or the catcher-shaft drive motor 58 cannot normally operate. In this case, too, the control device 150 operates, at Step S51, for forcibly jumping the needle bar 21 up to the upper-dead position thereof. Thus, the sewing needle 22 is effectively prevented from colliding with the loop catcher 59 in the asynchronous state in which it is expected from the excessive voltage fall that the amount of asynchronism will be greater than the reference amount.

Figure 11:
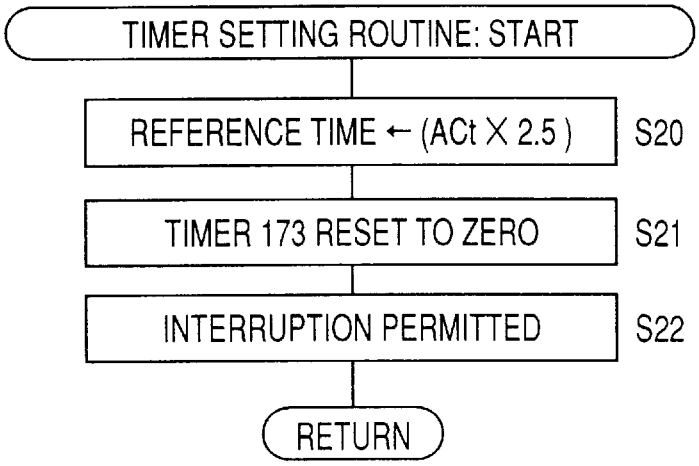
FIG. 11 is a flow chart representing a reference-time setting routine.

Moreover, the control device 150 may identify, from the control-interruption signal supplied thereto from the timer 173 at Step S22 of FIG. 11, that the electric-power supplying service has interrupted. In this case, too, the control device 150 operates, at Step S51, for forcibly jumping the needle bar 21 up to the upper-dead position thereof. Thus, the sewing needle 22 is effectively prevented from colliding with the loop catcher 59 in the asynchronous state in which it is expected from the interruption of the electric-power supplying service that the amount of asynchronism will be greater than the reference amount.

Furthermore, in order to jump up the needle bar 21 in each asynchronous state, the capacitor C quickly supplies the stored electricity to the needle-bar jumping solenoid 41 via the driver circuit 105, the solenoid 41 quickly and reliably operates for jumping up the bar 21.

Although in the illustrated embodiment the rotation of the loop-catcher shaft 60 is synchronized with the rotation of the main shaft 17, it is possible to synchronize the rotation of the main shaft 17 with the rotation of the loop-catcher shaft 60.

In addition, the main control device 100 and the catcher-shaft control device 150 may be modified such that only one of the two motors 100, 150 generates a series of synchronizing pulse signals which are commonly utilized by the main motor 100 and the catcher-shaft drive motor 58 so that the two motors 110, 58 are synchronized with each other.

Moreover, the service-interruption detector circuit 170 and/or the voltage-fall detector circuit 180 may be replaced by combining other kinds of electronic components and/or circuits.

The capacitor C may be incorporated into the driver circuit 105 which is provided for driving the needle-bar jumping solenoid 41.

The solenoid 41 may be adapted to be energized by a regenerative electric current which is generated when the main motor 110 and/or the catcher-shaft drive motor 58 are rotated due to their inertias.

The solenoid 41 may be modified such that it permits the needle bar 21 to jump up when it is deenergized due to the interruption of the electric-power supplying service.

The main motor 110 may be provided by various kinds of electric motors such as a stepper motor or an AC servomotor other than the induction motor employed in the illustrated embodiment, and the catcher-shaft drive motor 58 may be provided by various kinds of electric motors such as an induction motor or an AC servomotor other than the stepper motor employed in the illustrated embodiment.

Referring next to FIGS. 29 to 34, there will be described another embodiment of the present invention, which relates to a multiple-head embroidering machine, S. The embroidering machine S includes three multiple-needle sewing machines, S1, S2, S3. Each sewing machine S1–S3 includes a loop catcher 234 in the form of a full-rotation shuttle (FIG. 31) which catches a loop of a needle thread (not shown) conveyed by a sewing needle 211, and a loop-catcher drive motor 233 (FIG. 31) which drives or rotates a loop-catcher shaft 235 of the loop catcher 234 and which is independent of a main motor (not shown) which drives or rotates a main shaft (not shown) and thereby reciprocates the needle 211.

Figure 29:
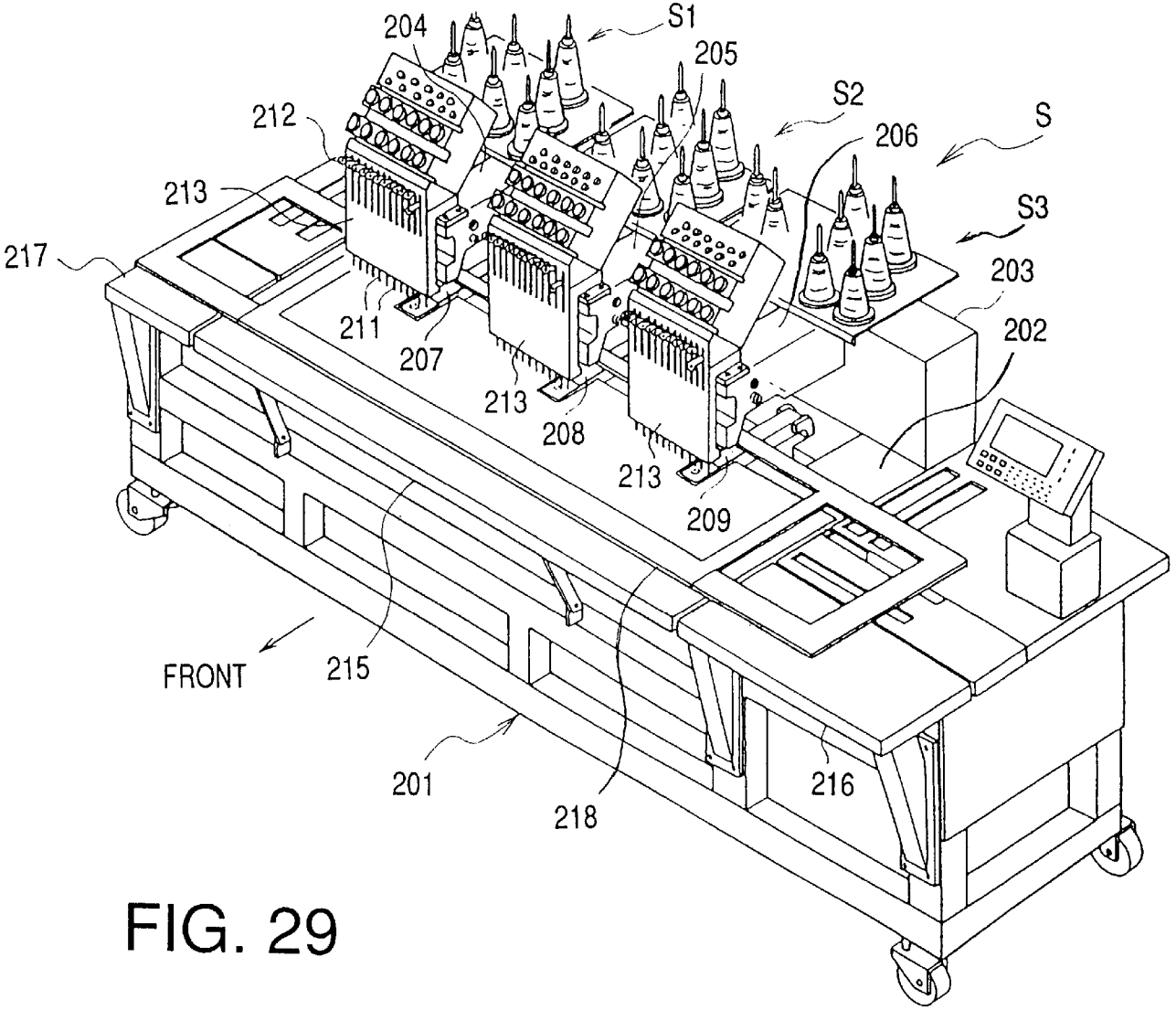
FIG. 29 is a perspective view of another multiple-head embroidering machine as a second embodiment of the present invention.

As shown in FIG. 29, the embroidering machine S includes an elongate base frame 201. A support plate 202 is provided on a rear portion of the base frame 201. The support plate 2 has a predetermined length in the longitudinal direction of the base frame 201, and has a generally rectangular shape in its plan view. An elongate support frame 203 stands on a rear portion of the support plate 202, and supports three sewing heads 204, 205, 206 such that the three sewing heads 204–206 are equidistant from one another in the longitudinal direction of the support frame 203. Respective end portions of three sewing beds 207, 208, 209 in the form of three, generally cylindrical bed units which correspond to the three sewing heads 204–206, respectively, are supported by an elongate portion of the base frame 201 which corresponds to a front end portion of the support plate 202.

Thus, the three multiple-needle sewing machines S1–S3 are provided by the three sewing heads 204–206 supported by the support frame 203, and the three bed units 207–209 which are independent of one another, respectively. A front end portion of the sewing head 204–206 of each sewing machine S1–S3 supports twelve needle bars (not shown) which are arranged in an array extending in the longitudinal direction of the base frame 201, such that one of the needle bars which is positioned or indexed at an operating position is reciprocated up and down by the main motor via the main shaft. Each sewing head 204–206 additionally has twelve take-up levers 212 which correspond to the twelve needle bars, respectively, and one of the twelve take-up levers 212 which corresponds to the said one needle bar being positioned at the operating position is swung in synchronism with the reciprocation of the said one needle bar. The needle bars and the take-up levers 212 are accommodated in a needle-bar case 213, which is supported by each sewing head 204–206 such that the needle-bar case 213 is movable in the longitudinal direction of the base frame 201. The respective needle-bar cases 213 of the three sewing heads 204–206 can be moved, simultaneously with one another, by a needle-bar changing device (not shown) which is driven by a needle-bar changing motor (not shown), so that color sewing threads conveyed by a current group of sewing needles 211 being positioned at the respective operating positions are changed to different color sewing threads conveyed by a new group of sewing needles 211.

A work table 215 is provided in front of the support plate 202 such that an upper surface of the work table 215 is flush with those of the bed units 207–209 and extends horizontally. An elongate movable frame 218 which extends in the longitudinal direction of the base frame 201 and has a rectangular shape in its plan view, is placed over the work table 215 and a pair of side tables 216, 217 which are provided on both sides of the work table 215, respectively. The movable frame 218 is driven or moved by an X-axis moving device (not shown) in an X-axis direction, i.e., in the longitudinal direction of the base frame 201, and is driven or moved by a Y-axis moving device (not shown) in a Y-axis direction perpendicular to the X-axis direction. The X-axis and Y-axis moving devices include an X-axis driving motor (not shown) and a Y-axis driving motor 119 (not shown), respectively. Thus, the movable frame 218 is movable to an arbitrary position on an X-Y plane defined by the X-axis and Y-axis directions.

Each sewing machine S1–S3 has a needle-bar drive device which drives or reciprocates the needle bar up and down, and a take-up lever drive device which drives or reciprocates the take-up lever 212 up and down. The needle-bar drive device and the take-up lever drive device are driven by the main motor (not shown) via the main shaft. Since the needle-bar and take-up lever drive devices employed in the present embroidering system S are well known in the art, the description thereof is omitted.

Each sewing head 204–206 includes a presser foot (not show) which is selectively moved to an operating position where the presser foot presses a work sheet (not shown) held by the movable frame 218 above the sewing bed 207–209, and a retracted position higher than the operating position by a predetermined distance. The presser foot is moved by a presser-foot moving device (not shown).

Figure 30:
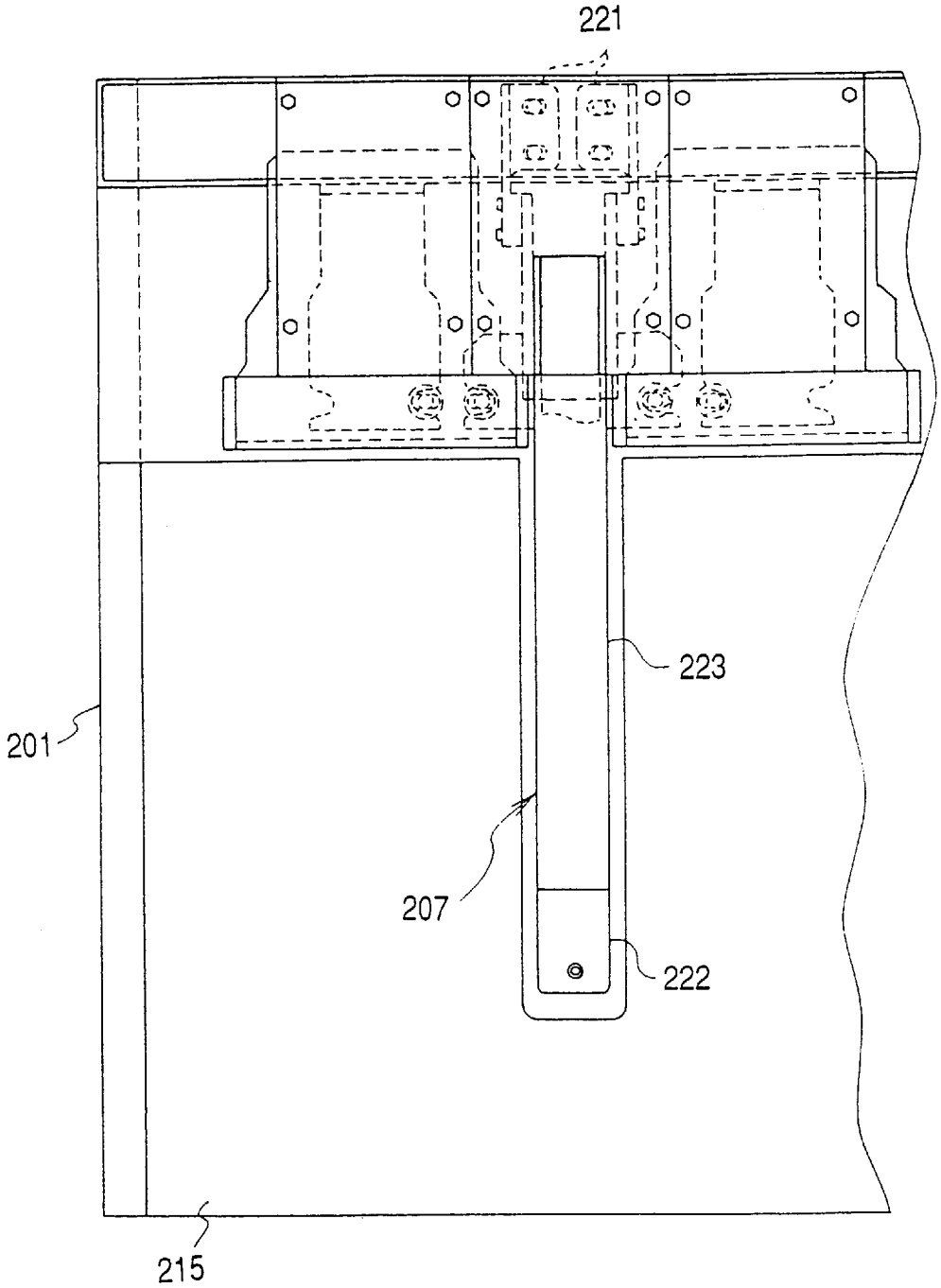
FIG. 30 is a plan view of a part of the machine of FIG. 29 which includes a part of a work table, and a bed unit.
Figure 31:
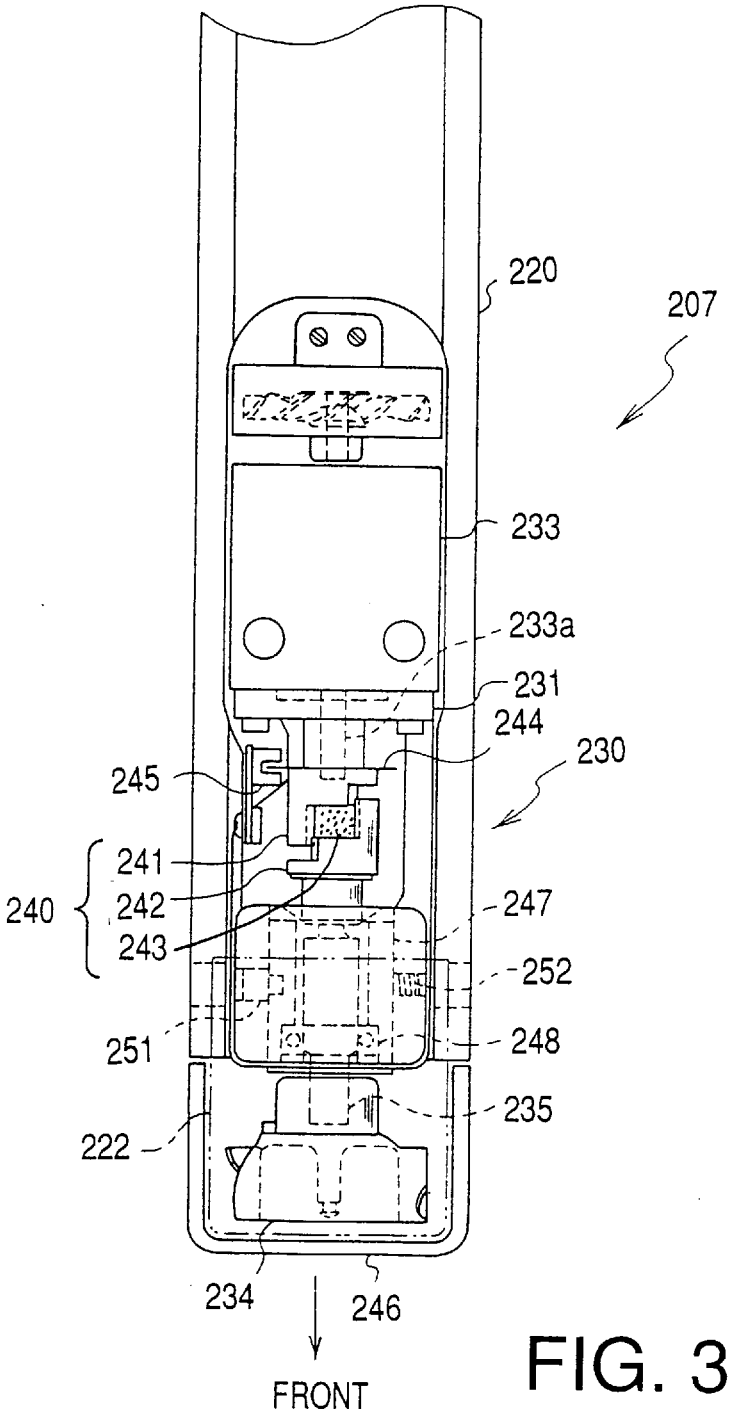
FIG. 31 is a plan view of a part of the bed unit which includes a loop-catcher module.
Figure 32:
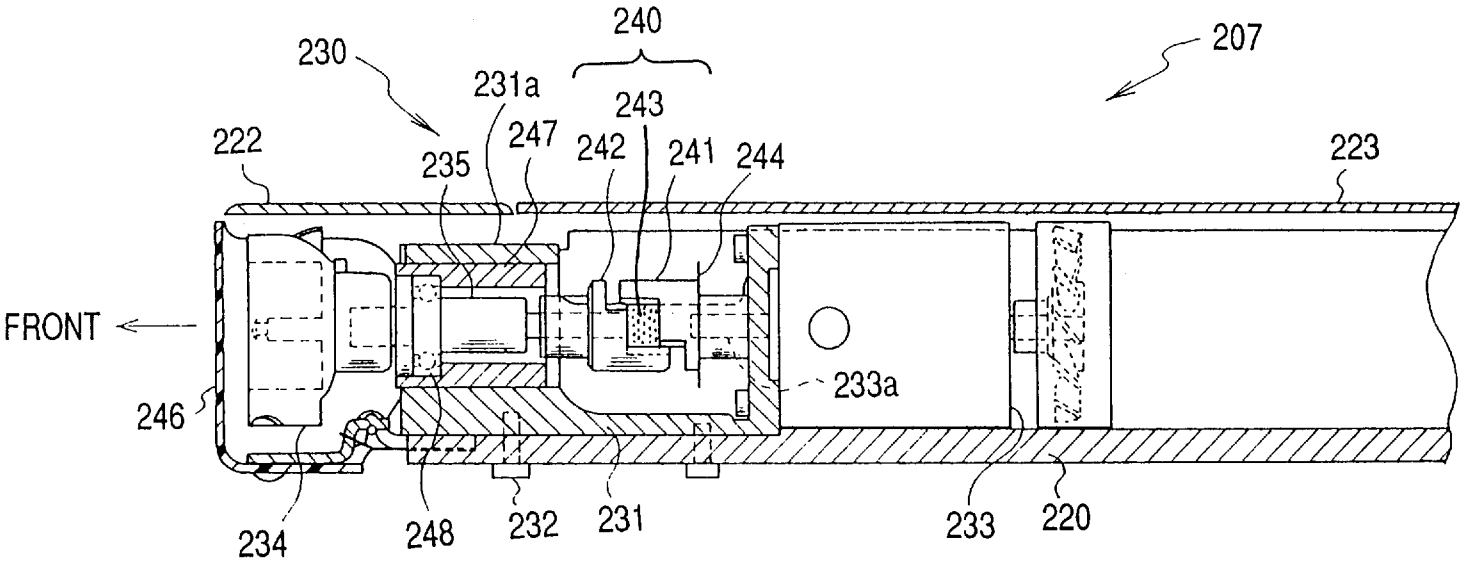
FIG. 32 is a longitudinal, cross-section view of the part of the bed unit including the loop-catcher module.

Referring next to FIGS. 30 to 32, there will be described the bed units 207–209. Since the three bed units 207–209 have the same construction, one 207 of the three units 208–209 will be described.

The bed unit 207 includes a bed case 220 which extends in the Y-axis direction and which has a generally U-shaped cross section. A rear end portion of the bed case 220 is attached to a pair of support brackets 221 which are fixed to the elongate portion of the base frame 201 which corresponds to the front end portion of the support plate 202 and which extends in the X-axis direction. A loop-catcher module or unit 230 is detachably attached to a front end portion of the bed case 220. An upper side of the front end portion of the bed case 220 is covered by a throat plate 222 having a needle throat, and a cover plate 223 provided adjacent to the throat plate 222.

Next, the loop-catcher module 220 will be described in detail.

As shown in FIGS. 31 and 32, an attachment block 231 is detachably attached, with screws 232, to the front end portion of the bed case 220, and a loop-catcher drive motor 233 which is provided by a stepper motor is fixed to a rear end of the block 231. The loop catcher 234 which is provided by a full-rotation shuttle is disposed in front of the block 231, and a loop-catcher shaft 235 which is fixed to the loop catcher 234 is supported by the block 231 such that the catcher shaft 235 is rotatable about an axis line thereof and such that the shaft 235 is movable in the Y-axis direction, that is, the position of the shaft 235 is adjustable in the Y-axis direction.

A rear end of the catcher shaft 235 is connected to an output or drive shaft 233*a* of the drive motor 233 by a coupling device 240.

The coupling device 240 includes a first connection member 241 fixed to a front end of the drive shaft 233*a* of the drive motor 233, a second connection member 242 fixed to the rear end of the catcher shaft 235, and a buffer member 243 sandwiched by, and between, the first and second connecting members 241, 242.

Figure 33:
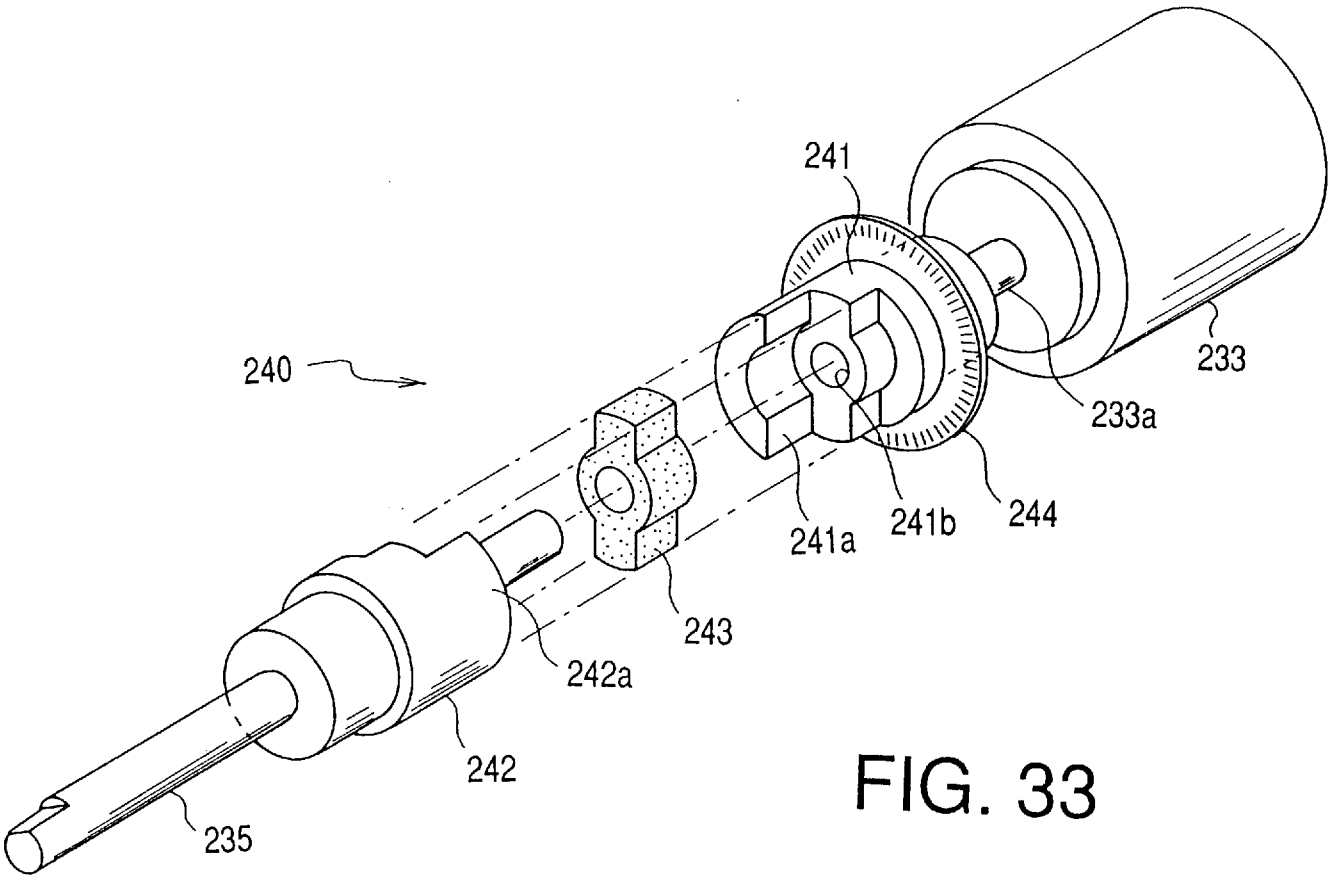
FIG. 33 is an enlarged, exploded view of a coupling device employed in the bed unit.

As shown in FIG. 33, the first connecting member 241 includes a part-doughnut drive-force output portion 241*a* which projects frontward parallel to an axis line of the drive shaft 233*a* of the drive motor 233. The part-doughnut output portion 241*a* extends over a first angle smaller than 180° about the axis line of the drive shaft 233*a*. The first connecting member 241 also has an engaging hole 241*b* which is concentric with the drive shaft 233*a* of the drive motor 233. The second connecting member 242 includes a part-doughnut drive-force input portion 242*a* which projects rearward parallel to an axis line of the catcher shaft 235 and is opposed to the part-doughnut output portion 241*a*. The part-doughnut input portion 242*a* extends over a second angle smaller than 180° about the axis line of the catcher shaft 235. The first and second angles are equal to each other. The buffer member 243, which may be formed of a hard rubber or a soft resin, is sandwiched between the output and input portions 241*a*, 242*a* such that the buffer member 243 is slightly compressed. The catcher shaft 235 extends through the second connecting member 242 and the buffer member 243 and engages (i.e., fits in) the engaging hole 241*b* of the first connecting member 242*b*, so that the catcher shaft 235 is concentrically connected to the drive shaft 233*a*.

The loop catcher 234 has the same construction as the loop catcher 59 shown in FIG. 23, and the description of the loop catcher 234 is omitted. The loop catcher 234 has a point-of-hook similar to the point-of-hook 59*b* shown in FIG. 23.

A circular encoder disk 244 which has a plurality of radially extending slits is concentrically fixed to a rear end portion of the first connecting member 241, and an encoder sensor 245 which is provided by a photosensor optically detects each of the slits of the encoder disk 244 and outputs encoder signals which include a motor-reference-position signal indicative of a reference position of the loop-catcher drive motor 233 and additionally include clock pulse signals. The encoder sensor 245 includes a light emitter 245*a* and a light receiver 245*b*, and is fixed to the attachment block 231 attached to the bed case 220, such that the light emitter and receiver 245*a*, 245*b* are opposed to each other via the encoder disk 244. When the catcher drive motor 233 is driven or operated, the rotation of the drive shaft 233*a* is transmitted to the catcher shaft 235 via the coupling device 240. Thus, the loop catcher 234 is rotated in a predetermined direction, at a rotation speed which is twice higher than that of the main shaft. The front end portion of the bed unit 207 is covered by a protection cover 246 which is pivotally hinged to a lower end of the front end portion of the bed case 220.

Next, there will be described a supporting device which supports the loop catcher 234 such that the position of the catcher 234 is adjustable in the Y-axis direction parallel to the axial direction of the catcher shaft 235.

The attachment block 231 includes a cylindrical portion 231*a* in which a cylindrical bearing case 247 is provided such that the bearing case 247 is movable in the Y-axis direction. A bearing 248 which supports the catcher shaft 235 such that the shaft 235 is rotatable about an axis line thereof, is press-fit in the bearing case 247. Thus, the catcher shaft 235 fixed to the loop catcher (i.e., full-rotation shuttle) 234 is supported by the bearing 248 fixed to the bearing case 247 such that the catcher shaft 235 is rotatable about the axis line thereof.

Next, there will be described a position adjusting device 250 which is operable for adjusting a position of the loop catcher 234 or the catcher shaft 235 in the Y-axis direction, i.e., in the axial direction of the shaft 235.

Figure 34:
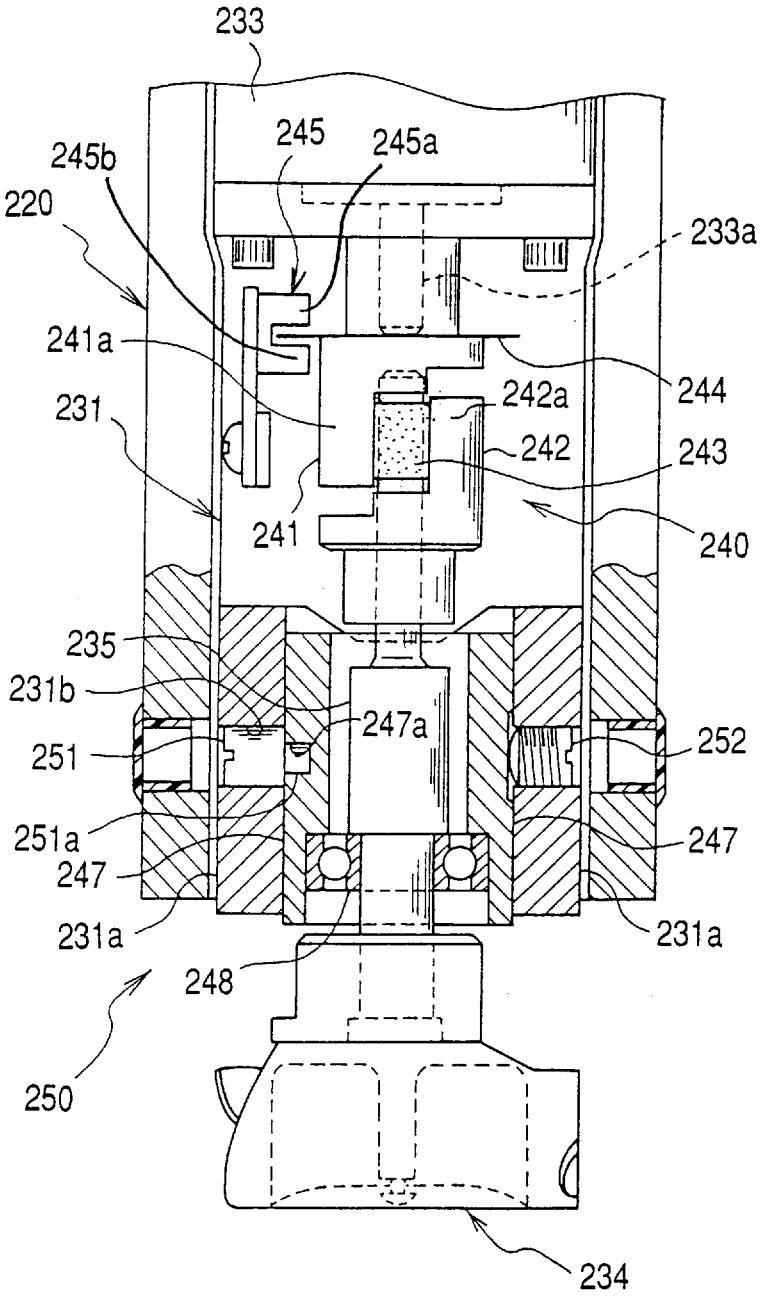
FIG. 34 is an enlarged plan view of a front end portion of the bed unit.

As shown in FIGS. 31 and 34, an eccentric pin 251 is provided in a pin hole 231*b* formed in one of opposite side walls of the cylindrical portion 231*a* of the attachment block 231, such that the eccentric pin 251 is rotatable and such that an eccentric projection 251*a* of the pin 251 is engaged with a circumferentially extending, elongate hole 247*a* formed in a corresponding side wall of the bearing case 247. An externally threaded set screw 252 is threadedly engaged with an internally threaded hole formed in the other side wall of the cylindrical portion 231*a* of the block 231. When the set vis 252 is fastened, the bearing case 247 is fixed in position relative to the block 231.

When the set vis 252 is manually loosened and the eccentric pin 251 is manually rotated in a clockwise or counterclockwise direction, the bearing case 247 can be moved by a small distance (e.g., 1 to 2 mm) frontward or rearward in the Y-axis direction, because of the engagement of the eccentric projection 251*a* with the elongate hole 247*a*. Thus, the position of the loop catcher 234 in the Y-axis direction can be finely adjusted, and accordingly the clearance provided between the point-of-hook of the loop catcher 234 and the sewing needle 211 can be appropriately adjusted.

Next, there will be described the operation of the bed unit 207 constructed as described above.

The drive or output shaft 233*a* of the catcher drive motor 233 is connected to the first connecting member 241, and the catcher shaft 235 fixed to the loop catcher 234 is connected to the second connecting member 242. The bearing 248 is fixed to the bearing case 247 which is movable in the axial direction thereof relative to cylindrical portion 231*a* of the attachment block 231, and the catcher shaft 235 is rotatably supported by the bearing 248.

The coupling device 240 includes the first connecting member 241 fixed to the drive shaft 233*a*, the second connecting member 242 fixed to the catcher shaft 235, and the buffer member 243 formed of, e.g., hard rubber or plastic. More specifically, the drive-force output portion 241*a* extending parallel to the drive shaft 233*a* is opposed to the drive-force input portion 242*a* extending parallel to the catcher shaft 235, in a direction perpendicular to the axial direction of the catcher shaft 235, and the buffer member 243 is sandwiched between the drive-force output and input portions 241*a*, 242*a* such that the buffer member 243 is slightly compressed. Thus, the coupling device 240 enjoys a simple construction. The coupling device 240 permits the catcher shaft 235 to be moved in the axial direction thereof relative to the drive shaft 233*a* without causing any substantial change of the angular phase of the catcher shaft 235 relative to the drive shaft 233*a*, while permitting the drive force to be transmitted from the output portion 241*a* to the input portion 242*a* opposed to the output portion 241*a*, via the buffer member 243.

In addition, since the buffer member 243 absorbs abrupt changes in the load applied from the loop catcher 234 to the catcher drive motor 233, the buffer member 243 can protect the drive motor 233. Moreover, since the drive-force output portion 241*a* does not directly contact the drive-force input portion 242*a*, noise can be prevented from being produced because of otherwise possible contacts thereof.

Furthermore, since the catcher shaft 235 extends through the second connecting member 242 and the buffer member 243 and fits in the engaging hole 241*b* of the first connecting member 241, the catcher shaft 235 is concentrically connected to the drive shaft 233*a*. Accordingly, the coupling device 240 enjoys a high drive-force transmitting efficiency.

When the eccentric pin 251 of the position adjusting device 250 is rotated in opposite directions, the clearance between the sewing needle 211 and the point-of-hook of the loop catcher 234 in the axial direction of the catcher shaft 235 can be easily adjusted with high accuracy. Thus, the needle clearance can be easily adjusted without causing any substantial change between the respective predetermined meeting positions of the point-of-hook of the loop catcher 234 and the sewing needle 211.

Referring next to FIG. 35A, and 35B, there will be described another coupling device 360 which may be employed in each of the bed units 207, 208, 209 of the embroidering machine S shown in FIG. 29. The coupling device 360 includes a first connecting member 361 fixed to the drive shaft 233*a* of the catcher drive motor 233, a second connecting member 362 fixed to the catcher shaft 235 of the loop catcher 234, and a buffer member 243 similar to the buffer member 243 shown in FIG. 33.

As shown in FIG. 35A, the first connecting member 361 includes a drive-force output portion 361*a*, a part-doughnut portion 361*b*, and a circular base portion 361*c*. The output portion 361*a* extends parallel to the drive shaft 233*a* from the part-doughnut portion 361*b*. The part-doughnut portion 361*b* extends over a first angle greater than 180° in a circumferential direction of the first connecting member 361. The second connecting member 362 includes an engaging portion 362*a*, a drive-force input portion 362*b*, and a circular base portion 362*c*. The input portion 362*a* extends parallel to the catcher shaft 235 from the base portion 362*c*, and is opposed to the output portion 361*a* of the first connecting member 361 via the buffer member 243. The engaging portion 362*a* includes a central circular portion and an outer part-doughnut portion which extends over a second angle smaller than 180° in a circumferential direction of the second connecting member. The outer part-doughnut portion may, not may not, be integrally formed with the central circular portion. The sum of the first and second angles is equal to, or slightly smaller than, 360°. The engaging portion 362*a* of the second connecting member 362 is engaged with the part-doughnut portion 361*b* of the first connecting member 361, so that the first and second connecting members 361, 362 are concentrically connected to each other. In this state, the buffer member 243 is slightly compressed between the drive-force output and input portions 361*a*, 362*b*, such that an upper projection 243*a* of the buffer member 243 is sandwiched between respective upper engaging surfaces of the output and input portions 361*a*, 362*b*, a lower projection 243*a* of the buffer member 243 is sandwiched between respective lower engaging surfaces of the output and input portions 361*a*, 362*b*, and a central circular portion 243*b* of the buffer member 243 is sandwiched between respective central part-cylindrical surfaces of the output and input portions 361*a*, 362*b*.

The engagement of the part-doughnut portion 361*a* of the first connecting member 361 with he engaging portion 362*a* of the second connecting member 362 contributes to concentrically connecting the first and second connecting members 361, 362, to each other. Thus, the present coupling device 360 enjoys the same advantages as those of the coupling device 240 shown in FIG. 33.

Figure 36A:
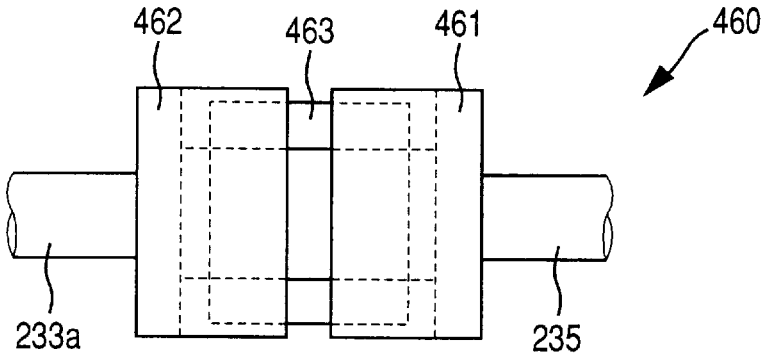
FIG. 36A is a side view of a first and a second connecting member and a buffer member of another coupling device which is employed in another sewing machine as a fourth embodiment of the present invention.
Figure 36B:
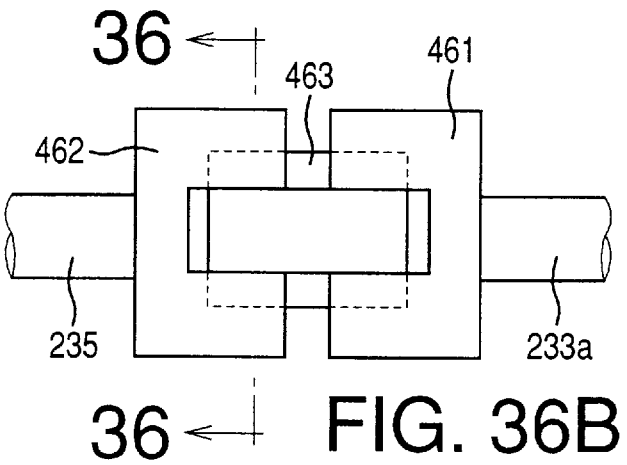
FIG. 36B is a plan view of the coupling device shown in FIG. 36A.
Figure 36C:
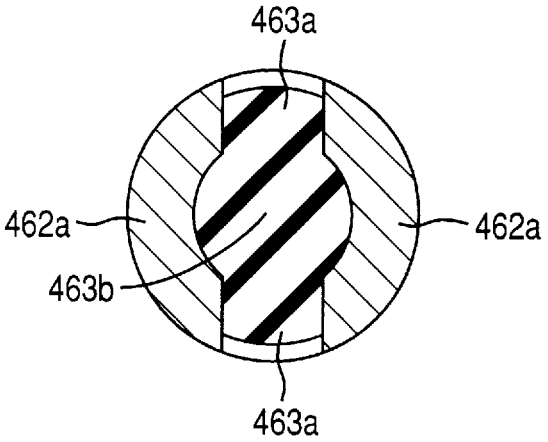
FIG. 36C is a cross-section view of the coupling device shown in FIG. 36A, taken along line 36—36 shown in FIG. 36B.

Referring next to FIG. 36A, 36B, and 36C, there will be described another coupling device 460 which may be employed in each of the bed units 207, 208, 209 of the embroidering machine S shown in FIG. 29. The coupling device 460 includes a first connecting member 461 fixed to the drive shaft 233*a* of the catcher drive motor 233, a second connecting member 462 fixed to the catcher shaft 235 of the loop catcher 234, and a buffer member 463 formed of a rubber or a resin.

The buffer member 463 has an upper and a lower rectangular projection 463*a*, 463*a* and a central cylindrical portion 463*b*. As shown in FIG. 36A, two axially opposite end portions of the buffer member 463 are press-fit in respective engaging grooves of the first and second connecting members 461, 462, respectively, such that the buffer member 463 is slightly compressed. The second connecting member 462 has two projections 462*a*, 462*a* defining the engaging groove. The first connecting member 461 also has similar projections. In this state, there are left some distance between the two connecting members 461, 462 which defines a maximum distance over which the loop catcher 234 or the catcher shaft 235 is movable in the axial direction of the shaft 235. When the catcher drive motor 233 is driven and the drive shaft 233*a* is rotated, the buffer member 463 is subject to shear stresses.

The buffer member 463 contributes to concentrically connecting the first and second connecting members 461, 462 to each other. The coupling device 460 enjoys the same advantages of the coupling device 240 shown in FIG. 33 or the coupling device 360 shown in FIG. 35A.

Figure 37:
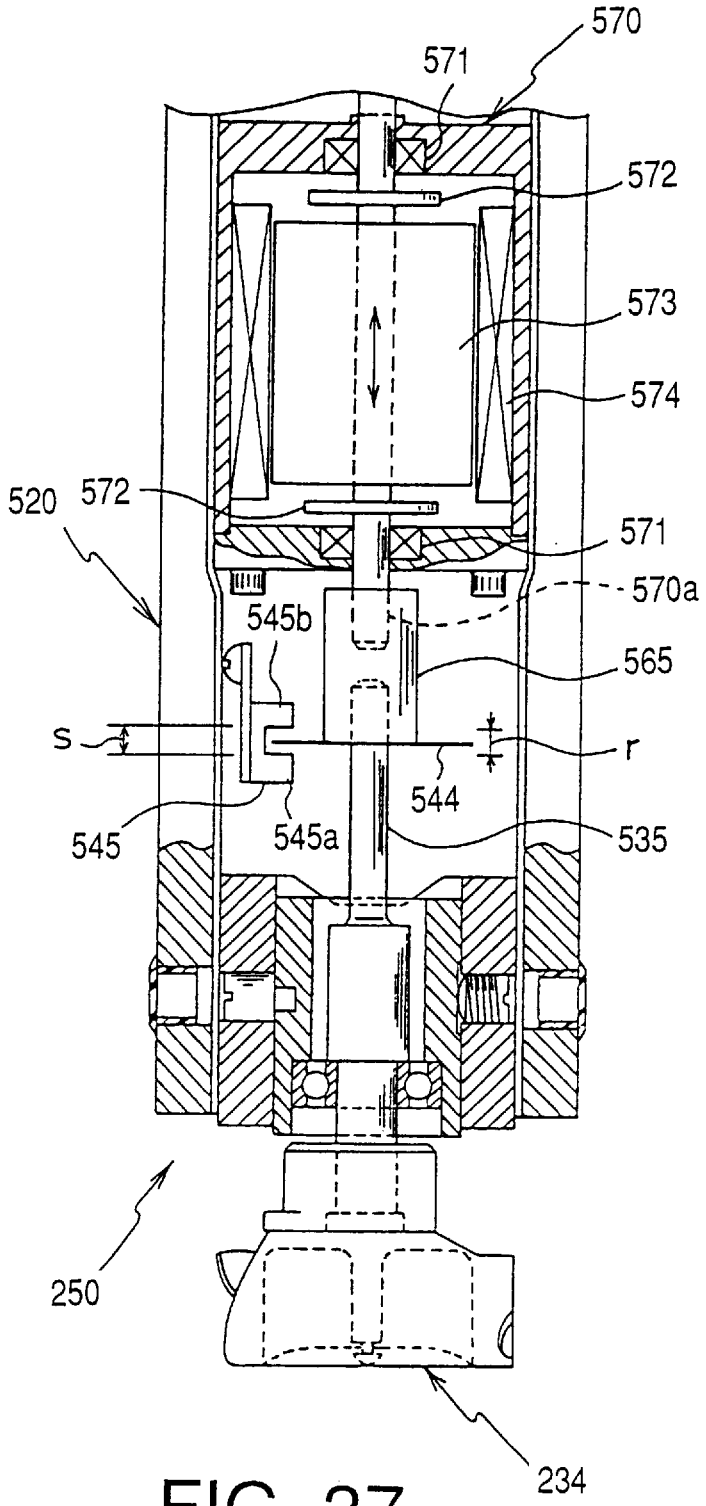
FIG. 37 is a partly cross-section, plan view of a front end portion of a bed unit which is employed in another sewing machine as a fifth embodiment of the present invention.

Referring next to FIG. 37, there will be described another loop-catcher module which may be employed in place of the loop-catcher module 230 shown in FIG. 31.

In the present embodiment, a coupling member 565 is used to integrally connect the catcher shaft 235 to a drive or output shaft 570*a* of a catcher-shaft drive motor 570. In the present embodiment, the catcher shaft 235 and the drive shaft 570*a* integrally connected to each other are movable as a unit in the axial direction of the catcher shaft 235.

Two axially opposite end portions of the drive shaft 570*a* of the catcher drive motor 570 are supported by two angular bearings 571 fixed to a motor casing attached to the bed case 220, such that the drive shaft 570*a* is rotatable about an axis line thereof and is movable in an axial direction thereof relative to the motor casing or bed case 520. Two stopper rings 572 are fixed to the drive shaft 570*a*, such that there are left respective distances between the two stopper rings 572 and corresponding walls of the motor casing, so that the drive shaft 570*a* and accordingly the catcher shaft 535 are movable in the axial direction of the shaft 535. The electric motor 570 includes a rotor 573 fixed to the drive shaft 570*a*, and an electrically energizeable coil (i.e., stator) 574 fixed to the motor casing. Wherever the drive shaft 570*a* may be moved in an axial direction thereof, the rotor 573 and drive shaft 570*a* can be electromagnetically rotated.

A circular encoder disk 544 is fixed to the coupling member 565 which integrally connects the catcher shaft 535 and the drive shaft 570*a*. An encoder sensor 545 which is fixed to the attachment block 231 includes a light emitter 545*a* and a light receiver 545*b* which is opposed to the light emitter 545*a* via the encoder disk 544. The light emitter and receiver 545*a*, 545*b* are distant from each other by a distance, s, which defines a maximum distance, r, (e.g., 2 to 3 mm) over which the drive shaft 570*a* or the catcher shaft 235 is movable in the axial direction thereof. In the present embodiment, the position adjusting device 250 shown in FIG. 34 is employed for adjusting a position of the loop catcher 234 in the axial direction of the catcher shaft 235.

Thus, the present loop-catcher module enjoys the same advantages of the loop-catcher module 230 shown in FIG. 31. In addition, the present module enjoys the advantage that even if the drive shaft 570*a* is moved in the axial direction thereof, the encoder disk 544 does not collide with the encoder sensor 545.

Figure 38A:
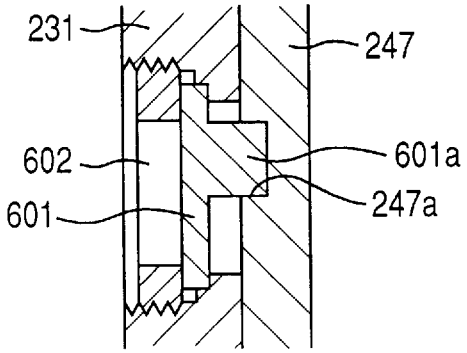
FIG. 38A is a cross-section view of another position adjusting device which is employed in another sewing machine as a sixth embodiment of the present invention.
Figure 38B:
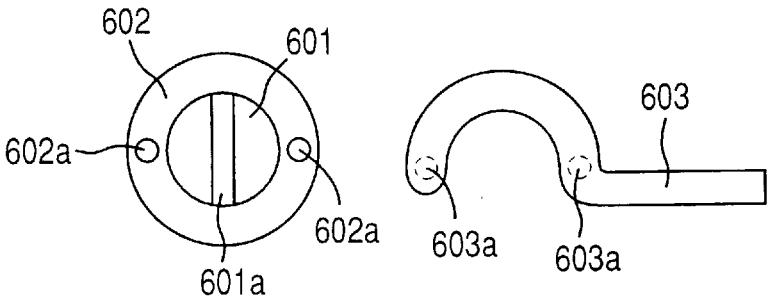
FIG. 38B is a view of a rotatable adjusting member and an externally threaded nut of the position adjusting device shown in FIG. 38A, and a tool which is used for fastening and unfastening the nut and thereby pressing the adjusting member against a housing of the sewing machine.

Referring next to FIGS. 38A and 38B, there will be another position adjusting device which may be employed in place of the position adjusting device 250 shown in FIG. 34.

The present adjusting device includes an eccentric pin 601 having an eccentric projection 601*a* which is engaged with the elongate hole 247*a* formed in the bearing case 247. The eccentric pin 601 includes a base portion from which the projection 601*a* projects and which is engageable with a circular shoulder portion of the attachment block 231. The adjusting device further includes an externally threaded nut 602 which is threaded engaged with an internally threaded hole formed in the block 231 such that the threaded hole is adjacent to the circular shoulder portion. The nut 602 has two holes 602*a*, 602*a* which are engageable with two projections 603*a*, 603*a* of a tool 603.

After the nut 602 is unfastened using the tool 603 in such a manner that the projections 603*a* are engaged with the holes 602*a*, a screw drive is engaged with a groove 601*a* of the eccentric pin 601 to rotate the pin 601 in one of opposite directions, so that the bearing case 247 and accordingly the catcher shaft 235 are moved in the axial direction of the shaft 235 and the position of the loop catcher 234 is adjusted in the axial direction of the shaft 235. Then, the tool 603 is used to fasten the nut 602 to press the pin 601 to the block 231, so that the eccentric projection 601*a* is fixed in position in the axial direction of the shaft 235. In the present embodiment, the set vis 252 employed in the position adjusting device 250 shown in FIG. 34 may be omitted.

While the present invention has been described in its preferred embodiments, the invention may otherwise be embodied.

For example, the coupling device 240 may be replaced by a first connecting member having a polygonal cross section and a second connecting member which externally fits on the first connecting member, or a first connecting member having a pair of plate-like projections opposed to each other and a second connecting member having a plate-like projection which fits in, or is sandwiched between, the two projections of the first connecting member.

In addition, in the embodiment shown in FIGS. 37, the drive shaft 570*a* and the catcher shaft 535 which are integrally connected by the coupling member 565 may be replaced by a single shaft which is fixed to the loop catcher 234 and which is driven or rotated by the electric motor 570. In this case, the coupling member 565 may be omitted.

The principle of the present invention is applicable to various kinds of sewing machines, such as a single-head embroidering machine having a single sewing head, or a sewing machine in which a loop catcher is driven or rotated owing to a driving force obtained from a main motor via a main shaft.

In addition, the principle of the present invention is applicable to a sewing machine in which a half-rotation shuttle or a looper is employed in the full-rotation shuttle 34, 234.

It is to be understood that the present invention may be embodied with other changes, improvements, and modifications that may occur to those skilled in the art without departing from the scope and spirit of the invention defined in the appended claims.

What is claimed is:

1. A sewing machine, comprising:

a needle bar to which a sewing needle conveying a sewing thread is secured;

a loop catcher which catches a loop of the sewing thread conveyed by the sewing needle;

a catcher shaft which is fixed to said loop catcher;

a first drive device which includes an output shaft and which rotates said catcher shaft about an axis thereof and thereby rotates said loop catcher;

a supporting device which is not rotatable, and which supports said catcher shaft such that the catcher shaft is rotatable about said axis thereof relative to said supporting device and is not movable in an axial direction thereof relative to the supporting device; and coupling means for connecting said catcher shaft to said output shaft of said first drive device such that a drive force of said first drive device is transmitted to said loop catcher via the output shaft, said coupling means and the catcher shaft, wherein the catcher shaft is movable in said axial direction thereof relative to the output shaft while a phase of the catcher shaft relative to the output shaft is substantially maintained.

2. A sewing machine according to claim 1, further comprising a main shaft to which said needle bar is connected, and a second drive device which rotates said main shaft and thereby reciprocates said needle bar, said first drive device being independent of said second drive device.

3. A sewing machine according to claim 1, wherein said coupling means comprises a first connecting member which is fixed to said output shaft of said drive motor and which includes a drive-force output portion, a second connecting member which is fixed to said catcher shaft fixed to said loop catcher and which includes a drive-force input portion, and a buffer member which is provided between said drive-force output and input portions.

4. A sewing machine according to claim 3, wherein said buffer member is formed of a material selected from the group consisting of a rubber and a resin.

5. A sewing machine according to claim 3, wherein one of said first and second connecting members which is fixed to a corresponding one of said output shaft and said catcher shaft includes an engaging portion which engages the other one of the output shaft and the catcher shaft such that said other shaft is not movable relative to said engaging portion in a direction perpendicular to said axial direction of the catcher shaft, so that the output shaft and the catcher shaft are concentrically connected to each other.

6. A sewing machine according to claim 5, wherein said engaging portion comprises at least one of an engaging hole and an engaging projection.

7. A sewing machine according to claim 3, wherein said first connecting member includes said drive-force output portion extending parallel to said output shaft, said second connecting member includes said drive-force input portion extending parallel to said catcher shaft and being opposed to said drive-force output portion in a direction perpendicular to said axial direction of the catcher shaft, and said buffer member is sandwiched between said drive-force output and input portions.

8. A sewing machine according to claim 3, wherein said first connecting member additionally includes one of (a) a first engaging portion including a circular portion having a first outer diameter and a first part-doughnut portion which has a first inner diameter equal to the first outer diameter and a second outer diameter greater than the first inner diameter and which is integral with said circular portion and extends over a first angle smaller than 180° and (b) a second engaging portion including a second part-doughnut engaging portion which has the first inner diameter and the second outer diameter and which extends over a second angle which is greater than 180° and adds to the first angle to provide 360°, and said second connecting member additionally includes the other of said first and second engaging portions, said first and second engaging portions engaging each other such that the first and second engaging portions are not movable relative to each other in a direction perpendicular to said axial direction of the catcher shaft, so that the output shaft and the catcher shaft are concentrically connected to each other.

9. A sewing machine according to claim 3, wherein said first connecting member includes said drive-force output portion which engages a first engaging portion of said buffer member such that the buffer member is not movable relative to the drive-force output portion in a direction perpendicular to said axial direction of said catcher shaft, and said second connecting member includes said drive-force input portion which engages a second engaging portion of the buffer member such that the buffer member is not movable relative to the drive-force input portion in said direction perpendicular to said axial direction and which is opposed via the buffer member to the drive-force output portion in said axial direction.

10. A sewing machine according to claim 1, further comprising a position adjusting device which is operable for moving said catcher shaft in said axial direction thereof and thereby adjusting a position of the catcher shaft relative to said output shaft of said drive motor in said axial direction.

11. A sewing machine according to claim 10, further comprising a housing in which said catcher shaft and said output shaft of said drive motor are accommodated, wherein said position adjusting device comprises a rotatable adjusting member which is supported by said housing such that said adjusting member is rotatable about an axis line thereof and which has a first engaging portion which is eccentric with respect to said axis line, a case member which is movable relative to said housing in said axial direction of the catcher shaft and which has a second engaging portion which is engaged with said first engaging portion, and at least one bearing which is fixed to said case member and which bears the catcher shaft while permitting the rotation thereof and inhibiting the movement thereof relative thereto in said axial direction.

12. A sewing machine, comprising:

a needle bar to which a sewing needle conveying a sewing thread is secured;

a loop catcher which catches a loop of the sewing thread conveyed by the sewing needle;

a catcher shaft which is fixed to said loop catcher;

a drive device which includes an output shaft and which rotates said catcher shaft about an axis thereof and thereby rotates said loop catcher, said catcher shaft being integrally connected to said output shaft of said drive device, so that a drive force of said drive device is transmitted to said loop catcher via the output shaft and the catcher shaft, the catcher shaft being movable in an axial direction thereof together with said loop catcher and the output shaft of the drive device; and a position adjusting device which is operable for moving said catcher shaft and said output shaft of said drive device integrally connected to each other, in said axial direction of the catcher shaft, and thereby adjusting a position of said loop catcher in said axial direction.

13. A sewing machine according to claim 12, wherein said drive device comprises an electric motor including a rotor and a stator, said output shaft including a first portion fixed to said rotor, and a pair of bearings which bear a second and a third portion of said output shaft on both sides of said first portion thereof, respectively, while permitting the rotation of the output shaft and the movement thereof with said catcher shaft in said axial direction.

14. A sewing machine according to claim 12, further comprising a housing in which said catcher shaft and said output shaft of said drive motor are accommodated, and a rotary encoder including a rotary plate which has a plurality of slits and which is fixed to said output shaft and said catcher shaft integrally connected to each other, and a light emitter and a light receiver which are fixed to said housing and are opposed to each other via said rotary plate, said light emitter emitting a light toward said light receiver, said light receiver receiving the light emitted by the light emitter and transmitted through each of the slits of the rotary plate, said light emitter and receiver being remote from each other by a distance which defines a greatest possible distance over which said loop catcher is movable in said axial direction.

15. A sewing machine according to claim 12, wherein said catcher shaft and said output shaft of said drive device are provided by a single shaft member.

16. A sewing machine, comprising a needle bar to which a sewing needle conveying a sewing machine thread is secured;

a loop catcher which catches a loop of the sewing thread conveyed by the sewing needle;

a catcher shaft which is fixed to said loop catcher;

a drive device which includes an output shaft connected to said catcher shaft and which rotates the catcher shaft about an axis thereof and thereby rotates said loop catcher;

a supporting device which is not rotatable, and which supports said catcher shaft, wherein the catcher shaft is rotatable about said axis thereof relative to said supporting device and is not movable in an axial direction thereof relative to the supporting device; and a position adjusting device which is operable for moving said supporting device in said axial direction of the catcher shaft and thereby adjusting a position of said loop catcher in said axial direction.

17. A sewing machine according to claim 16, further comprising a housing in which said catcher shaft and said output shaft of said drive motor are accommodated, wherein said supporting device comprises a case member which is movable relative to said housing in said axial direction of the catcher shaft, and at least one bearing which is fixed to said case member and which bears the catcher shaft while permitting the rotation thereof and inhibiting the movement thereof relative thereto in said axial direction.

18. A sewing machine according to claim 17, wherein said position adjusting device comprises a rotatable adjusting member which is supported by said housing such that said adjusting member is rotatable about an axis line thereof and which has a first engaging portion which is eccentric with respect to said axis line, and a second engaging portion of said case member which is engaged with said first engaging portion.

19. A sewing machine according to claim 18, wherein said position adjusting device further comprising a fastening device which fastens said case member to said housing to inhibit the movement of the case member in said axial direction of said catcher shaft and unfastens the case member from the housing to permit the case member to be moved in the axial direction of the catcher shaft as a result of rotation of said rotatable adjusting member.

20. A sewing machine according to claim 19, wherein said fastening device comprises an engaging surface of said case member, and an externally threaded member which is threadedly engaged with an internally threaded hole of said housing and which is engageable with said engaging surface to fasten the case member to the housing.

21. A sewing machine according to claim 18, wherein said position adjusting device further comprising a fastening device which fastens said rotatable adjusting member to said housing to inhibit the rotation of the adjusting member and thereby inhibit the movement of said case member in said axial direction of said catcher shaft and unfastens the adjusting member from the housing to permit the adjusting member to be rotated to move the case member in the axial direction of the catcher shaft.

22. A sewing machine according to claim 21, wherein said fastening device comprises an externally threaded member, an engaging portion of said housing which is engageable with a base portion of said rotatable adjusting member, and an internally threaded hole of the housing in which said base portion of the adjusting member is provided and with which said externally threaded member is threadedly engaged to press the adjusting member against said engaging portion of the housing so as to fasten the adjusting member to the housing.

23. A sewing machine according to claim 16, further comprising a housing in which said catcher shaft and said output shaft of said drive motor are accommodated, wherein said supporting device comprises a case member which is movable relative to said housing in said axial direction of the catcher shaft, and at least one bearing which is fixed to said case member and which bears the catcher shaft while permitting the rotation thereof and inhibiting the movement thereof relative thereto in said axial direction, and wherein said position adjusting device comprising a rotatable adjusting member which is supported by said housing such that said adjusting member is rotatable about an axis line thereof and which has engaging projection which is eccentric with respect to said axis line, and an engaging elongate hole of said case member which is engaged with said engaging projection.

24. A sewing machine according to claim 16, further comprising coupling means which connects said catcher shaft to said output shaft of said drive device such that a drive force of said drive device is transmitted to said loop catcher via the output shaft, said coupling device and the catcher shaft, and such that the catcher shaft is movable in said axial direction thereof relative to the output shaft while a phase of the catcher shaft relative to the output shaft is substantially maintained.

25. A sewing machine according to claim 16, wherein said catcher shaft is integrally connected to said output shaft of said drive device so that a drive force of said drive device is transmitted to said loop catcher via the output shaft and the catcher shaft, the catcher shaft being movable in said axial direction thereof together with the output shaft as well as said loop catcher.

* * * * *